US009293104B2

(12) United States Patent
Yamazaki et al.

(10) Patent No.: US 9,293,104 B2
(45) Date of Patent: Mar. 22, 2016

(54) LIQUID CRYSTAL DISPLAY DEVICE

(75) Inventors: Shunpei Yamazaki, Setagaya (JP); Jun Koyama, Sagamihara (JP); Hiroyuki Miyake, Atsugi (JP); Kouhei Toyotaka, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 188 days.

(21) Appl. No.: 13/167,023

(22) Filed: Jun. 23, 2011

(65) Prior Publication Data

US 2012/0001955 A1 Jan. 5, 2012

(30) Foreign Application Priority Data

Jul. 2, 2010 (JP) ..... 2010-152158

(51) Int. Cl.

| | |
|---|---|
| ***G09G 5/10*** | (2006.01) |
| ***G09G 3/36*** | (2006.01) |
| *G09G 3/34* | (2006.01) |

(52) U.S. Cl.

CPC ..... *G09G 3/3677* (2013.01); *G09G 3/3688* (2013.01); *G09G 3/3413* (2013.01); *G09G 2310/0235* (2013.01)

(58) Field of Classification Search

None

See application file for complete search history.

(56) References Cited

U.S. PATENT DOCUMENTS

| | | | |
|---|---|---|---|
| 5,731,856 | A | 3/1998 | Kim et al. |
| 5,744,864 | A | 4/1998 | Cillessen et al. |
| 6,294,274 | B1 | 9/2001 | Kawazoe et al. |
| 6,448,951 | B1 | 9/2002 | Sakaguchi et al. |
| 6,563,174 | B2 | 5/2003 | Kawasaki et al. |
| 6,727,522 | B1 | 4/2004 | Kawasaki et al. |

(Continued)

FOREIGN PATENT DOCUMENTS

| | | | |
|---|---|---|---|
| EP | 1737044 | A | 12/2006 |
| EP | 1992983 | A | 11/2008 |

(Continued)

OTHER PUBLICATIONS

Baron et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Nicholas Lee
*Assistant Examiner* — Duane N Taylor, Jr.
(74) *Attorney, Agent, or Firm* — Eric J. Robinson; Robinson Intellectual Property Law Office, P.C.

(57) ABSTRACT

The liquid crystal display device includes a pixel portion including first and second regions and light sources. The first and second regions each include a liquid crystal element whose transmissivity is controlled in accordance with a voltage of an image signal and a transistor for controlling holding of the voltage, whose off-state current is extremely low. The light sources perform first and second drivings: lights whose hues are different from each other are sequentially supplied to the first region in a first rotating order and the lights are sequentially supplied to the second region in a second rotating order which is different from the first rotating order in the first driving; and a light having a single hue is supplied consecutively to one or both of the first and second regions in the second driving. The period for holding the voltage is different between the first and second drivings.

16 Claims, 32 Drawing Sheets

(56) References Cited

U.S. PATENT DOCUMENTS

| | | | |
|---|---|---|---|
| 6,882,012 | B2 | 4/2005 | Yamazaki et al. |
| 7,049,190 | B2 | 5/2006 | Takeda et al. |
| 7,061,014 | B2 | 6/2006 | Hosono et al. |
| 7,064,346 | B2 | 6/2006 | Kawasaki et al. |
| 7,105,868 | B2 | 9/2006 | Nause et al. |
| 7,193,593 | B2 | 3/2007 | Koyama et al. |
| 7,211,825 | B2 | 5/2007 | Shih et al |
| 7,224,339 | B2 | 5/2007 | Koyama et al. |
| 7,250,996 | B2 | 7/2007 | Yoshida et al. |
| 7,268,756 | B2 | 9/2007 | Koyama et al. |
| 7,282,782 | B2 | 10/2007 | Hoffman et al. |
| 7,297,977 | B2 | 11/2007 | Hoffman et al. |
| 7,317,438 | B2 | 1/2008 | Yamazaki et al. |
| 7,323,356 | B2 | 1/2008 | Hosono et al. |
| 7,385,224 | B2 | 6/2008 | Ishii et al. |
| 7,385,579 | B2 | 6/2008 | Satake |
| 7,402,506 | B2 | 7/2008 | Levy et al. |
| 7,411,209 | B2 | 8/2008 | Endo et al. |
| 7,425,937 | B2 | 9/2008 | Inukai |
| 7,453,065 | B2 | 11/2008 | Saito et al. |
| 7,453,087 | B2 | 11/2008 | Iwasaki |
| 7,462,862 | B2 | 12/2008 | Hoffman et al. |
| 7,468,304 | B2 | 12/2008 | Kaji et al. |
| 7,486,361 | B2 | 2/2009 | Yoshida et al. |
| 7,501,293 | B2 | 3/2009 | Ito et al. |
| 7,674,650 | B2 | 3/2010 | Akimoto et al. |
| 7,732,819 | B2 | 6/2010 | Akimoto et al. |
| 7,751,003 | B2 | 7/2010 | Yoshida et al. |
| 7,791,074 | B2 | 9/2010 | Iwasaki |
| 7,935,582 | B2 | 5/2011 | Iwasaki |
| 7,956,361 | B2 | 6/2011 | Iwasaki |
| 8,154,024 | B2 | 4/2012 | Iwasaki |
| 8,324,621 | B2 | 12/2012 | Yamazaki et al. |
| 8,492,758 | B2 | 7/2013 | Yamazaki et al. |
| 8,537,086 | B2 | 9/2013 | Koyama et al. |
| 2001/0046027 | A1 | 11/2001 | Tai et al. |
| 2002/0056838 | A1 | 5/2002 | Ogawa |
| 2002/0132454 | A1 | 9/2002 | Ohtsu et al. |
| 2003/0189401 | A1 | 10/2003 | Kido et al. |
| 2003/0218222 | A1 | 11/2003 | Wager et al. |
| 2004/0038446 | A1 | 2/2004 | Takeda et al. |
| 2004/0127038 | A1 | 7/2004 | Carcia et al. |
| 2005/0017302 | A1 | 1/2005 | Hoffman |
| 2005/0199959 | A1 | 9/2005 | Chiang et al. |
| 2006/0035452 | A1 | 2/2006 | Carcia et al. |
| 2006/0043377 | A1 | 3/2006 | Hoffman et al. |
| 2006/0091793 | A1 | 5/2006 | Baude et al. |
| 2006/0108529 | A1 | 5/2006 | Saito et al. |
| 2006/0108636 | A1 | 5/2006 | Sano et al. |
| 2006/0110867 | A1 | 5/2006 | Yabuta et al. |
| 2006/0113536 | A1 | 6/2006 | Kumomi et al. |
| 2006/0113539 | A1 | 6/2006 | Sano et al. |
| 2006/0113549 | A1 | 6/2006 | Den et al. |
| 2006/0113565 | A1 | 6/2006 | Abe et al. |
| 2006/0169973 | A1 | 8/2006 | Isa et al. |
| 2006/0170111 | A1 | 8/2006 | Isa et al. |
| 2006/0197092 | A1 | 9/2006 | Hoffman et al. |
| 2006/0208977 | A1 | 9/2006 | Kimura |
| 2006/0228974 | A1 | 10/2006 | Thelss et al. |
| 2006/0231882 | A1 | 10/2006 | Kim et al. |
| 2006/0238135 | A1 | 10/2006 | Kimura |
| 2006/0244107 | A1 | 11/2006 | Sugihara et al. |
| 2006/0284171 | A1 | 12/2006 | Levy et al. |
| 2006/0284172 | A1 | 12/2006 | Ishii |
| 2006/0292777 | A1 | 12/2006 | Dunbar |
| 2007/0024187 | A1 | 2/2007 | Shin et al. |
| 2007/0046191 | A1 | 3/2007 | Saito |
| 2007/0052025 | A1 | 3/2007 | Yabuta |
| 2007/0054507 | A1 | 3/2007 | Kaji et al. |
| 2007/0090365 | A1 | 4/2007 | Hayashi et al. |
| 2007/0108446 | A1 | 5/2007 | Akimoto |
| 2007/0152217 | A1 | 7/2007 | Lai et al. |
| 2007/0172591 | A1 | 7/2007 | Seo et al. |
| 2007/0187678 | A1 | 8/2007 | Hirao et al. |
| 2007/0187760 | A1 | 8/2007 | Furuta et al. |
| 2007/0194379 | A1 | 8/2007 | Hosono et al. |
| 2007/0252928 | A1 | 11/2007 | Ito et al. |
| 2007/0272922 | A1 | 11/2007 | Kim et al. |
| 2007/0287296 | A1 | 12/2007 | Chang |
| 2008/0006877 | A1 | 1/2008 | Mardilovich et al. |
| 2008/0017854 | A1* | 1/2008 | Marks et al. ..... 257/43 |
| 2008/0038929 | A1 | 2/2008 | Chang |
| 2008/0050595 | A1 | 2/2008 | Nakagawara et al. |
| 2008/1003888 | | 2/2008 | Takechi et al. |
| 2008/0073653 | A1 | 3/2008 | Iwasaki |
| 2008/0083950 | A1 | 4/2008 | Pan et al. |
| 2008/0106191 | A1 | 5/2008 | Kawase |
| 2008/0128689 | A1 | 6/2008 | Lee et al. |
| 2008/0129195 | A1 | 6/2008 | Ishizaki et al. |
| 2008/0151132 | A1 | 6/2008 | Oura et al. |
| 2008/0166475 | A1* | 7/2008 | Jeong et al. ..... 427/126.3 |
| 2008/0166834 | A1 | 7/2008 | Kim et al. |
| 2008/0182358 | A1 | 7/2008 | Cowdery-Corvan et al. |
| 2008/0224133 | A1 | 9/2008 | Park et al. |
| 2008/0254569 | A1 | 10/2008 | Hoffman et al. |
| 2008/0258139 | A1 | 10/2008 | Ito et al. |
| 2008/0258140 | A1 | 10/2008 | Lee et al. |
| 2008/0258141 | A1 | 10/2008 | Park et al. |
| 2008/0258143 | A1 | 10/2008 | Kim et al. |
| 2008/0259099 | A1* | 10/2008 | Arai et al. ..... 345/690 |
| 2008/0284970 | A1 | 11/2008 | Ishitani |
| 2008/0296568 | A1 | 12/2008 | Ryu et al. |
| 2009/0058842 | A1* | 3/2009 | Bull et al. ..... 345/212 |
| 2009/0068773 | A1 | 3/2009 | Lai et al. |
| 2009/0073325 | A1 | 3/2009 | Kuwabara et al. |
| 2009/0114910 | A1 | 5/2009 | Chang |
| 2009/0134399 | A1 | 5/2009 | Sakakura et al. |
| 2009/0152506 | A1 | 6/2009 | Umeda et al. |
| 2009/0152541 | A1 | 6/2009 | Maekawa et al. |
| 2009/0167663 | A1 | 7/2009 | Ker et al. |
| 2009/0280600 | A1 | 11/2009 | Hosono et al. |
| 2009/1027812 | | 11/2009 | Hosono et al. |
| 2010/0065844 | A1 | 3/2010 | Tokunaga |
| 2010/0092800 | A1 | 4/2010 | Itagaki et al. |
| 2010/0109002 | A1 | 5/2010 | Itagaki et al. |
| 2010/0133525 | A1* | 6/2010 | Arai et al. ..... 257/40 |
| 2011/0062436 | A1 | 3/2011 | Yamazaki et al. |
| 2011/0102476 | A1* | 5/2011 | Chang ..... 345/690 |
| 2011/0108837 | A1* | 5/2011 | Yamazaki et al. ..... 257/43 |
| 2011/0157216 | A1 | 6/2011 | Yamazaki et al. |
| 2011/0248970 | A1 | 10/2011 | Koyama et al. |
| 2011/0248978 | A1 | 10/2011 | Koyama et al. |
| 2011/0249037 | A1 | 10/2011 | Koyama et al. |
| 2011/0292088 | A1 | 12/2011 | Toyotaka et al. |
| 2011/0310132 | A1 | 12/2011 | Kurokawa et al. |
| 2011/0316818 | A1 | 12/2011 | Koyama et al. |
| 2012/0001953 | A1 | 1/2012 | Hirakata et al. |
| 2012/0001954 | A1 | 1/2012 | Yamazaki et al. |
| 2012/0002127 | A1 | 1/2012 | Yamazaki et al. |
| 2012/0002132 | A1 | 1/2012 | Yamazaki et al. |

FOREIGN PATENT DOCUMENTS

| | | | |
|---|---|---|---|
| EP | 2226847 | A | 9/2010 |
| EP | 2339639 | A | 6/2011 |
| EP | 2816607 | A | 12/2014 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 11-337904 | A | 12/1999 |
| JP | 2000-044236 | A | 2/2000 |
| JP | 2000-150900 | A | 5/2000 |
| JP | 2000-180825 | A | 6/2000 |
| JP | 2002-076356 | A | 3/2002 |
| JP | 2002-258815 | A | 9/2002 |
| JP | 2002-289859 | A | 10/2002 |
| JP | 2003-086000 | A | 3/2003 |

(56) References Cited

FOREIGN PATENT DOCUMENTS

| | | | |
|---|---|---|---|
| JP | 2003-086808 | A | 3/2003 |
| JP | 2003-248463 | | 9/2003 |
| JP | 2004-103957 | A | 4/2004 |
| JP | 2004-273614 | A | 9/2004 |
| JP | 2004-273732 | A | 9/2004 |
| JP | 2006-220685 | | 8/2006 |
| JP | 2007-103918 | A | 4/2007 |
| JP | 2007-264211 | | 10/2007 |
| JP | 2009-003437 | A | 1/2009 |
| JP | 2009-042405 | | 2/2009 |
| TW | I296345 | | 5/2008 |
| TW | 200912393 | | 3/2009 |
| TW | 200929149 | | 7/2009 |
| WO | WO-2004/114391 | | 12/2004 |
| WO | WO-2007/029844 | | 3/2007 |

OTHER PUBLICATIONS

Kurita et al., "Evaluation and Improvement of Picture Quality for Moving Images on Field-sequential Color Displays," IDW '00: Proceedings of the 17th International Display Workshops, 2000, pp. 69-72.

Taira et al., "A15" Field-Sequential Display without Color Break-Up using an AFLC Color Shutter," IDW '00: Proceedings of the 17th International Display Workshops, 2000, pp. 73-76.

Jarvenpaa, "7.2: Measuring Color Breakup of Stationary Images in Field- Sequential-Color Displays," SID Digest '04: SID International Symposium Digest of Technical Papers, 2004, vol. 35, pp. 82-85.

International Search Report (Application No. PCT/JP2011/064187) Dated Sep. 27, 2011.

Written Opinion (Application No. PCT/JP2011/064187) Dated Sep. 27, 2011.

Fortunato.E et al., "Wide-Bandgap High-Mobility ZnO Thin-Film Transistors Produced at Room Temperature,", Appl. Phys. Lett. (Applied Physics Letters) , Sep. 27, 2004, vol. 85, No. 13, pp. 2541-2543.

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using CG-Silicon Technology,", SID Digest '04 : SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters) , Jun. 26, 2007, vol. 90, No. 26, pp. 262106-1-262106-3.

Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.

Hayashi.R et al., "42.1: Invited Paper: Improved Amorphous In—Ga—Zn—O TFTS,", SID Digest '08 : SID International Symposium Digest of Technical Papers, May 20, 2008, vol. 39, pp. 621-624.

Prins.M et al., "A Ferroelectric Transparent Thin-Film Transistor,", Appl. Phys. Lett. (Applied Physics Letters) , Jun. 17, 1996, vol. 68, No. 25, pp. 3650-3652.

Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.

Kimizuka.N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System,", Journal of Solid State Chemistry, Apr. 1, 1995, vol. 116, No. 1, pp. 170-178.

Nomura.K et al., "Thin-Film Transistor Fabricated in Single-Crystalline Transparent Oxide Semiconductor,", Science, May 23, 2003, vol. 300, No. 5623, pp. 1269-1272.

Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.

Asakuma.N et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.

Osada.T et al., "15.2: Development of Driver-Integrated Panel using Amorphous In—Ga—Zn—Oxide TFT,", SID Digest '09 : SID International Symposium Digest of Technical Papers, May 31, 2009, pp. 184-187.

Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.

Li.C et al., "Modulated Structures of Homologous Compunds InMO3(ZnO)m (M=In, Ga; m=integer) Described by Four-Dimensional Superspace Group,", Journal of Solid State Chemistry, 1998, vol. 139, pp. 347-355.

Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.

Lee.J et al., "World'S Largest (15-Inch) XGA AMLCD Panel Using IGZO Oxide TFT,", SID Digest '08 : SID International Symposium Digest of Technical Papers, May 20, 2008, vol. 39, pp. 625-628.

Nowatari.H et al., "60.2: Intermediate Connector With Suppressed Voltage Loss for White Tandem OLEDs,", SID Digest '09 : SID International Symposium Digest of Technical Papers, May 31, 2009, vol. 40, pp. 899-902.

Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.

Tsuda.K et al., "Ultra Low Power Consumption Technologies for Mobile TFT-LCDs ,", IDW '02 : Proceedings of the 9th International Display Workshops, Dec. 4, 2002, pp. 295-298.

Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.

Fung.T et al., "2-D Numerical Simulation of High Performance Amorphous In—Ga—Zn—O TFTs for Flat Panel Displays,", AM-FPD '08 Digest of Technical Papers, jul. 2, 2008, pp. 251-252, The Japan Society of Applied Physics.

Jeong.J et al., "3.1: Distinguished Paper: 12.1-Inch WXGA AMOLED Display Driven by Indium—Gallium—Zinc Oxide TFTs Array,", SID Digest '08 : SID International Symposium Digest of Technical Papers, May 20, 2008, vol. 39, No. 1, pp. 1-4.

Park.J et al., "High performance amorphous oxide thin film transistors with self-aligned top-gate structure,", IEDM '09: Technical Digest of International Electron Devices Meetin, Dec. 7, 2009, pp. 191-194.

Kurokawa.Y et al., "UHF RFCPUS on Flexible and Glass Substrates for Secure RFID Systems,", Journal of Solid-State Circuits , 2008, vol. 43, No. 1, pp. 292-299.

Ohara.H et al., "Amorphous In—Ga—Zn—Oxide TFTs with Suppressed Variation for 4.0 inch QVGA AMOLED Display,", AM-FPD '09 Digest of Technical Papers, Jul. 1, 2009, pp. 227-330, The Japan Society of Applied Physics.

Coates.D et al., "Optical Studies of the Amorphous Liquid-Cholesteric Liquid Crystal Transition:The "Blue Phase"," Physics Letters, Sep. 10, 1973, vol. 45A, No. 2, pp. 115-116.

Cho.D et al., "21.2:Al and SN-Doped Zinc Indium Oxide Thin Film Transistors for AMOLED Back-Plane,", SID Digest '09 : SID International Symposium Digest of Technical Papers, May 31, 2009, pp. 280-283.

(56) References Cited

OTHER PUBLICATIONS

Lee.M et al., "15.4:Excellent Performance of Indium-Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and Its Bending Properties,", SID Digest '09 : SID International Symposium Digest of Technical Papers, May 31, 2009, pp. 983-985.
Sakata.J et al., "Development of 4.0-In. AMOLED Display With Driver Circuit Using Amorphous In—Ga—Zn—Oxide TFTs,", IDW '09 : Proceedings of the 16th International Display Workshops, 2009, pp. 689-692.
Park.J et al., "Amorphous Indium—Gallium—Zinc Oxide TFTs and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by Peald Grown ZnO TFT,", IMID '07 Digest, 2007, pp. 1249-1252.
Godo.H et al., "Temperature Dependence of Characteristics and Electronic Structure for Amorphous In—Ga—Zn—Oxide TFT,", AM-FPD '09 Digest of Technical Papers, Jul. 1, 2009, pp. 41-44.
Osada.T et al., "Development of Driver-Integrated Panel Using Amorphous In—Ga—Zn—Oxide TFT,", AM-FPD '09 Digest of Technical Papers, Jul. 1, 2009, pp. 33-36.
Hirao.T et al., "Novel Top-Gate Zinc Oxide Thin-Film Transistors (ZnO TFTs) for AMLCDs,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn—Oxide TFT,", SID Digest '09 : SID International Symposium Digest of Technical Papers, May 31, 2009, pp. 1110-1112.
Ohara.H et al., "21.3:4.0 In. QVGA AMOLED Display Using In—Ga—Zn—Oxide TFTs With a Novel Passivation Layer,", SID Digest '09 : SID International Symposium Digest of Technical Papers, May 31, 2009, pp. 284-287.
Miyasaka.M, "SUFTLA Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic Nano-Structured Liquid Crystal Composites for Display Applications,", SID Digest '09 : SID International Symposium Digest of Technical Papers, May 31, 2009, PP. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06 : Proceeding of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blues Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YbFe2O4, and Yb2Fe3O7 Types of Structures for Compounds in the In2O3 and Sc2O3—A2O3—BO Systems [A; Fe, Ga, or Al; B: Mg, Mn, Fe, Ni, Cu,or Zn] at Temperatures Over 1000 ° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium—Gallium—Zinc Oxide Semiconductor Upon Exposure to Water,", Appl. Phys. Lett. (Applied Physics Letters) , Eng. 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies In ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m <4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using CASTEP,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No, 2, pp. 800-803.
Oh.M et al., "Improving the Gate Stability of ZnO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters) , Sep. 1, 2003, vol. 83, No. 9, pp. 1755-1757.
Amano.S et al., "Low Power LC Display Using In—Ga—Zn—Oxide TFTs Based on Variable Frame Frequency", SID Digest '10 : SID International Symposium Digest of Technical Papers, 2010, vol. 41, pp. 626-629.
Taiwanese Office Action (Application No. 100123095), dated Nov. 16, 2015.

* cited by examiner

FIG. 3

| | 301 | 302 | 303 |
|---|---|---|---|
| driver circuit | operate | operate | not operate except during writing |
| backlight | hues are switched | hues are not switched | hues are not switched |
| number of writing image signal | same as number as hues | one | one |

LIQUID CRYSTAL DISPLAY DEVICE

TECHNICAL FIELD

The present invention relates to an active-matrix liquid crystal display device including a transistor in a pixel.

BACKGROUND ART

In a transmissive liquid crystal display device, power consumption of a backlight largely affects power consumption of the whole of the liquid crystal display device, and therefore, reduction of light loss within a panel is important for reduction of power consumption. Loss of light within a panel is caused by light refraction in an interlayer insulating film, light absorption in a color filter, or the like. In particular, the light loss is large in principle in a color filter in which light absorption by a pigment is used to extract light having a predetermined range of wavelengths from white light. As a matter of fact, 70% or more of the energy of light from the backlight is absorbed by the color filter. As described above, the color filter hinders reduction in power consumption of the liquid crystal display device.

To avoid the problem of loss of light by the color filter, a field sequential driving (FS driving) is effective. The FS driving is a driving method for displaying a color image by sequentially lighting a plurality of light sources whose hues are different from each other. It is not necessary to use a color filter in the FS driving, which leads to reduction in light loss within a panel, so that the transmittivity of the panel can be improved. Accordingly, the use efficiency of light from the backlight can be improved and power consumption of the whole of the liquid crystal display device can be reduced. Further, according to the FS driving, an image for each color can be displayed per pixel, so that image display with high definition can be performed.

Disclosed in Patent Document 1 is a liquid crystal display device in which the displaying mode is switched between a color-image display using a field sequential displaying mode in the normal case and a monochrome display in the case where the image is a text or the like.

REFERENCE

Patent Document 1: Japanese Published Patent Application No. 2003-248463

DISCLOSURE OF INVENTION

However, separate perception of images for respective colors without synthesizing them, a so-called color break-up is likely to occur in the FS driving. In particular, the color break-up tends to occur remarkably in displaying a moving image.

Further, according to the field sequential driving, power consumption of a liquid crystal display device can be reduced as compared to that in the case of using a color filter. However, along with the spread of mobile electronic devices, the degree of demand for lower power consumption of a liquid crystal display device is getting higher and more and more reduction in power consumption is being demanded.

In view of the foregoing, one object of one embodiment of the present invention is to provide a liquid crystal display device deterioration of image quality of which can be prevented, and a driving method thereof. One object of one embodiment of the present invention is to provide a liquid crystal display device power consumption of which can be reduced, and a driving method thereof.

A liquid crystal display device according to one embodiment of the present invention includes a backlight including a plurality of light sources whose hues of lights are different from each other. Further, a method for driving the light sources is switched between full-color image display and monochrome image display.

In the case of the full-color image display, a pixel portion is divided into a plurality of regions, and lighting of the light sources is controlled per region. Specifically, in one embodiment of the present invention, a pixel portion is divided into at least a first region and a second region, a plurality of lights whose hues are different from each other are sequentially supplied to the first region in a first rotating order, and the plurality of lights whose hues are different from each other are also sequentially supplied to the second region in a second rotating order which is different from the first rotating order.

In the case of the monochrome image display, at lest one of the plurality of lights whose hues are different from each other is supplied consecutively to the whole of the pixel portion or per region.

Further, in one embodiment of the present invention, the driving frequency is decreased in the case where the monochrome image is a still image to be lower than that in the case where the monochrome image is a moving image. Further, in one embodiment of the present invention, a liquid crystal element and an insulated gate field effect transistor (hereinafter referred to simply as a transistor) whose off-state current is extremely low, for controlling the retention of voltage applied to the liquid crystal element are provided in a pixel portion in a liquid crystal display device in order to suppress the driving frequency. The transistor whose off-state current is extremely low enables the period in which voltage applied to the liquid crystal element is held to be increased. Accordingly, for example, in the case where image signals each having the same image information are written to the pixel portion for several consecutive frame periods, like the case of a still image, the image display can be maintained even with the low driving frequency, in other words, the small number of writings of an image signal for a certain period.

The transistor includes, in a channel formation region, a semiconductor material which has bandgap wider than the bandgap of a silicon semiconductor and has intrinsic carrier density lower than the intrinsic carrier density of the silicon semiconductor. With such a channel formation region including the semiconductor material having the above characteristics, a transistor whose off-state current is extremely low can be realized. As an example of such a semiconductor material, an oxide semiconductor having a bandgap which is approximately three times as large as that of silicon can be given. The transistor having the above-described structure is used as a switching element for holding the voltage applied to the liquid crystal element, whereby leakage of electric charge accumulated in the liquid crystal element can be further prevented as compared to the case of using a transistor using a normal semiconductor material such as silicon or germanium.

Specifically, a liquid crystal display device according to one embodiment of the present invention includes a panel provided with a pixel portion and a driver circuit for controlling an input of an image signal to the pixel region and a plurality of light sources for supplying lights whose hues are different from each other to the pixel portion. The pixel portion includes a liquid crystal element whose transmissivity is controlled in accordance with a voltage of the image signal and a transistor for controlling the holding of the voltage. A channel formation region of the transistor contains a semiconductor material whose bandgap is wider than that of a silicon semiconductor and whose intrinsic carrier density is lower than that of the silicon semiconductor, such as an oxide semiconductor, for example.

Further, specifically, in a driving method of a liquid crystal display device according to one embodiment of the present invention, a pixel portion is divided into at least a first region and a second region, a plurality of lights whose hues are different from each other are sequentially supplied to the first region in a first rotating order, and the plurality of lights whose hues are different from each other are also sequentially supplied to the second region in a second rotating order which is different from the first rotating order in the case of full-color image display; light having a single hue is supplied consecutively to the whole of the pixel portion or per region in the case of monochrome image display. In addition, the number of writings of an image signal in a certain period is switched between the case where the image signal contains data for a first monochrome image and the case where the image signal contains data for a second monochrome image.

Note that an oxide semiconductor (purified OS) after being subjected to reduction of impurities such as moisture or hydrogen which serves as an electron donor (donor) and addition of oxygen to decrease oxygen deficiency is an intrinsic (i-type) semiconductor or a substantially i-type semiconductor. Therefore, a transistor using the oxide semiconductor has a characteristic of extremely low off-state current. Specifically, the hydrogen concentration in the oxide semiconductor, which is measured by secondary ion mass spectrometry (SIMS), is less than or equal to $5\times10^{19}/cm^3$, preferably less than or equal to $5\times10^{18}/cm^3$, further preferably less than or equal to $5\times10^{17}/cm^3$, still further preferably less than or equal to $1\times10^{16}/cm^3$. In addition, the carrier density of the oxide semiconductor film, which is measured by Hall effect measurement, is less than $1\times10^{14}/cm^3$, preferably less than $1\times10^{12}/cm^3$, further preferably less than $1\times10^{11}/cm^3$. Furthermore, the bandgap of the oxide semiconductor is 2 eV or more, preferably 2.5 eV or more, further preferably 3 eV or more. With the oxide semiconductor film after being subjected to a sufficient reduction of the concentration of impurities such as moisture or hydrogen and a reduction of oxygen deficiency, off-state current of the transistor can be reduced.

The analysis of the concentration of hydrogen in the oxide semiconductor film is described here. The hydrogen concentrations in the oxide semiconductor film and the conductive film are measured by SIMS. It is known that it is difficult to obtain data in the proximity of a surface of a sample or in the proximity of an interface between stacked films formed of different materials, using SIMS in principle. Thus, in the case where the distribution of the hydrogen concentration of the film in the thickness direction is analyzed by SIMS, an average value in a region of the film where the value is not greatly changed and almost stable is employed as the hydrogen concentration. Further, in the case where the thickness of the film is small, such a region where almost the same value can be obtained cannot be found in some cases due to the influence of the hydrogen concentration of the adjacent film; in that case, the maximum value or the minimum value of the hydrogen concentration of the region of the film is employed as the hydrogen concentration of the film. Furthermore, in the case where a mountain-shaped peak having the maximum value or a valley-shaped peak having the minimum value does not exist in the region of the film, the value of an inflection point is employed as the hydrogen concentration.

Various experiments can actually prove low off-state current of the transistor using as an active layer such an oxide semiconductor film after being subjected to a reduction of impurities such as hydrogen or moisture and addition of oxygen to decrease oxygen deficiency. For example, even with an element with a channel width of $1\times10^6$ μm and a channel length of 10 μM, in a range of from 1 V to 10 V of voltage (drain voltage) between a source electrode and a drain electrode, it is possible that off-state current (drain current when the voltage between a gate electrode and the source electrode is 0 V or less) is less than or equal to the measurement limit of a semiconductor parameter analyzer, i.e., less than or equal to $1\times10^{-13}$ A. In that case, it can be found that an off-state current density corresponding to a value obtained by dividing the off-state current by the channel width of the transistor is less than or equal to 100 zA/μm. In addition, a capacitor and a transistor were connected to each other and the off-state current density was measured by using a circuit in which electric charge flowing into or from the capacitor was controlled by the transistor. In the measurement, the above-described oxide semiconductor film was used as a channel formation region in the transistor, and the off-state current density of the transistor was measured from a change in the amount of electric charge of the capacitor per unit time. As a result, it was found that in the case where the voltage between a source electrode and a drain electrode of the transistor was 3V, a lower off-state current density of several tens yoctoampere per micrometer (yA/μm) was able to be obtained. Therefore, in the semiconductor device relating to one embodiment of the present invention, the off-state current density of the transistor including the oxide semiconductor film as an active layer can be reduced to less than or equal to 100 yA/μm, preferably less than or equal to 10 yA/μm, or further preferably less than or equal to 1 yA/μm, depending on the voltage between the source electrode and drain electrode. Accordingly, the off-state current of the transistor including the oxide semiconductor film as an active layer is extremely lower than that of a transistor using silicon having crystallinity.

As the oxide semiconductor, the following can be used: indium oxide; tin oxide; zinc oxide; a binary metal oxide such as an In—Zn-based oxide semiconductor, a Sn—Zn-based oxide semiconductor, an Al—Zn-based oxide semiconductor, a Zn—Mg-based oxide semiconductor, a Sn—Mg-based oxide semiconductor, an In—Mg-based oxide semiconductor, or an In—Ga-based oxide semiconductor; a ternary metal oxide such as an In—Ga—Zn-based oxide semiconductor (also referred to as IGZO), an In—Al—Zn-based oxide semiconductor, an In—Sn—Zn-based oxide semiconductor, an Sn—Ga—Zn-based oxide semiconductor, an Al—Ga—Zn-based oxide semiconductor, a Sn—Al—Zn-based oxide semiconductor, an In—Hf—Zn-based oxide semiconductor, an In—La—Zn-based oxide semiconductor, an In—Ce—Zn-based oxide semiconductor, an In—Pr—Zn-based oxide semiconductor, an In—Nd—Zn-based oxide semiconductor, an In—Sm—Zn-based oxide semiconductor, an In—Eu—Zn-based oxide semiconductor, an In—Gd—Zn-based oxide semiconductor, an In—Tb—Zn-based oxide semiconductor, an In—Dy—Zn-based oxide semiconductor, an In—Ho—Zn-based oxide semiconductor, an In—Er—Zn-based oxide semiconductor, an In—Tm—Zn-based oxide semiconductor, an In—Yb—Zn-based oxide semiconductor, or an In—Lu—Zn-based oxide semiconductor; or a quaternary metal oxide such as an In—Sn—Ga—Zn-based oxide semiconductor, an In—Hf—Ga—Zn-based oxide semiconductor, an In—Al—Ga—Zn-based oxide semiconductor, an In—Sn—Al—Zn-based oxide semiconductor, an In—Sn—Hf—Zn-based oxide semiconductor, or an In—Hf—Al—Zn-based oxide semiconductor.

Note that here, for example, an In—Ga—Zn-based oxide means an oxide containing indium (In), gallium (Ga), and zinc (Zn), and there is no particular limitation on the composition ratio of In, Ga, and Zn. Further, the In—Ga—Zn-based oxide may include a metal element other than In, Ga, and Zn. As the oxide semiconductor, a material expressed by a chemical formula, $InMO_3(ZnO)_m$ (m>0, m is not necessary a natural number) may be used. Here, M represents one or more metal elements selected from Ga, iron (Fe), manganese (Mn), or cobalt (Co). Alternatively, as the oxide semiconductor, a material expressed by a chemical formula, $In_2SnO_5(ZnO)_n$ (n>0, n is a natural number) may be used.

In a liquid crystal display device according to one embodiment of the present invention, a pixel portion is divided into a plurality of regions, and lights whose hues are different from each other are sequentially supplied per region, whereby a color image is displayed. Therefore, at each time, hues of respective lights supplied to regions adjacent to each other can be different from each other. Consequently, separate perception of images for respective colors without synthesis can be prevented, so that a color break-up, which has been likely to occur in displaying a moving image, can be prevented from occurring.

In the case where a color image display is performed with a plurality of light sources whose hues are different from each other, unlike the case with the combination of a light source for a single color and color filters, the plurality of light sources need to be sequentially switched to turn on. Further, the frequency at which the light sources are switched needs to be higher than the frame frequency in the case of using the light source for single color. For example, assuming that the frame frequency in the case of using the light source for single color is 60 Hz, the frequency at which the light sources are switched is three times as high as that, 180 Hz in an FS driving with the light sources for red, green, and blue. Therefore, the driver circuit is also operated in accordance with the above-described frequency of the light sources, which results in operation of the driver circuit at extremely high frequency. Consequently, power consumption in the driver circuit tends to be higher than that in the case with the combination of a light source for single color and color filters.

However, according to one embodiment of the present invention, a transistor whose off-state current is extremely low is used, whereby a period for holding a voltage applied to a liquid crystal element can be prolonged. Therefore, the driving frequency for displaying a still image can be decreased to a frequency lower than the driving frequency for displaying a moving image. Consequently, a liquid crystal display device whose power consumption is low can be achieved.

BRIEF DESCRIPTION OF DRAWINGS

FIG. 3 schematically illustrates a driving method of a liquid crystal display device and an operation a backlight;

BEST MODE FOR CARRYING OUT THE INVENTION

Hereinafter, embodiments and an example of the present invention will be described in detail with reference to the accompanying drawings. However, the present invention is not limited to the following description and it is easily understood by those skilled in the art that the mode and details can be variously changed without departing from the scope and spirit of the present invention. Accordingly, the present invention should not be construed as being limited to the description of the embodiments and example below.

(Embodiment 1)

<Structure Example of Liquid Crystal Display Device>

Figure 1:
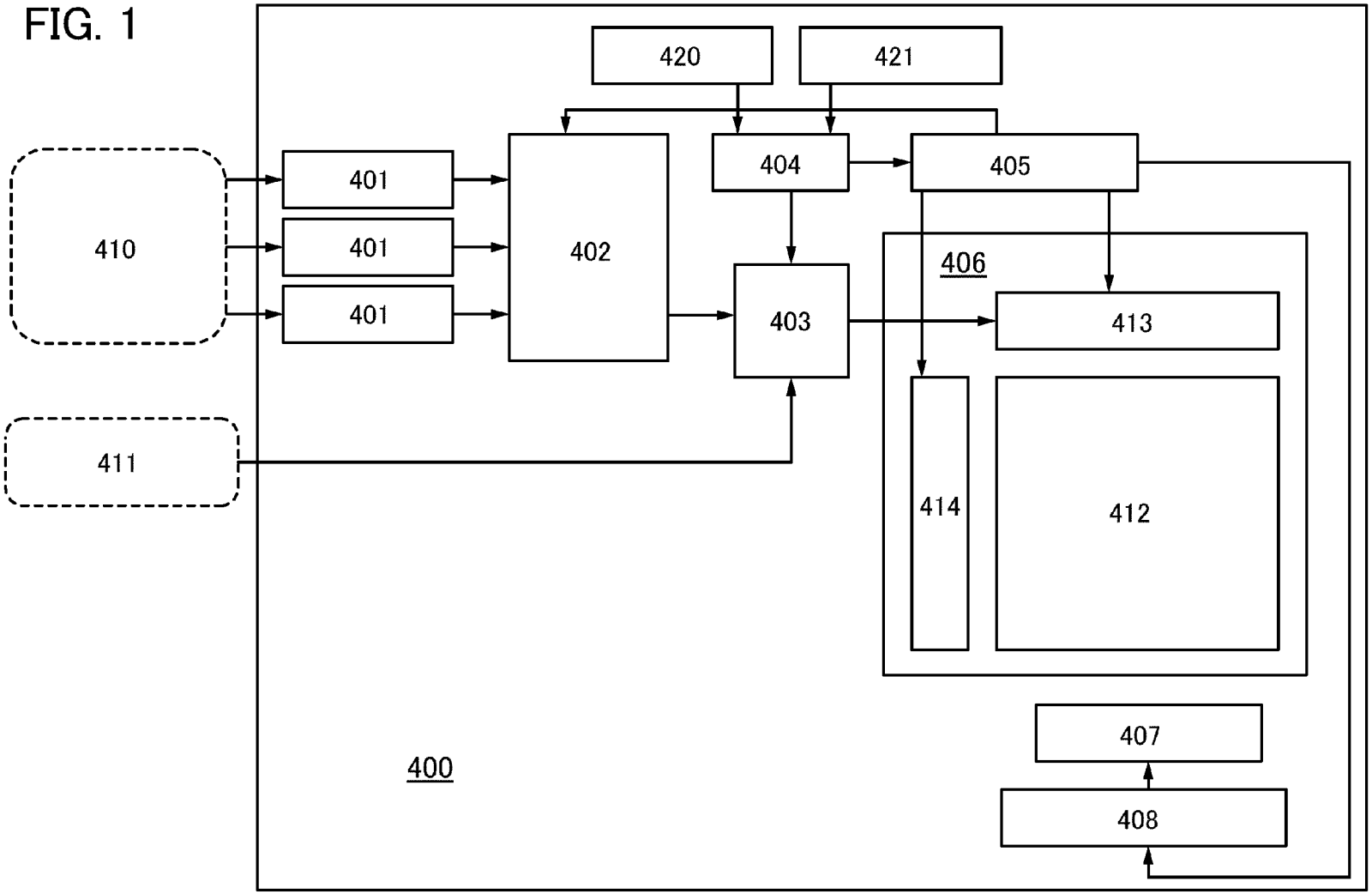
FIG. 1 is a block diagram illustrating a structure of a liquid crystal display device.

A liquid crystal display device 400 illustrated in FIG. 1 includes a plurality of image memories 401, an image data selection circuit 402, a selector 403, a CPU 404, a controller 405, a panel 406, a backlight 407, and a backlight control circuit 408.

Image data for a full-color image (full-color image data 410), which are input to the liquid crystal display device 400, are stored in the plurality of image memories 401. The full-color image data 410 include image data corresponding to their respective hues. The image data corresponding to the respective hues are stored in the respective image memories 401.

As the image memories 401, for example, memory circuits such as dynamic random access memories (DRAMs) or static random access memories (SRAMs) can be used.

The image data selection circuit 402 reads the full-color image data, which are stored in the plurality of image memories 401 and correspond to the respective hues, and sends the full-color image data to the selector 403 according to a command from the controller 405.

In addition, image data corresponding to a monochrome image (monochrome image data 411) are also input to the liquid crystal display device 400. Then, the monochrome image data 411 are input to the selector 403.

Note that a full-color image refers to an image displayed with gradations of a plurality of colors having different hues. In addition, a monochrome image refers to an image displayed with a gradation of a color having a single hue.

Although the structure in which the monochrome image data 411 are directly input to the selector 403 is employed in this embodiment, an embodiment of the present invention is not limited to this structure. The monochrome image data 411 may also be stored in the image memory 401 and then read by the image data selection circuit 402 in a similar manner to the full-color image data 410. In that case, the selector 403 may be included in the image data selection circuit 402.

Alternatively, the monochrome image data 411 may be formed by synthesizing the full-color image data 410 in the liquid crystal display device 400.

The CPU 404 controls the selector 403 and the controller 405 so that the operations of the selector 403 and the controller 405 are switched between full-color image display and monochrome image display.

Specifically, in the case of the full-color image display, the selector 403 selects the full-color image data 410 and supplies to the panel 406 in accordance with a command from the CPU 404. In addition, the controller 405 supplies the panel 406 with a driving signal which is synchronized with the full-color image data 410 and/or a power supply potential which is to be used when the full-color image is displayed, in accordance with a command from the CPU 404.

In the case of the monochrome image display, the selector 403 selects the monochrome image data 411 and supplies to the panel 406 in accordance with a command from the CPU 404. In addition, the controller 405 supplies the panel 406 with a driving signal which is synchronized with the monochrome image data 411 and/or a power supply potential which is to be used when the monochrome image is displayed, in accordance with a command from the CPU 404.

The panel 406 includes a pixel portion 412 in which each pixel includes a liquid crystal element, and driver circuits such as a signal line driver circuit 413 and a scan line driver circuit 414. The full-color image data 410 or the monochrome image data 411 from the selector 403 are supplied to the signal line driver circuit 413. In addition, the driving signals and/or the power supply potential from the controller 405 are/is supplied to the signal line driver circuit 413 and/or the scan line driver circuit 414.

Note that the driving signals include a signal line driver circuit start pulse signal (SSP) and a signal line driver circuit clock signal (SCK) which control the operation of the signal line driver circuit 413; a scan line driver circuit start pulse signal (GSP) and a scan line driver circuit clock signal (GCK) which control the operation of the scan line driver circuit 414; and the like.

A plurality of light sources whose hues of respective lights are different from each other are provided in the backlight 407. The controller 405 controls driving of the light sources included in the backlight 407 through the backlight control circuit 408.

Note that switching between full-color image display and monochrome image display can be performed by hand. In that case, an input device 420 may be provided for the liquid crystal display device 400 so that the CPU 404 controls the switching in accordance with a signal from the input device 420.

The liquid crystal display device 400 in this embodiment may include a photometric circuit 421. The photometric circuit 421 measures the brightness of an environment where the liquid crystal display device 400 is used. The CPU 404 may control the switching between full-color image display and monochrome image display in accordance with the brightness detected by the photometric circuit 421.

For example, in the case where the liquid crystal display device 400 in this embodiment is used in a dim environment, the CPU 404 may select full-color image display in accordance with a signal from the photometric circuit 421; in the case where the liquid crystal display device 400 is used in a bright environment, the CPU 404 may select monochrome image display in accordance with a signal from the photometric circuit 421. Note that a threshold value may be set in the photometric circuit 421 so that the backlight 407 is turned on when the brightness of a usage environment becomes less than the threshold value.

<Structure Example of Panel>

Next, an example of a specific structure of the panel of the liquid crystal display device according to one embodiment of the present invention will be described.

Figure 2A:
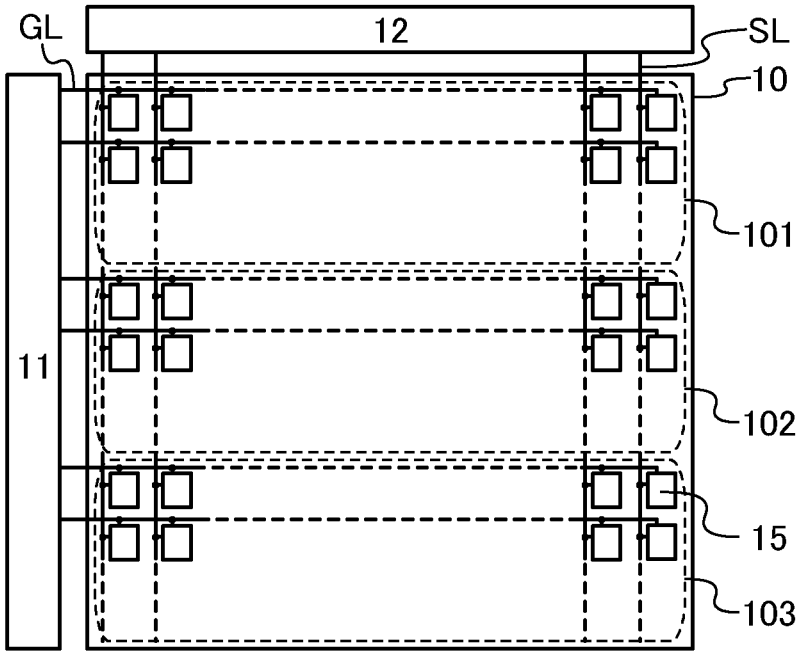
FIGS. 2A and 2B illustrate a structure of a panel and a configuration of a pixel.

FIG. 2A illustrates a structural example of a liquid crystal display device. The liquid crystal display device illustrated in FIG. 2A includes a pixel portion 10, a scan line driver circuit 11, and a signal line driver circuit 12. In one embodiment of the present invention, the pixel portion 10 is divided into a plurality of regions. Specifically, the pixel portion 10 is divided into three regions (regions 101 to 103) in FIG. 2A. Each region includes a plurality of pixels 15 arranged in a matrix.

M scan lines GL whose potentials are controlled by the scan line driver circuit 11 and n signal lines SL whose potentials are controlled by the signal line driver circuit 12 are provided for the pixel portion 10. The m scan lines GL are divided into a plurality of groups in accordance with the number of regions of the pixel portion 10. For example, the m scan lines GL are divided into three groups because the pixel portion 10 is divided into three regions in FIG. 2A. The scan lines GL in each group are connected to the plurality of pixels 15 in each corresponding region. Specifically, each scan line GL is connected to n pixels 15 in each corresponding row among the plurality of pixels 15 arranged in matrix in the corresponding region.

Regardless of the above regions, each of the signal lines SL is connected to m pixels 15. The m pixels 15 are included in the plurality of pixels 15 arranged in a matrix of m rows by n columns in the pixel portion 10, and are provided in each corresponding column.

Note that the term "connection" in this specification refers to electrical connection and corresponds to the state in which current, voltage, or a potential can be supplied or transmitted. Therefore, the state of connection does not always mean a state of direct connection but includes in its category a state of indirect connection via a circuit element such as a wiring, a resistor, a diode, or a transistor, in which a current, a voltage, or a potential can be supplied or transmitted.

Note that even when a circuit diagram illustrates independent components which are connected to each other, one conductive film may have functions of a plurality of components, such as the case where part of a wiring also functions as an electrode. The term "connection" in this specification also means such a case where one conductive film has functions of a plurality of components.

The "source electrode" and the "drain electrode" of the transistor interchange with each other depending on the polarity of the transistor or difference between the levels of potentials supplied to the respective electrodes. In general, in an n-channel transistor, an electrode supplied with a lower potential is called a source electrode, and an electrode supplied with a higher potential is called a drain electrode. Further, in a p-channel transistor, an electrode supplied with a lower potential is called a drain electrode, and an electrode supplied with a higher potential is called a source electrode. In this specification, one of a source electrode and a drain electrode is referred to as a first terminal and the other is referred to as a second terminal to describe the connection relation of the transistor.

Figure 2B:
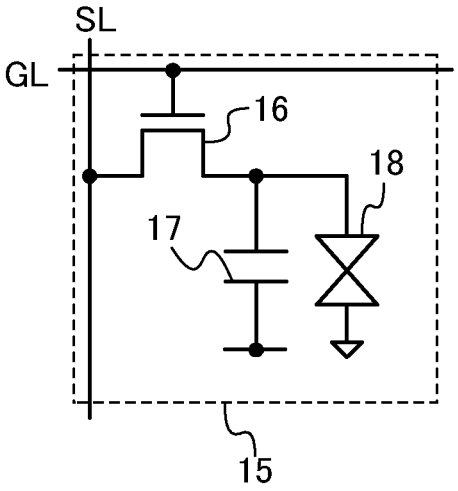

FIG. 2B illustrates an example of a circuit configuration of the pixel 15 included in the liquid crystal display device illustrated in FIG. 2A. The pixel 15 illustrated in FIG. 2B includes a transistor 16 functioning as a switching element, a liquid crystal element 18 whose transmittivity is controlled in accordance with the potential of an image signal supplied through the transistor 16, and a capacitor 17.

The liquid crystal element 18 includes a pixel electrode, a counter electrode, and a liquid crystal layer including liquid crystals to which a voltage between the pixel electrode and the counter electrode is applied. The capacitor 17 has a function of holding the voltage between the pixel electrode and the counter electrode of the liquid crystal element 18.

The liquid crystal layer can be formed using a liquid crystal material categorized by a thermotropic liquid crystal or a lyotropic liquid crystal. As another examples of a liquid crystal material used for the liquid crystal layer, the following can be given: a nematic liquid crystal, a smectic liquid crystal, a cholesteric liquid crystal, or a discotic liquid crystal. Further alternatively, a liquid crystal material categorized by a ferroelectric liquid crystal or an anti-ferroelectric liquid crystal can be used. Further alternatively, a liquid crystal material categorized by a high-molecular liquid crystal such as a main-chain high-molecular liquid crystal, a side-chain high-molecular liquid crystal, or a composite-type high-molecular liquid crystal, or a low-molecular liquid crystal can be used. Further alternatively, a liquid crystal material categorized by a polymer dispersed liquid crystal (PDLC) can be used.

Alternatively, a liquid crystal exhibiting a blue phase for which an alignment film is unnecessary may be used. The blue phase is one of liquid crystal phases, which is generated just before a cholesteric phase changes into an isotropic phase while temperature of cholesteric liquid crystal is increased. Since the blue phase is only generated within a narrow range of temperature, a chiral agent or an ultraviolet curable resin is added so that the temperature range is improved. The liquid crystal composition which includes a liquid crystal exhibiting a blue phase and a chiral agent is preferable because it has a small response time of less than or equal to 1 msec, has optical isotropy, which makes the alignment process unneeded, and has a small viewing angle dependence.

Moreover, the following method can be used for driving the liquid crystal, for example: a TN (twisted nematic) mode, an STN (super twisted nematic) mode, a VA (vertical alignment) mode, an MVA (multi-domain vertical alignment) mode, an IPS (in-plane-switching) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a PNLC (polymer network liquid crystal) mode, and a guest-host mode.

The pixel 15 may further include another circuit element such as a transistor, a diode, a resistor, a capacitor, or an inductor as needed.

Specifically, in FIG. 2B, a gate electrode of the transistor 16 is connected to the scan line GL. A first terminal of the transistor 16 is connected to the signal line SL. A second terminal of the transistor 16 is connected to the pixel electrode of the liquid crystal element 18. One electrode of the capacitor 17 is connected to the pixel electrode of the liquid crystal element 18. The other electrode of the capacitor 17 is connected to a node supplied with a potential. Note that the potential is also supplied to the counter electrode of the liquid crystal element 18. The potential supplied to the counter electrode may be in common with the potential supplied to the other electrode of the capacitor 17.

In one embodiment of the present invention, a channel formation region of the transistor 16 functioning as a switching element may include a semiconductor whose bandgap is wider than that of a silicon semiconductor and whose intrinsic carrier density is lower than that of the silicon semiconductor. As examples of the semiconductor, a compound semiconductor such as silicon carbide (SiC) or gallium nitride (GaN), an oxide semiconductor including a metal oxide such as zinc oxide (ZnO), and the like can be given. Among the above, an oxide semiconductor has an advantage of high mass productivity because the oxide semiconductor can be formed by sputtering, a wet process (e.g., a printing method), or the like. Note that the compound semiconductor such as silicon carbide or gallium nitride is required to be a single crystal, which needs crystal growth at a temperature extremely higher than a process temperature of the oxide semiconductor or epitaxial growth over a special substrate in order to realize a single crystal material. On the other hand, the oxide semiconductor can be formed even at room temperature; therefore, film formation can be performed over a silicon wafer that can be obtained easily or a glass substrate which is inexpensive and can be applied when the size of a substrate is increased; thus, the mass productivity is high. In addition, it is possible to stack a semiconductor element including the oxide semiconductor on an integrated circuit including a normal semiconductor material such as silicon or gallium. Accordingly, among the semiconductors with wide bandgaps, the oxide semiconductor particularly has an advantage of high mass productivity. Further, in the case where an oxide semiconductor with high crystallinity is to be obtained in order to improve the property (e.g., field-effect mobility) of a transistor, the oxide semiconductor with crystallinity can be easily obtained by heat treatment at 200° C. to 800° C.

In the following description, the case where an oxide semiconductor having the above advantages is used as the semiconductor having a wide bandgap is given as an example.

Unless otherwise specified, in the case of an n-channel transistor, an off-state current in this specification is a current which flows between a source electrode and a drain electrode when the potential of the drain electrode is higher than that of the source electrode and that of a gate electrode while the voltage of the gate electrode with respect to the source electrode is less than or equal to zero. Further, in this specification, in the case of a p-channel transistor, an off-state current is current which flows between a source electrode and a drain electrode when the potential of the drain electrode is lower than that of the source electrode or that of a gate electrode while the potential of the gate electrode with respect to the source is greater than or equal to zero.

Although FIG. 2B illustrates the case where one transistor 16 is used as a switching element in the pixel 15, one embodiment of the present invention is not limited to this configuration. A plurality of transistors may be used as a switching element. In the case where a plurality of transistors functions as a switching element, the plurality of transistors may be connected to each other in parallel, in series, or in combination of parallel connection and series connection.

In this specification, the state in which transistors are connected to each other in series means, for example, the state in which only one of a first terminal and a second terminal of a first transistor is connected to only one of a first terminal and a second terminal of a second transistor. Further, the state in which transistors are connected to each other in parallel means a state in which a first terminal of a first transistor is connected to a first terminal of the second transistor and a second terminal of the first transistor is connected to a second terminal of the second transistor.

The semiconductor material having such characteristics is included in the channel formation region, so that the transistor 16 whose off-state current is extremely low and whose withstand voltage is high can be realized. Further, the transistor 16 having the above-described structure is used as a switching element, so that leakage of charge accumulated in the liquid crystal element 18 can be prevented effectively as compared to the case of using a transistor using a normal semiconductor material such as silicon or germanium.

The transistor 16 whose low off-state current is extremely low is used, whereby a period in which a voltage supplied to the liquid crystal element 18 is held can be prolonged. Accordingly, for example, in the case where image signals each having the same image information are written to the pixel portion 10 for several consecutive frame periods, like in the case of a still image, an image display can be maintained even when the driving frequency is low, in other words, the number of writings of image signals to the pixel portion 10 in a certain period is reduced. For example, the above-described transistor 16, in which an oxide semiconductor film that is highly purified and whose oxygen deficiency is reduced is used as an active layer, is employed, whereby an interval between writings of image signals can be increased to 10 seconds or more, preferably 30 seconds or more, further preferably 1 minute or more. As the interval between writing operations of image signals is made longer, power consumption can be reduced.

Human eyes perceive images which are switched plural times when seeing an image formed by a plurality of numbers of writings of image signals, which might cause eyestrain. With a structure where the number of writings of image signals is reduced as described in this embodiment, eyestrain can be alleviated.

In addition, since the potential of an image signal can be held for a longer period, the quality of the displayed image can be prevented from being lowered even when the capacitor 17 for holding the potential of an image signal is not connected to the liquid crystal element 18. Thus, it is possible to increase the aperture ratio by reducing the size of the capacitor 17 or by omitting the capacitor 17, which leads to reduction in power consumption of the liquid crystal display device.

In addition, by inversion driving in which the polarity of the potential of an image signal is inverted with respect to the potential of the counter electrode, deterioration of a liquid crystal called burn-in can be prevented. However, in the inversion driving, the change in the potential supplied to the signal line is increased at the time of changing the polarity of the image signal; thus, a potential difference between a source electrode and a drain electrode of the transistor 16 functioning as a switching element is increased. Accordingly, deterioration of characteristics of the transistor 16, such as a shift of threshold voltage, is easily caused. In addition, in order to maintain a voltage held in the liquid crystal element 18, it is necessary that the off-state current is low even when the potential difference between the source electrode and the drain electrode is large. In one embodiment of the present invention, a semiconductor whose bandgap is wider than that of silicon or germanium and whose intrinsic carrier density is lower than that of silicon or germanium, such as an oxide semiconductor, is used for the transistor 16; therefore, the withstand voltage of the transistor 16 can be increased and the off-state current can be made considerably low. Therefore, as compared to the case of using a transistor using a normal semiconductor material such as silicon or germanium, deterioration of the transistor 16 can be prevented and the voltage held in the liquid crystal element 18 can be maintained.

<Operation Examples of Panel and Backlight>

Next, an example of the operation of the panel together with the operation of the backlight will be described. FIG. 3 schematically shows the operation of the liquid crystal display device and the operation of the backlight. As shown in FIG. 3, the operation of the liquid crystal display device according to one embodiment of the present invention is roughly divided into the following periods: a period in which a full-color image is displayed (a full-color image display period 301); a period in which a monochrome moving image is displayed (a monochrome moving image display period 302); and a period in which a monochrome still image is displayed (a monochrome still image display period 303).

In the full-color image display period 301, one frame period consists of a plurality of subframe periods. In each of the subframe periods, writing of the image signal to the pixel portion is performed. While an image is being displayed, driving signals are successively supplied to the driver circuits such as the scan line driver circuit and the signal line driver circuit. Therefore, the driver circuits are operated in the full-color image display period 301. In addition, the hue of the light supplied to the pixel portion from the backlight is switched every subframe period. Image signals corresponding to their respective hues are sequentially written to the pixel portion. Then, the image signals corresponding to all of the hues are written in one frame period, with which one image is formed. Accordingly, in the full-color image display period 301, the number of writings of the image signal to the pixel portion is more than one and is determined by the number of the hues of the lights supplied from the backlight.

In the monochrome moving image display period 302, writing of an image signal to the pixel portion is performed every frame period. While an image is being displayed, the driving signals are successively supplied to the driver circuits such as the scan line driver circuit and the signal line driver circuit. Therefore, the driver circuits are operated in the monochrome moving image display period 302. In addition, in the monochrome moving image display period 302, the hue of light supplied to the pixel portion by the backlight is not switched per frame period, but light having the same hue is successively supplied to the pixel portion. Then, one image can be formed with a writing of an image signal corresponding to the one hue to the pixel portion in one frame period. Accordingly, in the monochrome moving image display period 302, the number of writings of the image signal to the pixel portion in one frame period is one.

In the monochrome still image display period 303, wiring of an image signal to the pixel portion is performed every frame period. Note that unlike the full-color image display period 301 and the monochrome moving image display period 302, the driving signals are supplied to the driver circuits during the writing of the image signal to the pixel portion, and after the writing is completed, the supply of the driving signals to the driver circuits is stopped. Therefore, the driver circuits are not operated in the monochrome still image display period 303 except during the writing of the image signal. Further, in the monochrome still image display period 303, the hue of light supplied to the pixel portion by the backlight is not changed per frame period, but light having the same hue is successively supplied to the pixel portion. Then, one image can be formed with a writing of an image signal corresponding to the one hue to the pixel portion in one frame period. Accordingly, in the monochrome still image display period 303, the number of writings of the image signal to the pixel portion in one frame period is one.

It is preferable that 60 or more frame periods be provided in one second in the monochrome moving image display period 302 in order to prevent a flicker of an image or the like from being perceived. In the monochrome still image display period 303, one frame period can be extremely prolonged to, for example, one minute or longer. When one frame period is long, the period in which the driver circuits are not operated can be long, so that power consumption of the liquid crystal display device can be reduced.

The liquid crystal display device according to one embodiment of the present invention does not involve a color filter. Therefore, the power consumption of the backlight can be reduced to ⅓ that of a liquid crystal display device using a color filter, in each and every period of the full-color image display period 301, the monochrome moving image display period 302, and the monochrome still image display period 303.

Figure 4A:
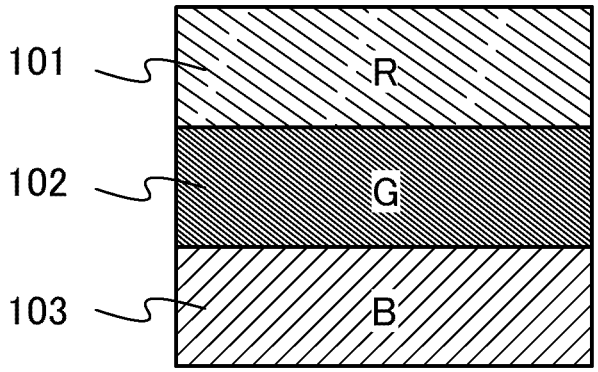
FIGS. 4A to 4C schematically illustrate examples of hues of lights supplied to regions.
Figure 4B:
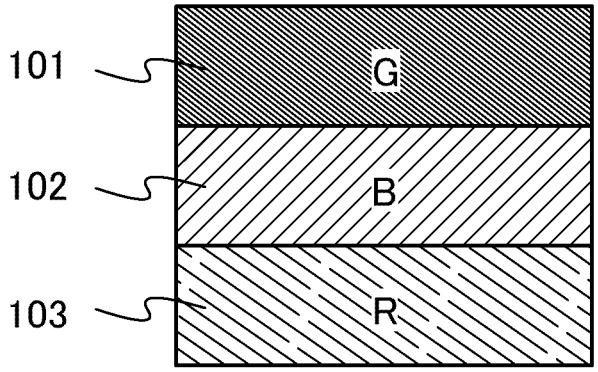
Figure 4C:
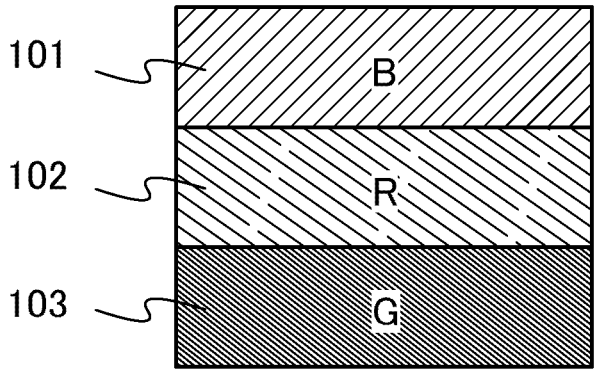

A plurality of lights whose hues are different form each other are sequentially supplied to each region of the pixel portion in one frame period in the full-color image display period 301. FIGS. 4A to 4C schematically illustrate an example of the hues of lights supplied to the regions. FIGS. 4A to 4C illustrate the case where the pixel portion is divided into three regions as in FIG. 2A. Further, FIGS. 4A to 4C illustrates the case where the backlight supplies respective lights of red (R), blue (B), and green (G) to the pixel portion.

First, FIG. 4A shows the first subframe period in which a light of red (R) is supplied to the region 101, a light of green (G) is supplied to the region 102, and a light of blue (B) is supplied to the region 103. FIG. 4B shows the second subframe period in which a light of green (G) is supplied to the region 101, a light of blue (B) is supplied to the region 102, and a light of red (R) is supplied to the region 103. FIG. 4C shows the third subframe period, in which a light of blue (B) is supplied to the region 101, a light of red (R) is supplied to the region 102, and a light of green (G) is supplied to the region 103.

The completion of the above subframe periods corresponds to the completion of one frame period. In one frame period, each hue of lights supplied to the regions takes a round of the regions, with which a full-color image can be displayed. In the regions, the hue of the light supplied to the region 101 is changed in the order of red (R), green (G), and blue (B); the hue of the light supplied to the region 102 is changed in the order of green (G), blue (B), and red (R); and the hue of the light supplied to the region 103 is changed in the order of blue (B), red (R), and green (G). In this manner, the plurality of the lights having different hues are sequentially supplied to each of the regions in accordance with the order that is different between the regions.

FIGS. 4A to 4C illustrate the example in which a light having one hue is supplied to one region in each subframe; however, one embodiment of the present invention is not limited to this structure. For example, the hues of the lights supplied to the regions may be changed in order of completion of the writing of the image signal. In that case, a region supplied with the light of the hue does not necessarily correspond to the region formed by dividing the pixel portion.

Figure 5A:
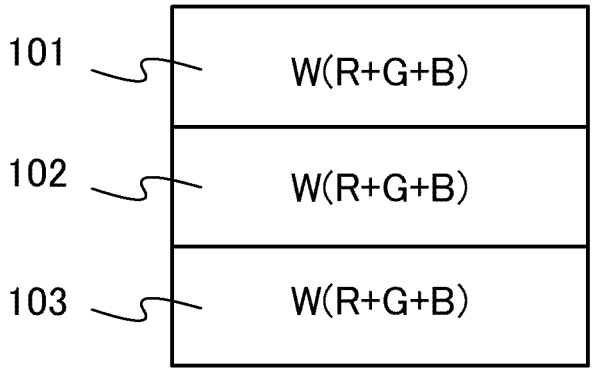
FIGS. 5A and 5B schematically illustrate examples of hues of lights supplied to regions.
Figure 5B:
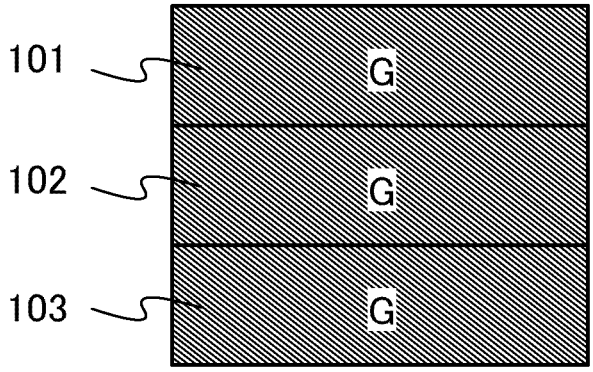

In the monochrome moving image display period 302 and the monochrome still image display period 303, at least one of the plurality of light whose hues are different form each other is successively supplied in the whole of the pixel portion or per region. FIGS. 5A and 5B schematically illustrate examples of the hue supplied to each region. FIGS. 5A and 5B illustrate the case where the pixel portion is divided into three regions as shown in FIG. 2A.

FIG. 5A illustrates the state where respective lights of red (R), blue (B), and green (G) are supplied in parallel from the backlight to the pixel portion. The lights of red (R), blue (B), and green (G) are mixed to supply a light of white (W) to each of the regions 101, 102, and 103. Consequently, an image with a gradation of a white light is displayed in the pixel portion.

Although FIG. 5A illustrates the example in which the light having one hue is supplied to the pixel portion by mixing the plurality of lights having different hues, a light having one hue may be supplied to the pixel portion without mixing. FIG. 5B illustrates the state where a light of green (G) is supplied from the backlight to the pixel portion. In that case, consequently, an image with a gradation of a green light is displayed in the pixel portion.

<Configuration Example of Scan Line Driver Circuit 11>

Figure 6:
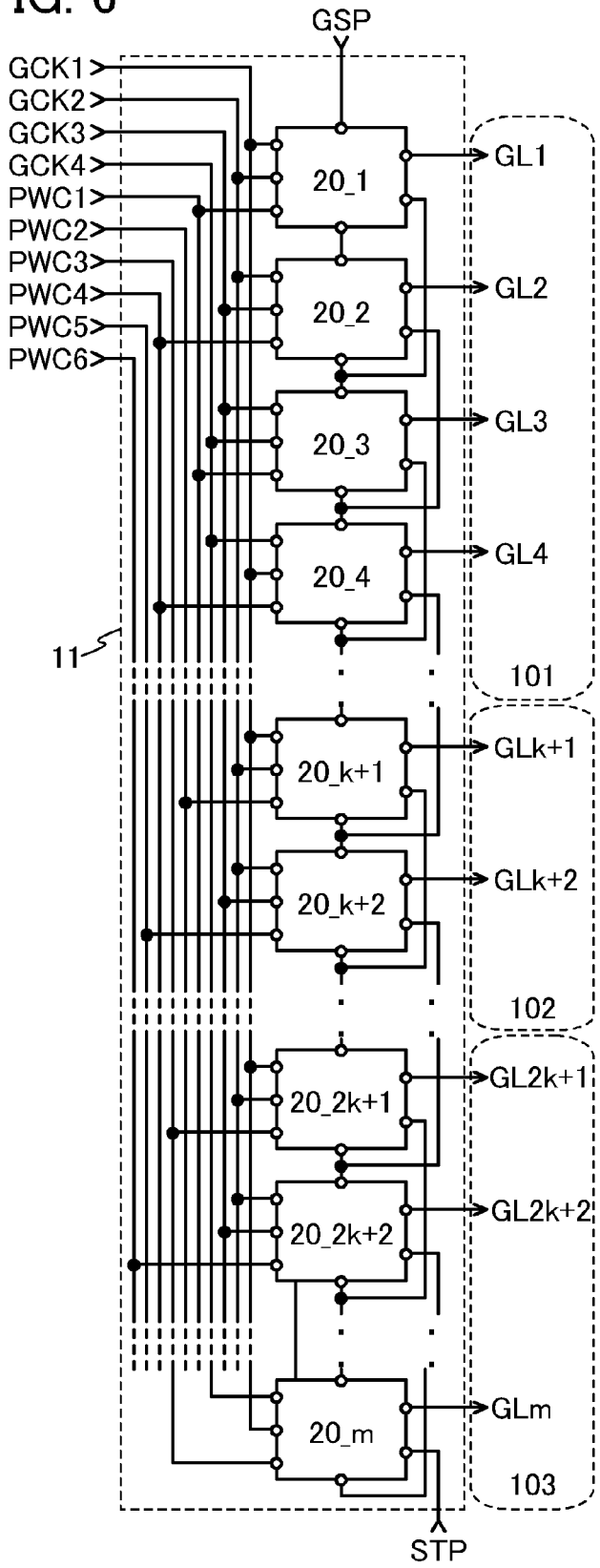
FIG. 6 illustrates a configuration of a scan line driver circuit.

FIG. 6 illustrates a configuration example of the scan line driver circuit 11 illustrated in FIG. 2A. The scan line driver circuit 11 in FIG. 6 includes first to m-th pulse output circuits 20_1 to 20_m. Selection signals are output from the first to m-th pulse output circuits 20_1 to 20_m and supplied to m scan lines GL (scan lines GL1 to GLm).

First to fourth scan line driver circuit clock signals (GCK1 to GCK4), first to sixth pulse width control signals (PWC1 to PWC6), and a scan line driver circuit start pulse signal (GSP) are supplied as driving signals to the scan line driver circuit 11.

Note that FIG. 6 illustrates the case where the first to k-th pulse output circuits 20_1 to 20_k (k is a multiple of 4 and less than m/2) are connected to the scan lines GL1 to GLk in the region 101, respectively. Further, the (k+1)-th to 2k-th pulse output circuits 20_k+1 to 20_2k are connected to the scan lines GLk+1 to GL2k in the region 102, respectively. Further, the (2k+1)-th to m-th pulse output circuits 20_2k+1 to 20_m are connected to the scan lines GL2k+1 to GLm in the region 103, respectively.

The first to m-th pulse output circuits 20_1 to 20_m begin to operate in response to the scan line driver circuit start pulse signal (GSP) that is input to the first pulse output circuit 20_1, and output selection signals whose pulses are sequentially shifted.

Circuits having the same configuration can be applied to the first to m-th pulse output circuits 20_1 to 20_m. A specific connection relation of the first to m-th pulse output circuits 20_1 to 20_m is described with reference to FIG. 7.

Figure 7:
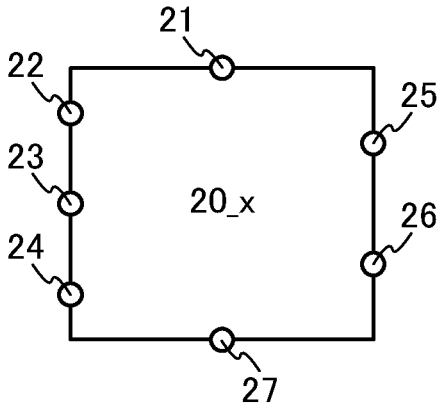
FIG. 7 schematically illustrates a x-th pulse output circuit 20_x.

FIG. 7 schematically illustrates the x-th pulse output circuit 20_x (x is a natural number less than or equal to m). Each of the first to m-th pulse output circuits 20_1 to 20_m has terminals 21 to 27. The terminals 21 to 24 and the terminal 26 are input terminals, and the terminals 25 and 27 are output terminals.

First, the terminal 21 is described. The terminal 21 of the first pulse output circuit 20_1 is connected to a wiring for supplying the scan line driver circuit start pulse signal (GSP). The terminal 21 of each of the second to m-th pulse output circuits 20_2 to 20_m is connected to the terminal 27 of each corresponding previous-stage pulse output circuit.

Next, the terminal 22 is described. The terminal 22 of the (4a−3)-th pulse output circuit 20_(4a−3) (a is a natural number less than or equal to m/4) is connected to a wiring for supplying the first scan line driver circuit clock signal (GCK1). The terminal 22 of the (4a−2)-th pulse output circuit 20_(4a−2) is connected to a wiring for supplying the second scan line driver circuit clock signal (GCK2). The terminal 22 of the (4a−1)-th pulse output circuit 20_(4a−1) is connected to a wiring for supplying the third scan line driver circuit clock signal (GCK3). The terminal 22 of the 4a-th pulse output circuit 20_4a is connected to a wiring for supplying the fourth scan line driver circuit clock signal (GCK4).

Next, the terminal 23 is described. The terminal 23 of the (4a−3)-th pulse output circuit 20_(4a−3) is connected to the wiring for supplying the second scan line driver circuit clock signal (GCK2). The terminal 23 of the (4a−2)-th pulse output circuit 20_(4a−2) is connected to the wiring for supplying the third scan line driver circuit clock signal (GCK3). The terminal 23 of the (4a−1)-th pulse output circuit 20_(4a−1) is connected to the wiring for supplying the fourth scan line driver circuit clock signal (GCK4). The terminal 23 in the 4a-th pulse output circuit 20_4a is connected to the wiring for supplying the first scan line driver circuit clock signal (GCK1).

Next, the terminal 24 is described. The terminal 24 in the (2b−1)-th pulse output circuit 20_(2 b−1) (b is a natural number less than or equal to k/2) is connected to a wiring for supplying the first pulse width control signal (PWC1). The terminal 24 in the 2b-th pulse output circuit 20_2b is connected to a wiring for supplying the fourth pulse width control signal (PWC4). The terminal 24 in the (2c−1)-th pulse output circuit 20_(2c−1) (c is a natural number greater than or equal to (k/2+1) and less than or equal to k) is connected to a wiring for supplying the second pulse width control signal (PWC2). The terminal 24 in the 2c-th pulse output circuit 20_2c is connected to a wiring for supplying the fifth pulse width control signal (PWC5). The terminal 24 in the (2d−1)-th pulse output circuit 20_(2d−1) (d is a natural number greater than or equal to (k+1) and less than or equal to m/2) is connected to a wiring for supplying the third pulse width control signal (PWC3). The terminal 24 in the 2d-th pulse output circuit 20_2d is connected to a wiring for supplying the sixth pulse width control signal (PWC6).

Next, the terminal 25 is described. The terminal 25 of the x-th pulse output circuit 20_x is connected to the scan line GLx in the x-th row.

Next, the terminal 26 is described. The terminal 26 of the y-th pulse output circuit 20_y (y is a natural number less than or equal to (m−1)) is connected to the terminal 27 of the (y+1)-th pulse output circuit 20_(y+1). The terminal 26 of the m-th pulse output circuit 20_m is connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit 20_(m+1). Specifically, the signals can be supplied to the m-th pulse output circuit 20_m from the (m+1)-th pulse output circuit 20 (m+1) provided as a dummy circuit or by directly inputting from the outside.

The connection relation of the terminal 27 in each of the pulse output circuits is as described above. Therefore, the above description is to be referred to.

<Configuration Example 1 of Pulse Output Circuit>

Figure 8A:
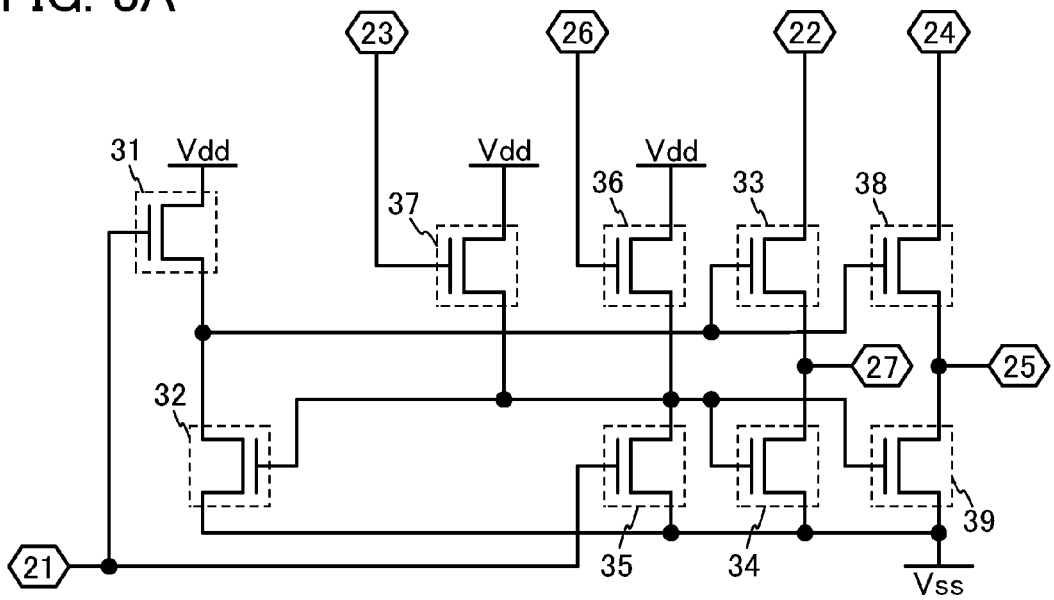
FIG. 8A illustrates a configuration of a pulse output circuit.

Next, FIG. 8A illustrates an example of a specific configuration of the x-th pulse output circuit 20_x illustrated in FIG. 7. The pulse output circuit illustrated in FIG. 8A includes transistors 31 to 39.

A gate electrode of the transistor 31 is connected to the terminal 21. A first terminal of the transistor 31 is connected to a node supplied with a high power supply potential (Vdd). A second terminal of the transistor 31 is connected to a gate electrode of the transistor 33 and a gate electrode of the transistor 38.

A gate electrode of the transistor 32 is connected to a gate electrode of the transistor 34 and a gate electrode of the transistor 39. A first terminal of the transistor 32 is connected to a node supplied with a low power supply potential (Vss). A second terminal of the transistor 32 is connected to the gate electrode of the transistor 33 and the gate electrode of the transistor 38.

A first terminal of the transistor 33 is connected to the terminal 22. A second terminal of the transistor 33 is connected to the terminal 27.

A first terminal of the transistor 34 is connected to the node supplied with the low power supply potential (Vss). A second terminal of the transistor 34 is connected to the terminal 27.

A gate electrode of the transistor 35 is connected to the terminal 21. A first terminal of the transistor 35 is connected to the node supplied with the low power supply potential (Vss). A second terminal of the transistor 35 is connected to the gate electrode of the transistor 34 and the gate electrode of the transistor 39.

A gate electrode of the transistor 36 is connected to the terminal 26. A first terminal of the transistor 36 is connected to the node supplied with the high power supply potential (Vdd). A second terminal of the transistor 36 is connected to the gate electrode of the transistor 34 and the gate electrode of the transistor 39. Note that it is possible to employ a structure in which the first terminal of the transistor 36 is connected to a node supplied with a power supply potential (Vcc) which is higher than the low power supply potential (Vss) and lower than the high power supply potential (Vdd).

A gate electrode of the transistor 37 is connected to the terminal 23. A first terminal of the transistor 37 is connected to the node supplied with the high power supply potential (Vdd). A second terminal of the transistor 37 is connected to the gate electrode of the transistor 34 and the gate electrode of the transistor 39. The first terminal of the transistor 37 may be connected to the node supplied with the power supply potential (Vcc).

A first terminal of the transistor 38 is connected to the terminal 24. A second terminal of the transistor 38 is connected to the terminal 25.

A first terminal of the transistor 39 is connected to the node supplied with the low power supply potential (Vss). A second terminal of the transistor 39 is connected to the terminal 25.

Figure 8B:
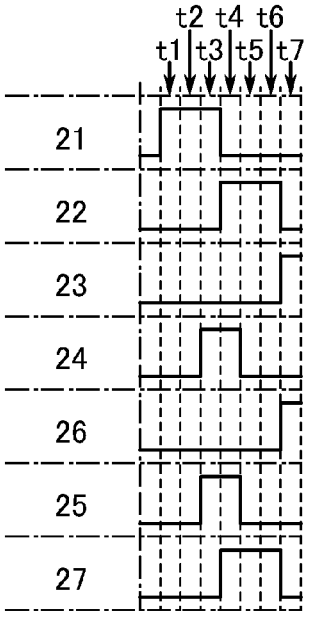
FIGS. 8B and 8C are timing charts thereof.

Next, FIG. 8B shows an example of a timing chart of the pulse output circuit illustrated in FIG. 8A. Periods t1 to t7 shown in FIG. 8B have the same length of time. The length of each of the periods t1 to t7 corresponds to ⅓ of a pulse width of each of the first to fourth scan line driver circuit clock signals (GCK1 to GCK4), and corresponds to ½ of a pulse width of each of the first to sixth pulse width control signals (PWC1 to PWC6).

In the pulse output circuit illustrated in FIG. 8A, a potential input to the terminal 21 is at a high level and potentials input to the terminal 22, the terminal 23, the terminal 24, and the terminal 26 are at a low level in the periods t1 and t2. Consequently, low-level potentials are output from the terminal 25 and the terminal 27.

Next, in the period t3, the potentials input to the terminal 21 and the terminal 24 are at a high level and the potentials input to the terminal 22, the terminal 23, and the terminal 26 are at a low level. Consequently, a high-level potential is output from the terminal 25 and a low-level potential is output from the terminal 27.

Next, in the period t4, the potentials input to the terminal 22 and the terminal 24 are at a high level and the potentials input to the terminal 21, the terminal 23, and the terminal 26 are at a low level. Consequently, high-level potentials are output from the terminal 25 and the terminal 27.

In the periods t5 and t6, the potential input to the terminal 22 is at a high level and the potentials input to the terminal 21, the terminal 23, the terminal 24, and the terminal 26 are at a low level. Consequently, a low-level potential is output from the terminal 25 and a high-level potential is output from the terminal 27.

In the period t7, the potentials input to the terminal 23 and the terminal 26 are at a high level and the potentials input to the terminal 21, the terminal 22, and to the terminal 24 are at a low level. Consequently, low-level potentials are output from the terminal 25 and the terminal 27.

Figure 8C:
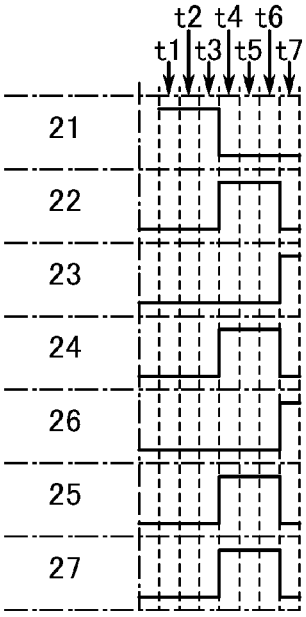

Next, FIG. 8C shows another example of the timing chart of the pulse output circuit illustrated in FIG. 8A. Periods t1 to t7 in FIG. 8C have the same length of time. The length of each of the periods t1 to t7 corresponds to ⅓ of the pulse width of each of the first to fourth scan line driver circuit clock signals (GCK1 to GCK4), and corresponds to ⅓ of the pulse width of each of the first to sixth pulse width control signals (PWC1 to PWC6).

In the pulse output circuit illustrated in FIG. 8A, the potential input to the terminal 21 is at a high level and the potentials input to the terminal 22, the terminal 23, the terminal 24, and the terminal 26 are at a low level in the periods t1 to t3. Consequently, low-level potentials are output from the terminal 25 and the terminal 27 in the periods t1 to t3.

Then, in the periods t4 to t6 in which the potentials input to the terminal 22 and the terminal 24 are at a high level, and the potentials input to the terminal 21, the terminal 23, and the terminal 26 are at a low level, high level potentials are output from the terminal 25 and the terminal 27.

<Operation Example of Scan Line Driver Circuit in Full-Color Image Display Period 301>

Next, the operation of the scan line driver circuit 11 in the full-color image display period 301 shown in FIG. 3 will be described, for example, using the scan line driver circuit 11 described with reference to FIG. 6, FIG. 7, and FIG. 8A.

Figure 9:
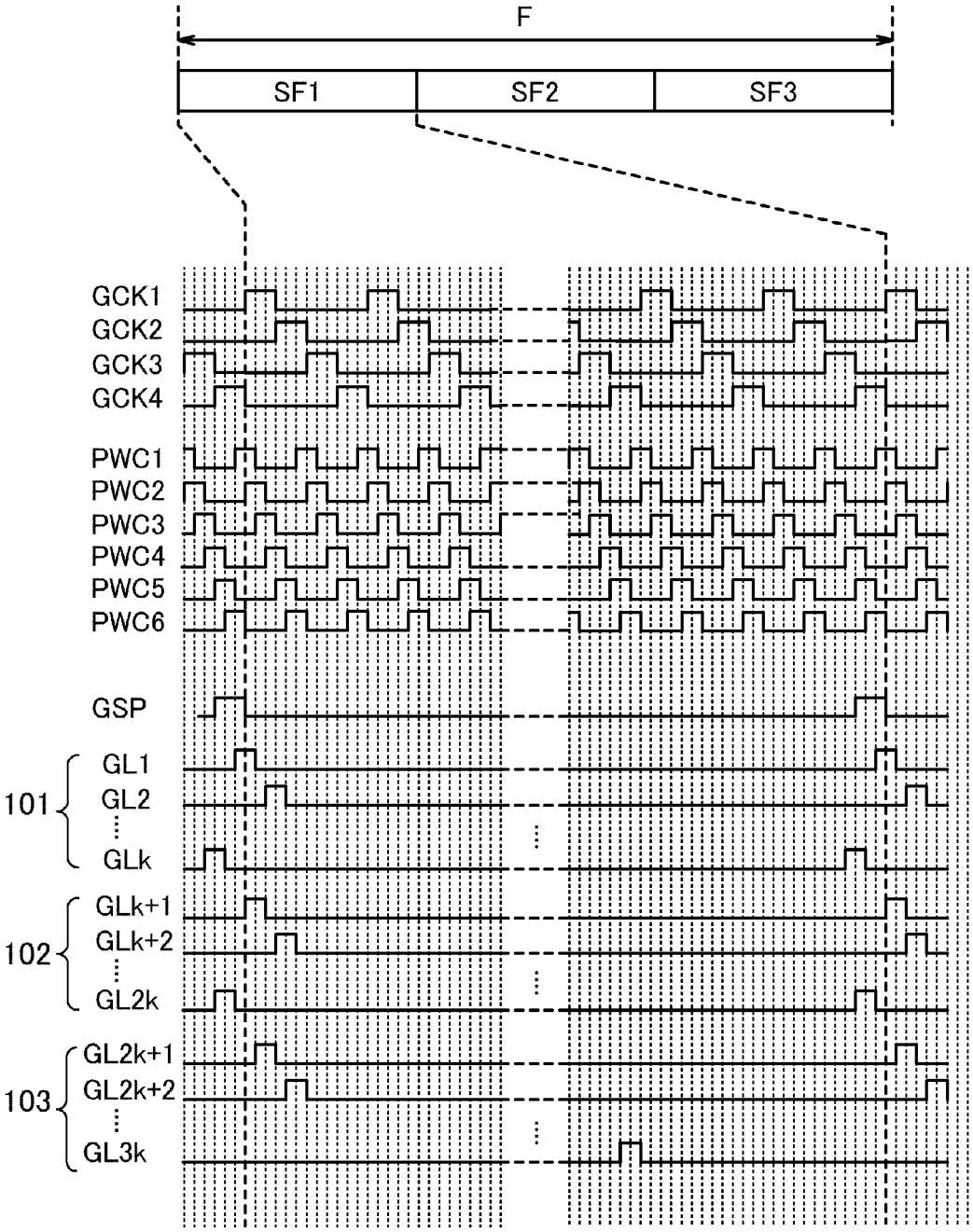
FIG. 9 is a timing chart of a scan line driver circuit.

FIG. 9 shows an example of a timing chart of the scan line driver circuit 11 in the full-color image display period 301. A subframe period SF1, a subframe period SF2, and a subframe period SF3 are provided in one frame period in FIG. 9. In FIG. 9, a timing chart of the subframe period SF1 is used as a typical example. Note that m is 3*j* in FIG. 9.

In FIG. 9, the scan line GL1 to the scan line GLk are connected to the pixels in the region 101, the scan line GLk+1 to the scan line GL2k are connected to the pixels in the region 102, the scan line GL2k+1 to the scan line GL3k are connected to the pixels in the region 103.

The first scan line driver circuit clock signal (GCK1) periodically repeats a high-level potential (the high power supply potential (Vdd)) and a low-level potential (the low power supply potential (Vss)), and has a duty ratio of ¼. Further, the second scan line driver circuit clock signal (GCK2) is a signal whose phase lags behind that of the first scan line driver circuit clock signal (GCK1) by ¼ of its cycle, the third scan line driver circuit clock signal (GCK3) is a signal whose phase lags behind that of the first scan line driver circuit clock signal (GCK1) by ½ of its cycle, and the fourth scan line driver circuit clock signal (GCK4) is a signal whose phase lags behind that of the first scan line driver circuit clock signal (GCK1) by ¾ of its cycle.

The first pulse width control signal (PWC1) periodically repeats a high-level potential (the high power supply potential (Vdd)) and a low-level potential (the low power supply potential (Vss)), and has a duty ratio of ⅓. The second pulse width control signal (PWC2) is a signal whose phase lags behind the first pulse width control signal (PWC1) by ⅙ of its cycle, the third pulse width control signal (PWC3) is a signal whose phase lags behind the first pulse width control signal (PWC1) by ⅓ of its cycle, the fourth pulse width control signal (PWC4) is a signal whose phase lags behind the first pulse width control signal (PWC1) by ½ of its cycle, the fifth pulse width control signal (PWC5) is a signal whose phase lags behind the first pulse width control signal (PWC1) by ⅔ of its cycle, and the sixth pulse width control signal (PWC6) is a signal whose phase lags behind the first pulse width control signal (PWC1) by ⅚ of its cycle.

In FIG. 9, the ratio of the pulse width of each of the first to fourth scan line driver circuit clock signals (GCK1 to GCK4) to the pulse width of each of the first to sixth pulse width control signals (PWC1 to PWC6) is 3:2.

Each of the subframe periods SF starts in response to falling of the potential of the pulse of the scan line driver circuit start pulse signal (GSP). The pulse width of the scan line driver circuit start pulse signal (GSP) is substantially the same as the pulse width of each of the first to fourth scan line driver circuit clock signals (GCK1 to GCK4). The falling of the potential of the pulse of the scan line driver circuit start pulse signal (GSP) is synchronized with rising of the potential of the pulse of the first scan line driver circuit clock signal (GCK1). The falling of the potential of the pulse of the scan line driver circuit start pulse signal (GSP) lags behind rising of the potential of the pulse of the first pulse width control signal (PWC1) by ⅙ of a cycle of the first pulse width control signal (PWC1).

The pulse output circuit illustrated in FIG. 8A is operated by the above signals in accordance with the timing chart in FIG. 8B. Accordingly, as illustrated in FIG. 9, the selection signals whose pulses are sequentially shifted are supplied to the scan lines GL1 to GLk in the region 101. Further, the pulses of the selection signals supplied to the scan lines GL1 to GLk are each shifted by a period corresponding to 3/2 of the pulse width. The pulse width of each of the selection signals supplied to the scan lines GL1 to GLk is almost the same as the pulse width of each of the first to sixth pulse width control signals (PWC1 to PWC6).

As in the case of the region 101, selection signals whose pulses are sequentially shifted are supplied to the scan lines GLk+1 to GL2k in the region 102. Further, the pulses of the selection signals supplied to the scan lines GLk+1 to GL2k are each shifted by a period corresponding to 3/2 of the pulse width. The pulse width of each of the selection signals supplied to the scan lines GLk+1 to GL2k is almost the same as the pulse width of each of the first to sixth pulse width control signals (PWC1 to PWC6).

As in the case of the region 101, selection signals whose pulses are sequentially shifted are supplied to the scan lines GL2k+1 to GL3k in the region 103. Further, the phases of the pulses of the selection signals supplied to the scan lines GL2k+1 to GL3k are each shifted by a period corresponding to 3/2 of the pulse width. The pulse width of each of the selection signal supplied to the scan lines GL2k+1 to GL3k is almost the same as the pulse width of each of the first to sixth pulse width control signals (PWC1 to PWC6).

The phases of the selection signals supplied to the scan lines GL1, GLk+1, and GL2k+1 are sequentially shifted by a period corresponding to ½ of the pulse width.

<Operation Example of Scan Line Driver Circuit in Monochrome Still Image Display Period 303>

Next, the operation of the scan line driver circuit 11 in the monochrome still image display period 303 shown in FIG. 3 will be described, for example, using the scan line driver circuit 11 described with reference to FIG. 6, FIG. 7, and FIG. 8A.

Figure 10:
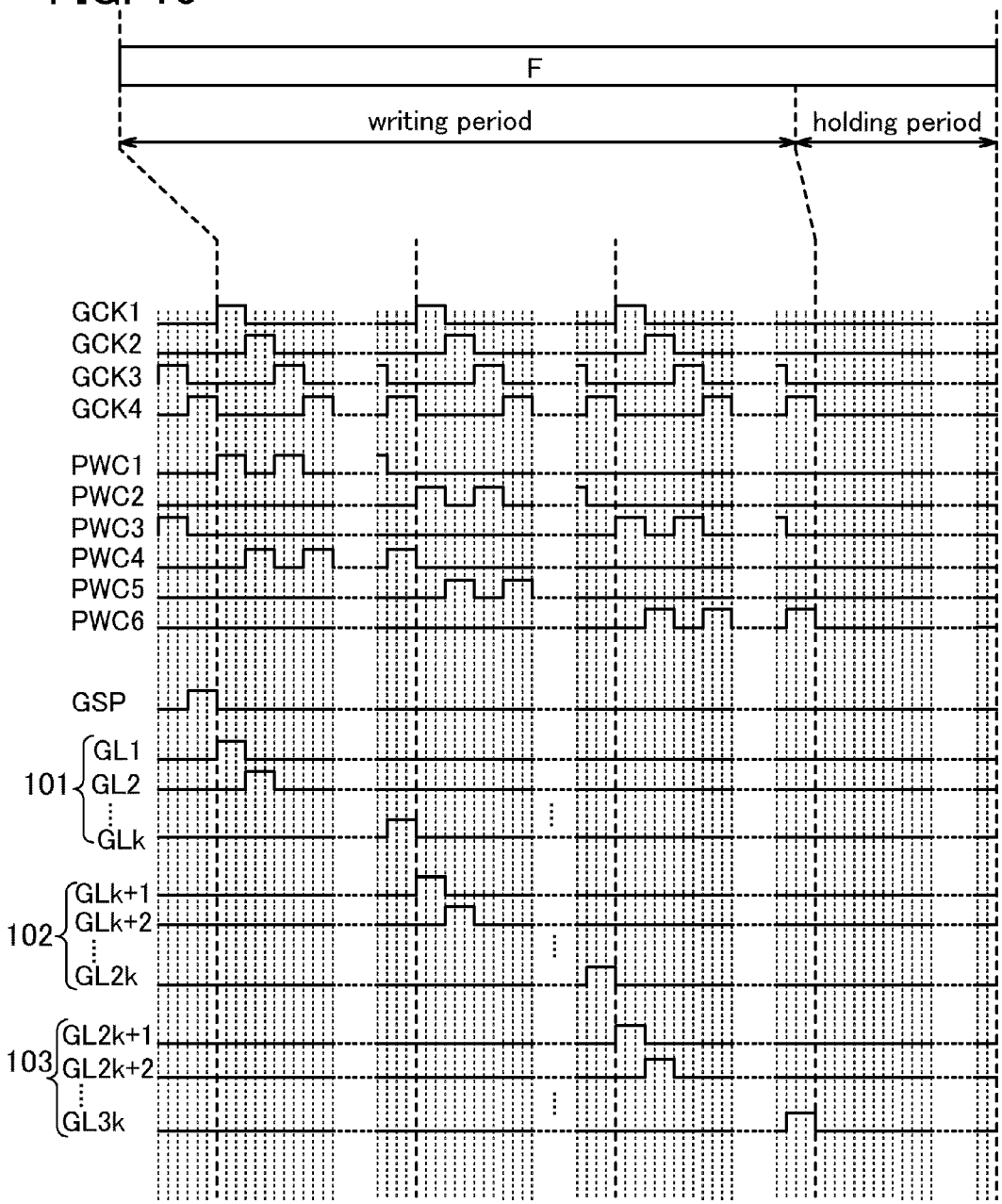
FIG. 10 is a timing chart of a scan line driver circuit.

FIG. 10 shows an example of a timing chart of the scan line driver circuit 11 in the monochrome still image display period 303. In FIG. 10, a writing period in which writing of an image signal to a pixel is performed and a holding period in which the image signal is held are provided in one frame period.

The first to fourth scan line driver circuit clock signals (GCK1 to GCK4) are the same signals as those in FIG. 9.

The first pulse width control signal (PWC1) and the fourth pulse width control signal (PWC4) periodically repeat a high-level potential (the high power supply potential (Vdd)) and a low-level potential (the low power supply potential (Vss)) and have a duty ratio of ½ in the first ⅓ period in the writing period. Further, in the other periods in the writing period, the first pulse width control signal (PWC1) and the fourth pulse width control signal (PWC4) have the low-level potentials. The fourth pulse width control signal (PWC4) is a signal whose phase lags behind that of the first pulse width control signal (PWC1) by ½ of its cycle.

The second pulse width control signal (PWC2) and the fifth pulse width control signal (PWC5) periodically repeat a high-level potential (the high power supply potential (Vdd)) and a low-level potential (the low power supply potential (Vss)) and have a duty ratio of ½ in the middle ⅓ period in the writing period. In the other periods in the writing period, the second pulse width control signal (PWC2) and the fifth pulse width control signal (PWC5) have the low-level potentials. The fifth pulse width control signal (PWC5) is a signal whose phase lags behind the second pulse width control signal (PWC2) by ½ of its cycle.

The third pulse width control signal (PWC3) and the sixth pulse width control signal (PWC6) periodically repeat a high-level potential (the high power supply potential (Vdd)) and a low-level potential (the low power supply potential (Vss)) and have a duty ratio of ½ in the last ⅓ period in the writing period. In the other periods in the writing period, the third pulse width control signal (PWC3) and the sixth pulse width control signal (PWC6) have the low-level potentials. The sixth pulse width control signal (PWC6) is a signal whose phase lags behind the third pulse width control signal (PWC3) by ½ of its cycle.

In FIG. 10, the ratio of the pulse width of each of the first to fourth scan line driver circuit clock signals (GCK1 to GCK4) to the pulse width of each of the first to sixth pulse width control signals (PWC1 to PWC6) is 1:1.

A frame period F starts in response to falling of the potential of the pulse of the scan line driver circuit start pulse signal (GSP). The pulse width of the scan line driver circuit start pulse signal (GSP) is almost the same as the pulse width of each of the first to fourth scan line driver circuit clock signals (GCK1 to GCK4). The falling of the potential of the pulse of the scan line driver circuit start pulse signal (GSP) is synchronized with rising of the potential of the pulse of the first scan line driver circuit clock signal (GCK1). In addition, the falling of the potential of the pulse of the scan line driver circuit start pulse signal (GSP) is synchronized with rising of the potential of a pulse of the first pulse width control signal (PWC1).

The pulse output circuit illustrated in FIG. 8A is operated by the above signals in accordance with the timing chart in FIG. 8C. Accordingly, as illustrated in FIG. 10, the selection signals whose pulses are sequentially shifted are supplied to the scan lines GL1 to GLk in the region 101. Further, the phases of the selection signals supplied to the scan lines GL1 to GLk are each shifted by a period corresponding to the pulse width. The pulse width of each of the selection signals supplied to the scan lines GL1 to GLk is almost the same as the pulse width of each of the first to sixth pulse width control signals (PWC1 to PWC6).

The supply of the selection signals whose pulses are sequentially shifted to the scan lines GL1 to GLk in the region 101 is followed by the supply of the selection signals whose pulses are sequentially shifted to the scan lines GLk+1 to GL2k in the region 102. The phases of the selection signals supplied to the scan lines GLk+1 to GL2k are each shifted by a period corresponding to the pulse width. The pulse width of each of the selection signals supplied to the scan lines GLk+1 to GL2k is almost the same as the pulse width of each of the first to sixth pulse width control signals (PWC1 to PWC6).

The supply of the selection signals whose pulses are sequentially shifted to the scan lines GLk+1 to GL2k in the region 102 is followed by the supply of the selection signals whose pulses are sequentially shifted to the scan lines GL2k+1 to GL3k in the region 103. Further, the phases of the selection signals supplied to the scan lines GL2k+1 to GL3k are each shifted by a period corresponding to the pulse width. The pulse width of each of the selection signals supplied to the scan lines GL2k+1 to GL3k is almost the same as the pulse width of each of the first to sixth pulse width control signals (PWC1 to PWC6).

Next, in the holding period, supply of the driving signals and the power supply potential to the scan line driver circuit 11 is stopped. Specifically, first, supply of the scan line driver circuit start pulse signal (GSP) is stopped, whereby output of the selection signal from the pulse output circuit is stopped in the scan line driver circuit 11, and selection by the pulse in all of the scan lines is terminated. After that, supply of the power supply potential Vdd to the scan line driver circuit 11 is stopped. Note that to stop input or to stop supply means, for example, to make a wiring to which a signal or a potential is input in a floating state, or to apply a low-level potential to a wiring to which a signal or a potential is input. According to the above method, malfunction of the scan line driver circuit 11 in stopping the operation can be prevented. In addition to the above structure, supply of the first to fourth scan line driver circuit clock signals (GCK1 to GCK4) and the first to sixth pulse width control signals (PWC1 to PWC6) to the scan line driver circuit 11 may be stopped.

By stopping the supply of the driving signals and the power supply potential to the scan line driver circuit 11, low-level potentials are supplied to all of the scan lines GL1 to GLk, the scan lines GLk+1 to GL2k, and the scan lines GL2k+1 to GL3k.

Note that in the monochrome moving image display period 302, the operation of the scan line driver circuit 11 in the writing period is the same as that in the monochrome still image display period 303.

According to one embodiment of the present invention, a transistor whose off-state current is extremely low is used, whereby a period for holding a voltage applied to a liquid crystal element can be prolonged. Therefore, a long period as the holding period shown in FIG. 10 can be ensured, and the driving frequency of the scan line driver circuit 11 can be decreased to be lower than that of the operation shown in FIG. 9. Consequently, a liquid crystal display device whose power consumption is low can be achieved.

<Configuration Example of Signal Line Driver Circuit 12>

Figure 11:
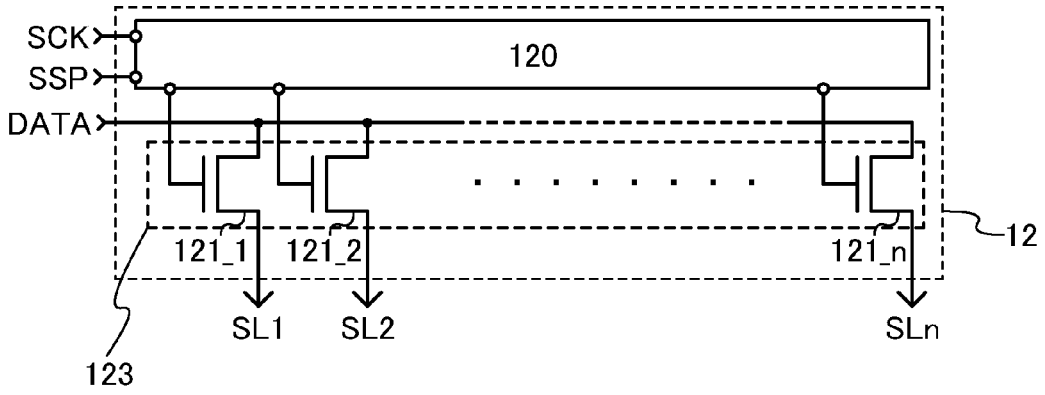
FIG. 11 illustrates a configuration of a signal line driver circuit.

FIG. 11 illustrates a configuration example of the signal line driver circuit 12 included in the liquid crystal display device shown in FIG. 2A. The signal line driver circuit 12 shown in FIG. 11 includes a shift register 120 having first to n-th output terminals and a switching element group 123 which controls supply of image signals (DATA) to the signal lines SL1 to SLn.

Specifically, the switching element group 123 includes transistors 121_1 to 121_n. First terminals of the transistors 121_1 to 121_n are connected to a wiring for supplying the image signal (DATA). Second terminals of the transistors 121_1 to 121_n are connected to the signal lines SL1 to SLn, respectively. Gate electrodes of the transistors 121_1 to 121_n are connected to the first to n-th output terminals of the shift register 120, respectively.

The shift register 120 operates in accordance with a driving signal such as a signal line driver circuit start pulse signal (SSP) and a signal line driver circuit clock signal (SCK), and outputs signals whose pulses are sequentially shifted from the first to n-th output terminals. The signals are input to the gate electrodes of the transistors to turn the transistors 121_1 to 121_n on sequentially.

Figure 12A:
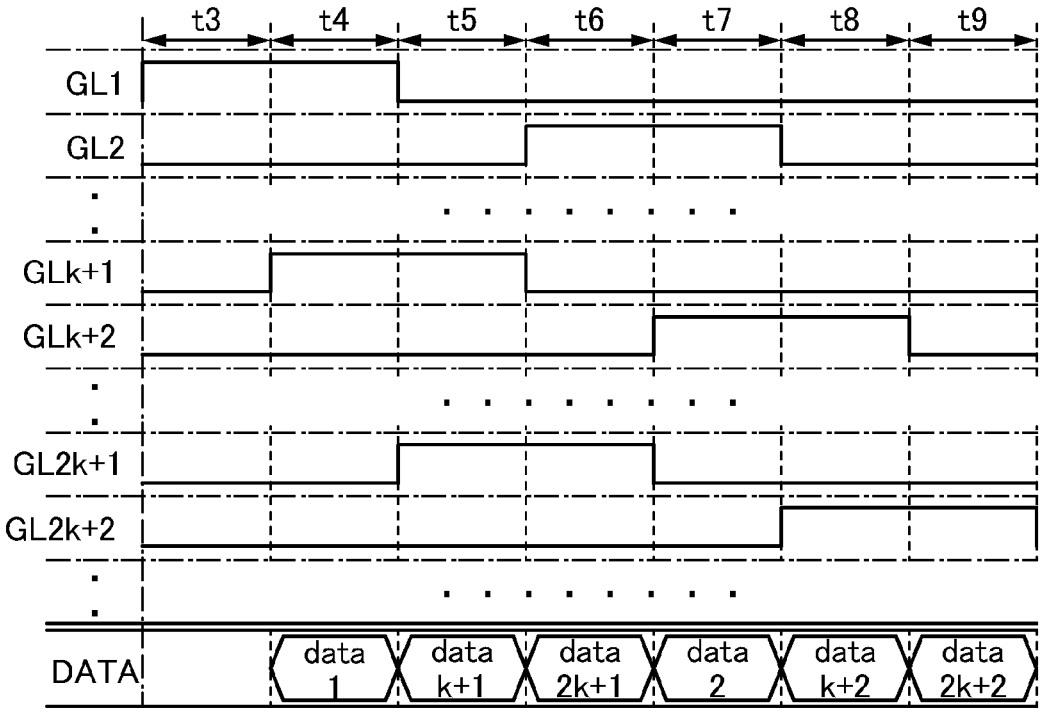
FIGS. 12A and 12B illustrate examples of a timing of an image signal (DATA) supplied to a signal line.

FIG. 12A shows an example of the timing of image signals (DATA) supplied to the signal lines in the full-color image display period 301. As shown in FIG. 12A, in a period in which pulses of selections signals input to two scan lines overlap with each other, an image signal (DATA) for the scan line whose pulse appears first is sampled and input to the signal lines in the signal line driver circuit 12 illustrated in FIG. 11. Specifically, the pulse of the selection signal input to the scan line GL1 and the pulse of the selection signal input to the scan line GLk+1 overlap with each other in a period t4 corresponding to ½ of the pulse width. The pulse of the scan line GL1 appears before the pulse of the scan line GLk+1. In the period in which the pulses overlap with each other, an image signal (data1) included in the image signals (DATA) for the scan line GL1 is sampled and input to the signal lines SL1 to the SLn.

In a similar manner, in a period t5, an image signal (datak+1) for the scan line GLk+1 is sampled and input to the signal lines SL1 to SLn. In a period t6, an image signal (data2k+1) for the scan line GL2k+1 is sampled and input to the signal lines SL1 to SLn. In a period t7, an image signal (data2) for the scan line GL2 is sampled and input to the signal lines SL1 to SLn. Also in each period following the period t7, the same operation is repeated and image signals (DATA) are written to the pixel portion.

In other words, input of the image signal to the signal lines SL1 to SLn is performed in the following order: pixels connected to the scan line GLs (s is a natural number less than k); pixels connected to the scan line GL2k+s; and pixels connected to the scan line GLs+1.

Figure 12B:
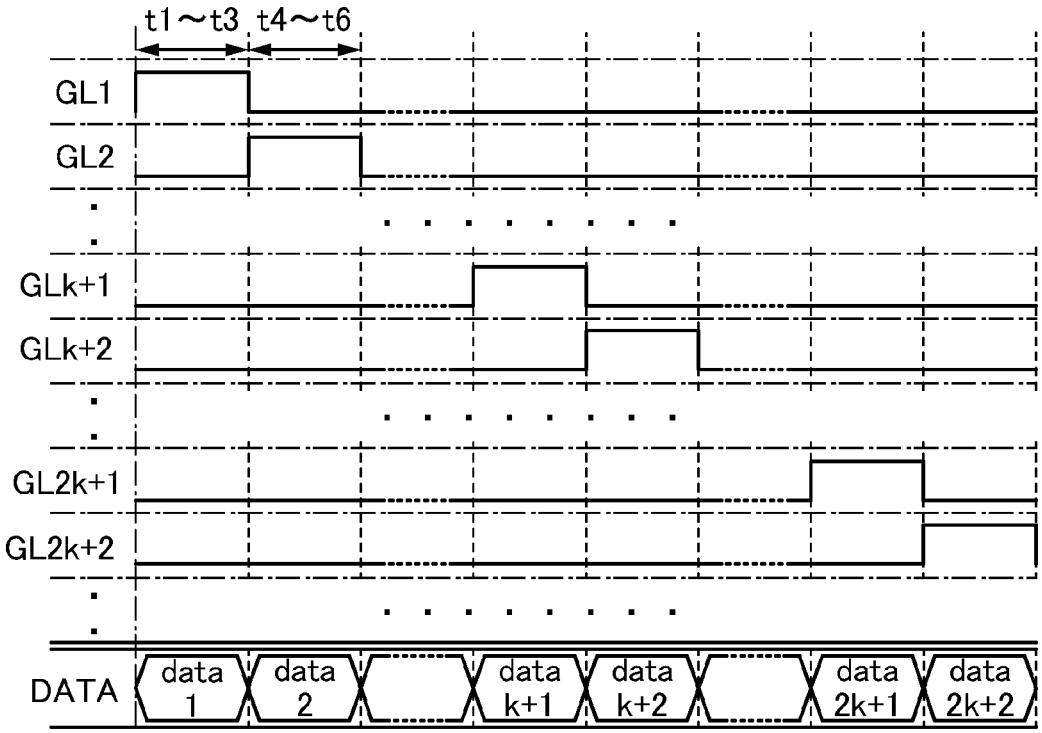

FIG. 12B shows an example of the timing of the image signals (DATA) supplied to the signal lines in the writing period provided in the monochrome moving image display period 302 and the monochrome still image display period 303. As shown in FIG. 12B, in a period in which a pulse of a selection signal input to the scan line appears, the image signal (DATA) for the scan line is sampled and input to the signal lines in the signal line driver circuit 12 illustrated in FIG. 11. Specifically, in a period in which the pulse of the selection signal input to the scan line GL1 appears, the image signal (data1) included in the image signals (DATA) for the scan line GL1 is sampled and input to the signal lines SL1 to SLn.

The same operation is repeated in each and every scan line following to the scan line GL1, whereby image signals (DATA) are written in the pixel portion.

In the holding period in the monochrome still image display period 303, supply of the signal line driver circuit start pulse signal (SSP) to the shift register 120 and supply of the image signals (DATA) to the signal line driver circuit 12 are stopped. Specifically, for example, first, the supply of the signal line driver circuit start pulse signal (SSP) is stopped to stop sampling of an image signal in the signal line driver circuit 12. Then, the supply of the image signals and the supply of the power supply potential to the signal line driver circuit 12 are stopped. According to the method, malfunction of the signal line driver circuit 12 in stopping operation of the signal line driver circuit 12 can be prevented. In addition, supply of the signal line driver circuit clock signal (SCK) to the signal line driver circuit 12 may be stopped.

<Operation Example of Liquid Crystal Display Device>

Figure 13:
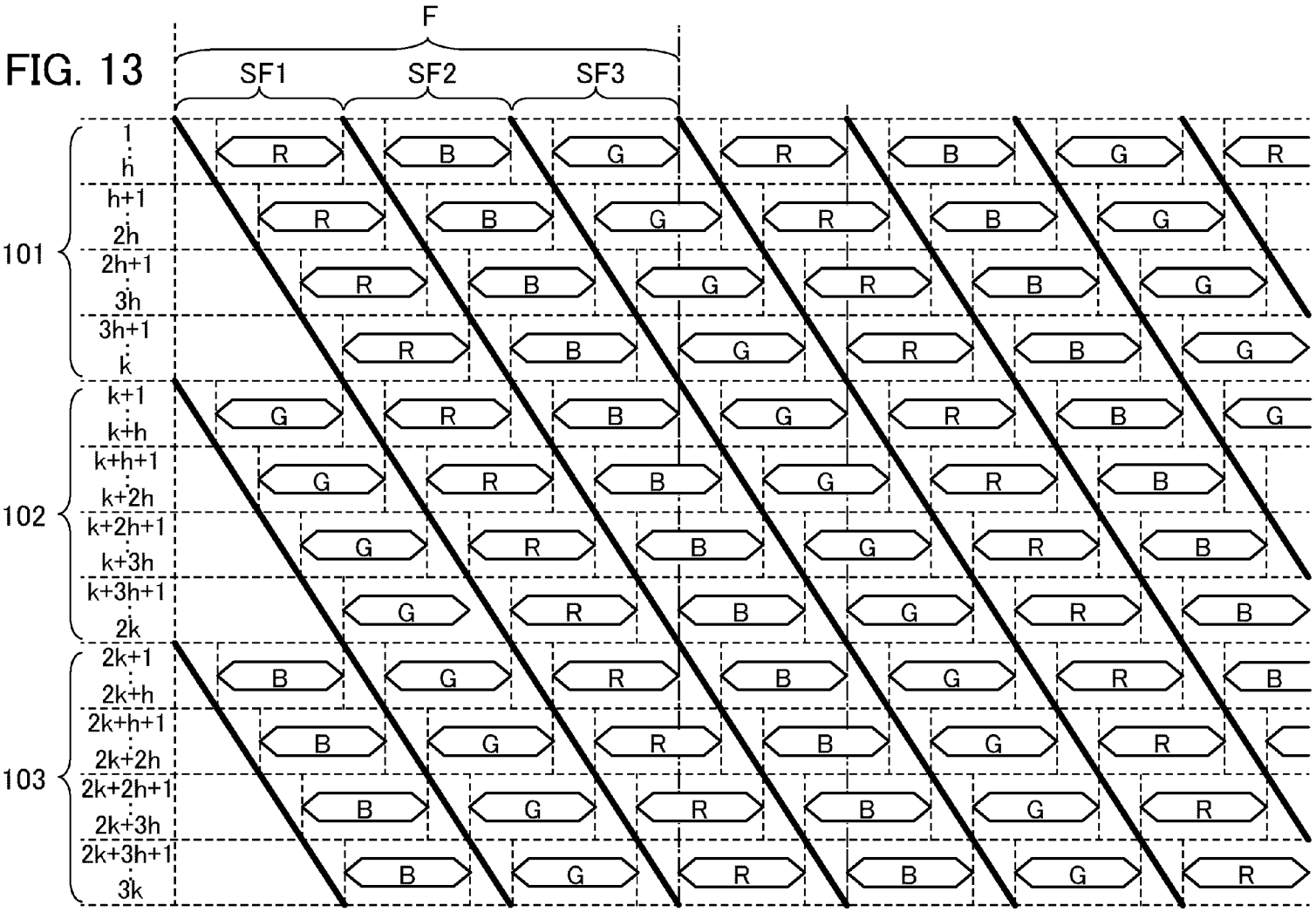
FIG. 13 illustrates a timing of scanning of a selection signal and a timing of lighting of a backlight.

FIG. 13 shows the timing of scanning of the selection signals and the timing of lighting of the backlight in the full-color image display period 301 in the above-described liquid crystal display device. In FIG. 13, the vertical axis represents the row in the pixel portion, and the horizontal axis represents time.

As shown in FIG. 13, in the liquid crystal display device described in this embodiment, a driving method in which a selection signal is supplied to the scan line GL1 and then a selection signal is supplied to the scan line GLk+1, which is the k-th rows from the scan line GL1, can be used in the full-color image display period 301. Therefore, the image signals can be supplied to the pixels in one subframe period SF in such a manner that n pixels connected to the scan line GL1 to n pixels connected to GLk are sequentially selected, n pixels connected to the scan line GLk+1 to n pixels connected to the scan line GL2k are sequentially selected, and n pixels connected to the scan line GL2k+1 to n pixels connected to the scan line GL3k are sequentially selected.

Specifically, in a first subframe period SF1 in FIG. 13, image signals for red (R) are written in the pixels connected to the scan lines GL1 to GLk, and then a light of red (R) is supplied to the pixels connected to the scan lines GL1 to GLk. With the above structure, an image for red (R) can be displayed in the region 101 of the pixel portion corresponding to the scan lines GL1 to GLk.

Further, in the first subframe period SF1, image signals for green (G) are written in the pixels connected to the scan lines GLk+1 to GL2k, and then a light of green (G) is supplied to the pixels connected to the scan lines GLk+1 to GL2k. With the above structure, an image for green (G) can be displayed in the region 102 of the pixel portion corresponding to the scan lines GLk+1 to GL2k.

Further, in the first subframe period SF1, image signals for blue (B) are written in the pixels connected to the scan lines GL2k+1 to GL3k, and then a light of blue (B) is supplied to the pixels connected to the scan lines GL2k+1 to GL3k. With the above structure, an image for blue (B) can be displayed in the region 103 of the pixel portion corresponding to the scan lines GL2k+1 to GL3k.

The same operation as in the first subframe period SF1 is repeated in a second subframe period SF2 and a third subframe period SF3. However, in the second subframe period SF2, an image for blue (B) is displayed in the region 101 of the pixel portion corresponding to the scan lines GL1 to GLk; an image for red (R) is displayed in the region 102 of the pixel portion corresponding to the scan lines GLk+1 to GL2k; and an image for green (G) is displayed in the region 103 of the pixel portion corresponding to the scan lines GL2k+1 to GL3k. Further, in the third subframe period SF3, an image for green (G) is displayed in the region 101 of the pixel portion corresponding to the scan lines GL1 to GLk; an image for blue (B) is displayed in the region 102 of the pixel portion corresponding to the scan lines GLk+1 to GL2k; and an image for red (R) is displayed in the region 103 of the pixel portion corresponding to the scan lines GL2k+1 to GL3k.

In this manner, the first to third subframe periods SF1 to SF3 are terminated in each and every scan line of the scan lines GL, that is, one frame period is completed, whereby a full-color image can be displayed in the pixel portion.

Note that in one embodiment of the present invention, each of the regions may be further divided into regions, and in the divided regions, lighting of the backlight may start sequentially upon termination of writing of an image signal. For example, the following may be employed: in the region 101, image signals for red (R) are written in the pixels connected to the scan lines GL1 to GLh (h is a natural number less than or equal to k/4); and then, a light of red (R) is supplied to the pixels connected to the scan lines GL1 to GLh while image signals for red (R) are written in the pixels connected to the scan lines GLh+1 to GL2h.

Figure 14:
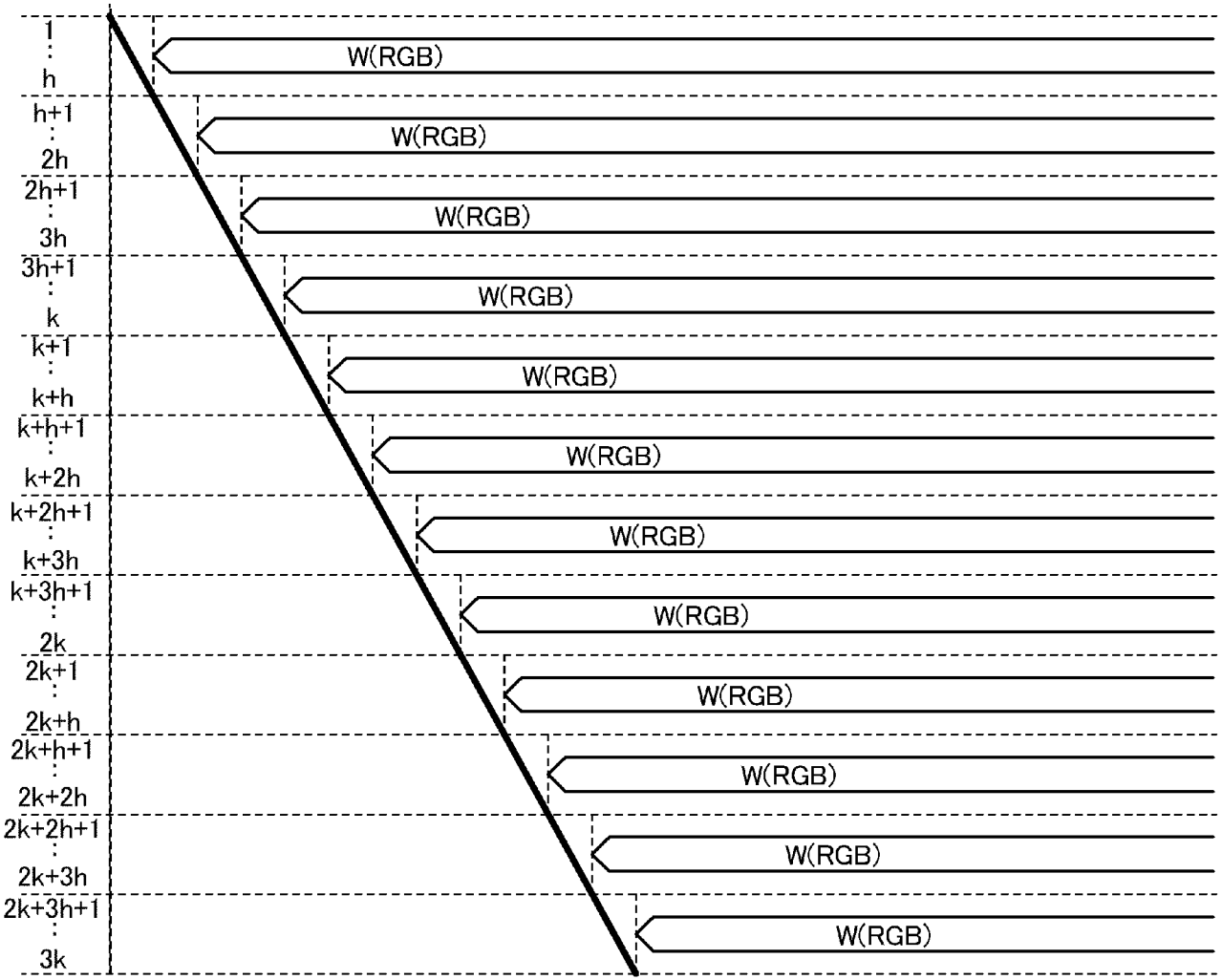
FIG. 14 illustrates a timing of scanning of a selection signal and a timing of lighting of a backlight.

FIG. 14 shows the timing of scanning of the selection signals and the timing of lighting of the backlight in the monochrome still image display period 303 in the above-described liquid crystal display device. In FIG. 14, the vertical axis represents the row in the pixel portion, and the horizontal axis represents time.

As shown in FIG. 14, the selection signals are sequentially supplied to the scan lines GL1 to GL3k in the monochrome still image display period 303 in the liquid crystal display device described in this embodiment.

Specifically, in FIG. 14, for example, in the region 101, image signals are written in the pixels connected to the scan lines GL1 to GLh; and then, a light of white (W) by a mixture of red (R), green (G), and blue (B) is supplied to the pixels connected to the scan lines GL1 to GLh while image signals are written in the pixels connected to the scan lines GLh+1 to GL2h. Then, the same operation is performed in pixels in each and every scan line, whereby a monochrome image can be displayed in the pixel portion.

Note that in the monochrome moving image display period 302, after the above operation is performed in the pixels in each and every scan line, the operation may be repeated, whereby a monochrome image is displayed on the pixel portion continually.

Although the structure in which light sources for three colors of red (R), green (G), and blue (B) are used as the backlight is employed for the liquid crystal display device according to one embodiment of the present invention, the structure of an liquid crystal display device of one embodiment of the present invention is not limited to this structure. In other words, light sources exhibiting a variety of respective colors may be used in combination in the backlight of a liquid crystal display of one embodiment of the present invention. For example, it is possible to use a combination of four colors of red (R), green (G), blue (B), and white (W); a combination of four colors of red (R), green (G), blue (B), and yellow (Y); or a combination of three colors of cyan (C), magenta (M), and yellow (Y).

In addition, a light source emitting a light of white (W) may further be provided in the backlight instead of forming a light of white (W) by mixing colors. The light source emitting a light of white (W) has high emission efficiency; therefore, with the use of the backlight formed using the light source, power consumption can be reduced. In the case where light sources that emit lights of two complementary colors (for example, in the case of lights of two colors of blue (B) and yellow (Y)), the lights of the two colors can be mixed, whereby a light exhibiting white (W) color can be formed. Alternatively, light sources that emit lights of six colors of pale red (R), pale green (G), pale blue (B), deep red (R), deep green (G), and deep blue (B) can be used in combination or light sources that emit lights of six colors of red (R), green (G), blue (B), cyan (C), magenta (M), and yellow (Y) can be used in combination.

Note that, for example, colors that can be exhibited using the light sources of red (R), green (G), and blue (B) are limited to colors existing in the triangle made by the three points on the chromaticity diagram which correspond to the emission colors of the respective light sources. Therefore, by further adding a light source of a color which exists outside the triangle on the chromaticity diagram, the range of the colors which can be exhibited in the liquid crystal display device can be expanded, so that color reproducibility can be enhanced.

For example, a light source exhibiting any of the following colors can be used in the backlight in addition to the light sources of red (R), green (G), and blue (B): deep blue (DB) which exists in a point positioned substantially outside the triangle in a direction from the center of the chromaticity diagram toward the point on the chromaticity diagram corresponding to the blue light source B; or deep red (DR) which exists in a point positioned substantially outside the triangle in a direction from the center of the chromaticity diagram toward the point on the chromaticity diagram corresponding to the red light source R.

As a light source of the backlight, a plurality of light-emitting diodes (LEDs) are preferably used, with which power consumption can be reduced as compared to a cold cathode fluorescent lamp and the intensity of light is adjustable. The intensity of light is partially adjusted by using LEDs in the backlight, so that image display with high contrast and high color visibility can be performed.

In addition, before and/or after the period in which one image is formed in the pixel portion, it is possible to provide a period (non-lighting period) in which the scanning of the selection signal and the lighting of the backlight unit are not performed.

In addition, by providing a plurality of frame periods which differ from each other in the order of lighting of colors of the backlight, generation of a color break-up can be further prevented.

<Configuration Example 2 of Pulse Output Circuit>

Figure 19A:
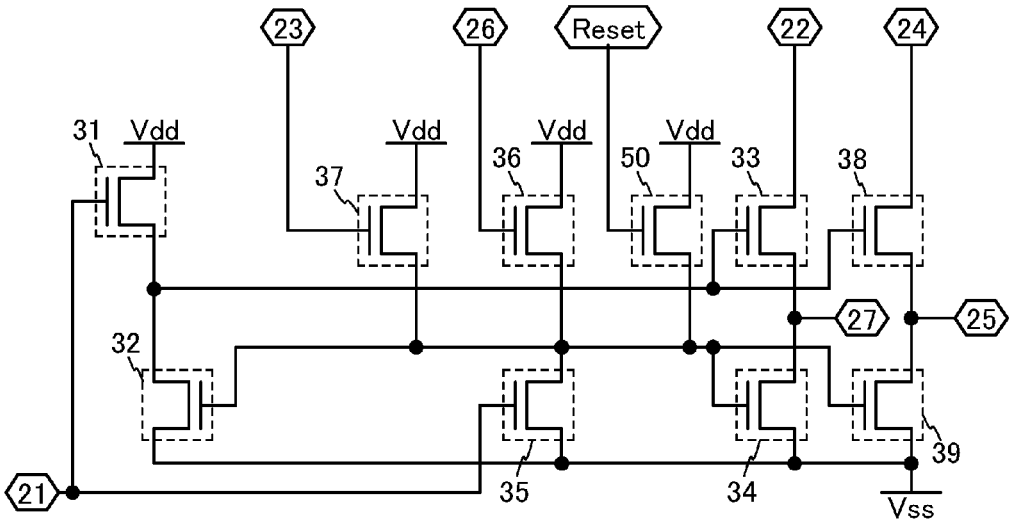
FIGS. 19A and 19B illustrate configurations of pulse output circuits.

FIG. 19A illustrates another example of the configuration of the pulse output circuit. The pulse output circuit illustrated in FIG. 19A includes a transistor 50 in addition to the configuration of the pulse output circuit illustrated in FIG. 8A. A first terminal of the transistor 50 is connected to the node supplied with the high power supply potential. A second terminal of the transistor 50 is connected to the gate electrode of the transistor 32, the gate electrode of the transistor 34, and the gate electrode of the transistor 39. A gate electrode of the transistor 50 is connected to a reset terminal (Reset).

A high-level potential is input to the reset terminal in a period which follows the round of switching of hues of the backlight in the pixel portion; a low-level potential is input in the other period. The transistor 50 is turned on by input of a high-level potential. Thus, the potential of each node can be initialized in the period after the backlight is turned on, so that malfunction can be prevented.

Note that in the case where the initialization is performed, it is necessary to provide an initialization period between periods in each of which one image is formed in the pixel portion. In addition, in the case where the backlight is turned off after one image is formed in the pixel portion, the initialization can be performed in the period in which the backlight is off.

Figure 19B:
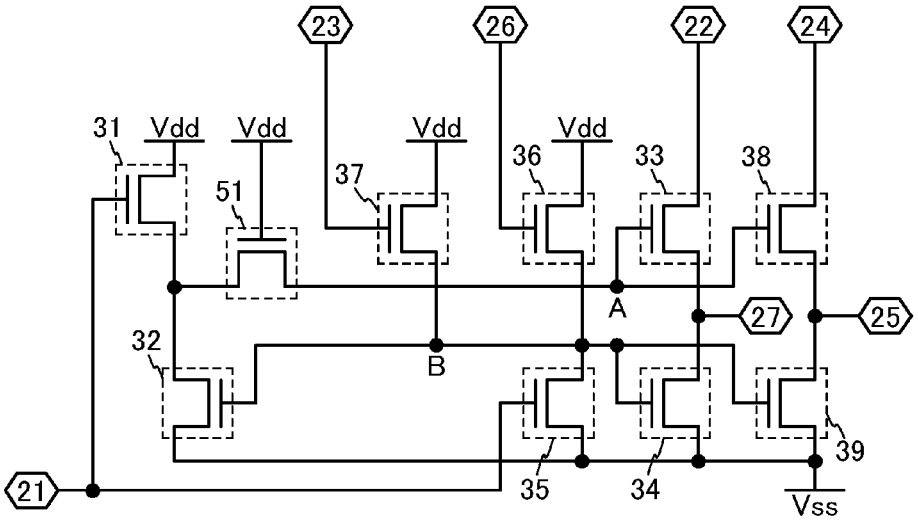

FIG. 19B illustrates another configuration example of the pulse output circuit. The pulse output circuit illustrated in FIG. 19B includes a transistor 51 in addition to the configuration of the pulse output circuit illustrated in FIG. 8A. A first terminal of the transistor 51 is connected to the second terminal of the transistor 31 and the second terminal of the transistor 32. A second terminal of the transistor 51 is connected to the gate electrode of the transistor 33 and the gate electrode of the transistor 38. A gate electrode of the transistor 51 is connected to the node supplied with the high power supply potential.

Note that the transistor 51 is off in the periods t1 to t6 shown in FIGS. 8B and 8C. Therefore, with the configuration including the transistor 51, the gate electrode of the transistor 33 and the gate electrode of the transistor 38 can be disconnected to the second terminal of the transistor 31 and the second terminal of the transistor 32 in the periods t1 to t6. Thus, a load at the time of the bootstrapping in the pulse output circuit can be reduced in the periods t1 to t6.

Figure 20A:
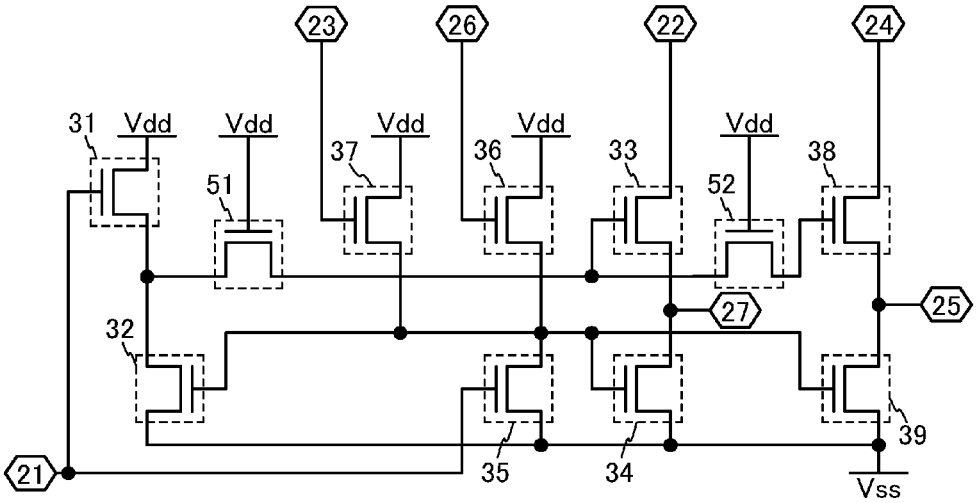
FIGS. 20A and 20B illustrate configurations of pulse output circuits.

FIG. 20A illustrates another example of the configuration of the pulse output circuit. The pulse output circuit illustrated in FIG. 20A includes a transistor 52 in addition to the configuration of the pulse output circuit illustrated in FIG. 19B. A first terminal of the transistor 52 is connected to the gate electrode of the transistor 33 and the second terminal of the transistor 51. A second terminal of the transistor 52 is connected to the gate electrode of the transistor 38. A gate electrode of the transistor 52 is connected to the node supplied with the high power supply potential.

The transistor 52 is provided as described above, whereby a load in the bootstrapping in the pulse output circuit can be reduced. In particular, the effect of reducing the load is enhanced in the case where the potential of a node connected to the gate electrode of the transistor 33 is increased only by capacitive coupling of the source electrode and the gate electrode of the transistor 33 in the pulse output circuit.

Figure 20B:
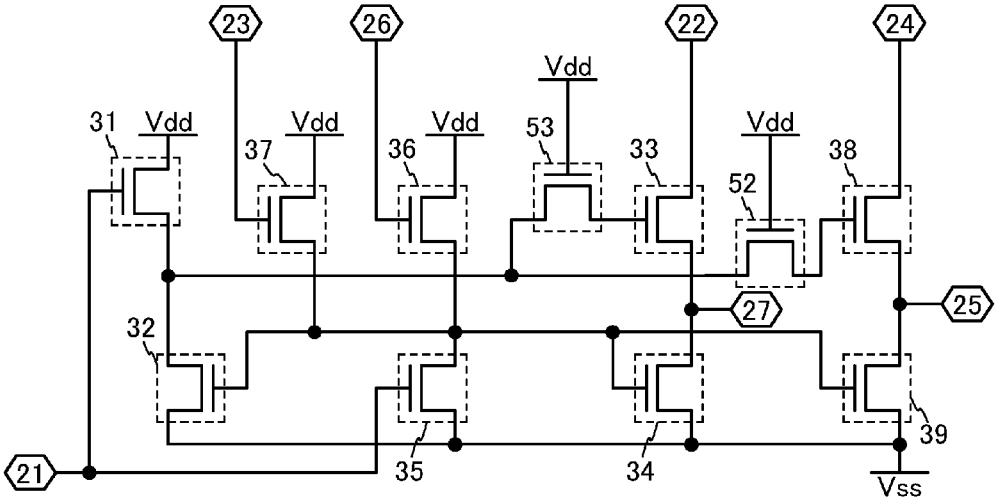

FIG. 20B illustrates another example of the configuration of the pulse output circuit. The pulse output circuit illustrated in FIG. 20B includes a transistor 53 in addition to the configuration of the pulse output circuit illustrated in FIG. 20A and does not include the transistor 51. A first terminal of the transistor 53 is connected to the second terminal of the transistor 31, the second terminal of the transistor 32, and the first terminal of the transistor 52. A second terminal of the transistor 53 is connected to the gate electrode of the transistor 33. A gate electrode of the transistor 53 is connected to the node supplied with the high power supply potential.

The transistor 53 is provided, whereby a load at the time of the bootstrapping in the pulse output circuit can be reduced. Further, an adverse effect of an irregular pulse generated in the pulse output circuit on the switching of the transistor 33 and the transistor 38 can be reduced.

As described in this embodiment, the liquid crystal display device according to one embodiment of the present invention performs color image display in such a manner that the pixel portion is divided into a plurality of regions and lights having different hues are sequentially supplied per region. At each time, the hues of the lights supplied to the adjacent regions can be different from each other. Accordingly, respective images of different colors can be prevented from being perceived separately without being synthesized, and a color break-up, which is likely to occur when a moving image is displayed, can be prevented.

In the case where a color image display is performed with a plurality of light sources whose hues are different from each other, unlike the case with the combination of a light source for a single color and color filters, the plurality of light sources need to be sequentially switched to turn on. Further, the frequency at which the light sources are switched needs to be higher than the frame frequency in the case of using the light source for single color. For example, assuming that the frame frequency in the case of using the light source for single color is 60 Hz, the frequency at which the light sources are switched is about three times as high as that, 180 Hz in an FS driving with the light sources for red, green, and blue. Therefore, the driver circuit is also operated in accordance with the above-described frequency of the light sources, which results in operation of the driver circuit at extremely high frequency. Consequently, power consumption in the driver circuit tends to be higher than that in the case with the combination of a light source for single color and color filters.

However, according to one embodiment of the present invention, a transistor whose off-state current is extremely low is used, whereby a period for holding a voltage applied to a liquid crystal element can be prolonged. Therefore, the driving frequency for displaying a still image can be decreased to a frequency lower than the driving frequency for displaying a moving image. Consequently, a liquid crystal display device whose power consumption is low can be achieved.

(Embodiment 2)

In Embodiment 2, one example of a liquid crystal display device of one embodiment of the present invention, whose panel structure is different from that in Embodiment 1 will be described.

<Structure Example of Panel>

A specific structure of a panel of one embodiment of the present invention will be described using an example thereof.

Figure 15A:
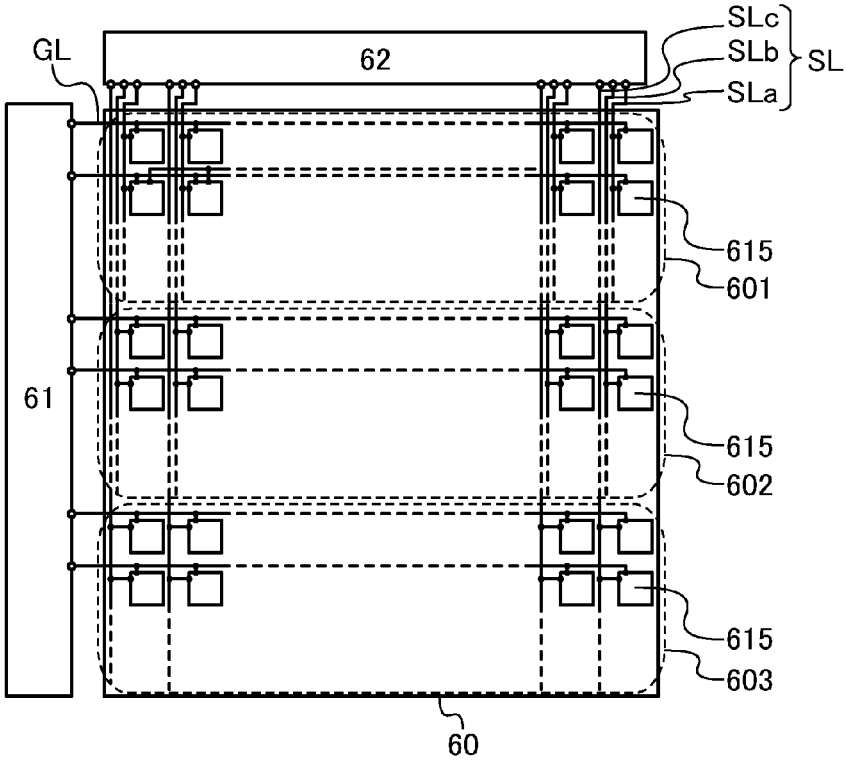
FIG. 15A illustrates a structure of a panel, and FIGS. 15B to 15D each illustrate a configuration of a pixel.

FIG. 15A illustrates a structural example of a liquid crystal display device. The liquid crystal display device illustrated in FIG. 15A includes a pixel portion 60, a scan line driver circuit 61, and a signal line driver circuit 62. In one embodiment of the present invention, the pixel portion 60 is divided into a plurality of regions. Specifically, the pixel portion 60 is divided into three regions (regions 601 to 603) in FIG. 15A. Each region includes a plurality of pixels 615 arranged in matrix.

M scan lines GL whose potentials are controlled by the scan line driver circuit 61 and 3×n signal lines SL whose potentials are controlled by the signal line driver circuit 62 are provided for the pixel portion 60. The m scan lines GL are divided into a plurality of groups in accordance with the number of regions of the pixel portion 60. For example, the m scan lines GL are divided into three groups because the pixel portion 60 is divided into three regions in FIG. 15A. The scan lines GL in each group are connected to the plurality of pixels 615 in each corresponding region. Specifically, each scan line GL is connected to n pixels 615 in each corresponding row among the plurality of pixels 615 arranged in matrix in each region.

In addition, the signal lines SL are divided into a plurality of groups in accordance with the number of regions of the pixel portion 60. For example, the 3×n signal lines SL are divided into three groups because the pixel portion 60 is divided into the three regions in FIG. 15A. The signal lines SL in each group are connected to the plurality of pixels 615 in each corresponding region.

Specifically, in FIG. 15A, the 3×n signal lines SL consist of n signal lines SLa, n signal lines SLb, and n signal lines SLc. Further, in FIG. 15A, each of the n signal lines SLa is connected to the pixels 615 in each corresponding column among the plurality of pixels 615 arranged in matrix in the region 601; each of the n signal lines SLb is connected to the pixels 615 in each corresponding column among the plurality of pixels 615 arranged in matrix in the region 602; and each of the n signal lines SLc is connected to the pixels 615 in each corresponding column among the plurality of pixels 615 arranged in matrix in the region 603.

Figure 15B:
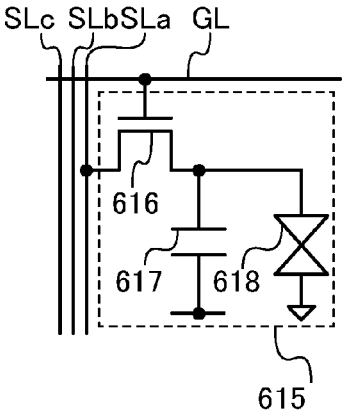
Figure 15C:
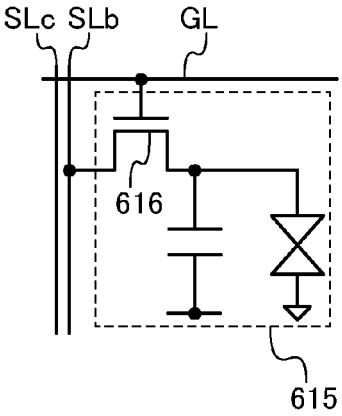
Figure 15D:
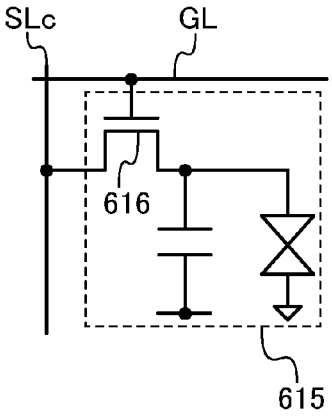

FIGS. 15B, 15C, and 15D are circuit diagrams of the pixels 615 in the regions 601, 602, and 603, respectively. The configuration of the pixel 615 is the same in the regions. Specifically, the pixel 615 includes a transistor 616 functioning as a switching element, a liquid crystal element 618 whose transmittivity is controlled in accordance with a potential of an image signal supplied through the transistor 616, and a capacitor 617 for holding the voltage between a pixel electrode and a counter electrode of the liquid crystal element 618.

As shown in FIG. 15B, in the region 601, the signal lines SLa, SLb, and SLc are provided next to the pixel 615. Further, in the pixel 615 in the region 601, a gate electrode of the transistor 616 is connected to the scan line GL, a first terminal thereof is connected to the signal line SLa, and a second terminal thereof is connected to the pixel electrode of the liquid crystal element 618. One electrode of the capacitor 617 is connected to the pixel electrode of the liquid crystal element 618, and the other electrode thereof is connected to a node applied with a potential.

As shown in FIG. 15C, in the region 602, the signal lines SLb and SLc are provided next to the pixel 615. Further, in the pixel 615 in the region 602, the gate electrode of the transistor 616 is connected to the scan line GL, the first terminal thereof is connected to the signal line SLb, and the second terminal thereof is connected to the pixel electrode of the liquid crystal element 618. One electrode of the capacitor 617 is connected to the pixel electrode of the liquid crystal element 618, and the other electrode thereof is connected to the node applied with the potential.

As shown in FIG. 15D, in the region 603, the signal line SLc is provided next to the pixel 615. Further, in the pixel 615 in the region 603, the gate electrode of the transistor 616 is connected to the scan line GL, the first terminal thereof is connected to the signal line SLc, and the second terminal thereof is connected to the pixel electrode of the liquid crystal element 618. One electrode of the capacitor 617 is connected to the pixel electrode of the liquid crystal element 618, and the other electrode thereof is connected to the node applied with the potential.

A potential is also applied to the counter electrode of the liquid crystal element 618 in each pixel 615. The potential applied to the counter electrode may be in common with the potential applied to the other electrode of the capacitor 617.

The pixel 615 may further include another circuit element such as a transistor, a diode, a resistor, a capacitor, or an inductor as needed.

In one embodiment of the present invention, a channel formation region of the transistor 616 functioning as a switching element may include a semiconductor whose bandgap is wider than that of a silicon semiconductor and whose intrinsic carrier density is lower than that of the silicon semiconductor. With such a semiconductor material having the above-described characteristics included in the channel formation region, the off-state current of the transistor 616 can be extremely decreased and the withstand voltage thereof can be increased. Further, with the transistor 616 having the above-described structure used as a switching element, leakage of electric charge accumulated in the liquid crystal element 618 can be further prevented as compared to the case of using a transistor including a normal semiconductor material such as silicon or germanium.

The transistor 616 whose off-state current is extremely low enables the period in which voltage applied to the liquid crystal element 618 is held to be increased. Accordingly, for example, in the case where image signals whose image data is the same as each other, like a still image, are written to the pixel portion 60 for a plurality of consecutive frame periods, display of an image can be maintained even when the driving frequency is low, i.e., the number of writing operations of an image signal to the pixel portion 60 for a certain period is reduced. For example, the above-described transistor in which a highly-purified, oxygen-defect-reduced oxide semiconductor film is used as an active layer is employed as the transistor 616, whereby an interval between writings of image signals can be extended to 10 seconds or more, preferably 30 seconds or more, further preferably 1 minute or more. As the interval between writings of image signals is made longer, power consumption can be further reduced.

In addition, since the potential of an image signal can be held for a longer period, the quality of the displayed image can be prevented from being lowered even when the capacitor 617 for holding the potential of an image signal is not connected to the liquid crystal element 618. Thus, it is possible to increase the aperture ratio by reducing the size of the capacitor 617 or by not providing the capacitor 617, which leads to reduction in power consumption of the liquid crystal display device.

In addition, by inversion driving in which the polarity of the potential of an image signal is inverted with respect to the potential of the counter electrode, deterioration of a liquid crystal called burn-in can be prevented. However, according to the inversion driving, the change in the potential supplied to the signal line is increased at the time of changing the polarity of the image signal; thus, a potential difference between a source electrode and a drain electrode of the transistor 616 functioning as a switching element is increased. Accordingly, deterioration of characteristics such as a shift in threshold voltage is easily caused in the transistor 616. Furthermore, in order to maintain the voltage held in the liquid crystal element 618, the off-state current of the transistor 616 needs to be low even when the potential difference between the source electrode and the drain electrode is large.

In one embodiment of the present invention, a semiconductor whose bandgap is wider than that of silicon or germanium and whose intrinsic carrier density is lower than that of silicon or germanium, such as an oxide semiconductor, is used for the transistor 616; therefore, the withstand voltage of the transistor 616 can be increased and the off-state current can be made considerably low. Therefore, as compared to the case of using a transistor including a normal semiconductor material such as silicon or germanium, deterioration of the transistor 616 can be prevented and the voltage held in the liquid crystal element 618 can be maintained.

Although FIGS. 15B to 15D illustrate the case where one transistor 616 is used as a switching element in the pixel 615, the present invention is not limited to this structure. A plurality of transistors may be used as one switching element. In the case where a plurality of transistors functions as one switching element, the plurality of transistors may be connected to each other in parallel, in series, or in combination of parallel connection and series connection.

<Configuration Example of Scan Line Driver Circuit 61>

Figure 16:
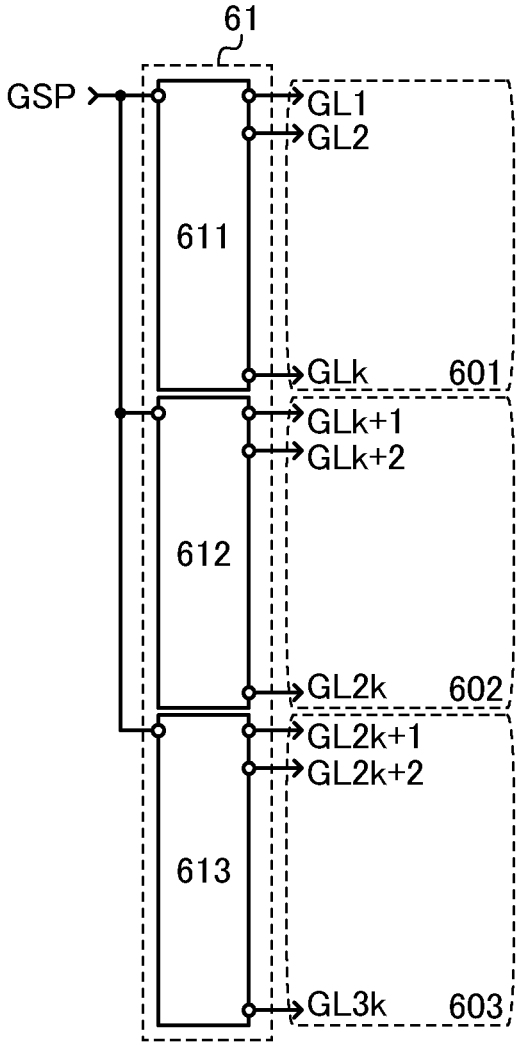
FIG. 16 illustrate a structure of a scan line driver circuit.

FIG. 16 illustrates a configuration example of the scan line driver circuit 61 included in the liquid crystal display device illustrated in FIGS. 15A to 15D. The scan line driver circuit 61 illustrated in FIG. 16 includes shift registers 611 to 613 each including k output terminals. Each output terminal of the shift register 611 is connected to each corresponding one of the k scan lines GL provided in the region 601; each output terminal of the shift register 612 is connected to each corresponding one of the k scan lines GL provided in the region 602; and each output terminal of the shift register 613 is connected to each corresponding one of the k scan lines GL provided in the region 603. That is, selection signals are scanned in the region 601 by the shift register 611, selection signals are scanned in the region 602 by the shift register 612, and selection signals are scanned in the region 603 by the shift register 613.

Specifically, a pulse of a scan line driver circuit start pulse signal (GSP) is input to the shift register 611, in response to which, the shift register 611 supplies selection signals whose pulses are shifted by ½ period sequentially to the scan lines GL1 to GLk. In response to the input of the pulse of the scan line driver circuit start pulse signal (GSP), the shift register 612 supplies selection signals whose pulses are shifted by ½ period sequentially to the scan lines GLk+1 to GL2k. In response to the input of the pulse of the scan line driver circuit start pulse signal (GSP), the shift register 613 supplies selection signals whose pulses are shifted by ½ period sequentially to the scan lines GL2k+1 to GL3k.

An operation example of the scan line driver circuit 61 in a full-color image display period 301 and a monochrome still image display period 303 is described below using FIG. 17.

Figure 17:
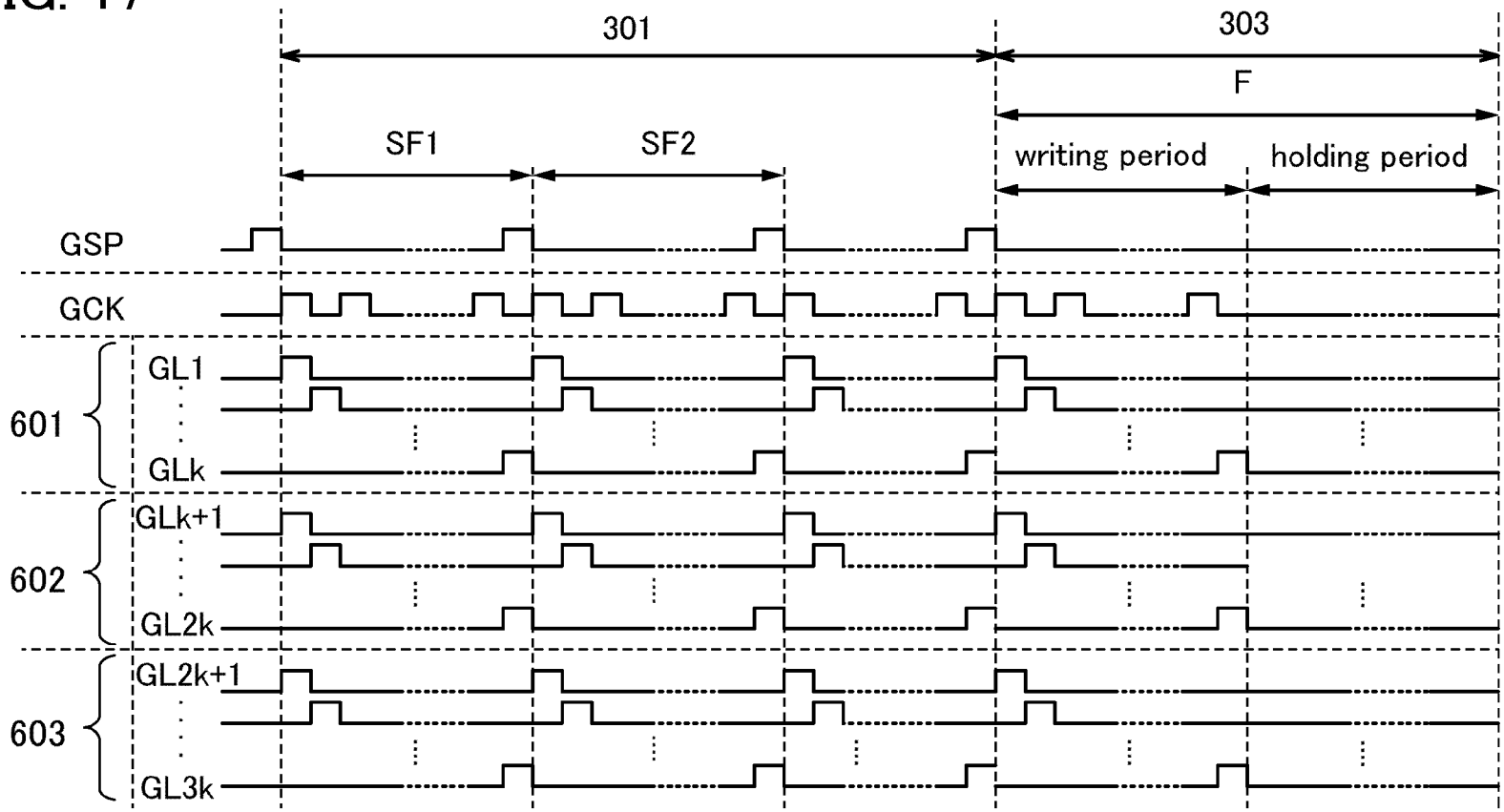
FIG. 17 is a timing chart of a scan line driver circuit.

FIG. 17 is a timing chart of a scan line driver circuit clock signal (GCK), the selection signals input to the scan lines GL1 to GLk, the selection signals input to the scan lines GLk+1 to GL2k, and the selection signals input to the scan lines GL2k+1 to GL3k.

First, an operation of the scan line driver circuit 61 in the full-color image display period 301 is described below. In the full-color image display period 301, a first subframe period SF1 starts in response to the pulse of the scan line driver circuit start pulse signal (GSP). In the first subframe period SF1, the selection signals whose pulses are sequentially shifted by ½ period are supplied to the scan lines GL1 to GLk; the selection signals whose pulses are sequentially shifted by ½ period are supplied to the scan lines GLk+1 to GL2k; and the selection signals whose pulses are sequentially shifted by ½ period are supplied to the scan lines GL2k+1 to GL3k.

Then, the pulse of the scan line driver circuit start pulse signal (GSP) is input to the scan line driver circuit 61 again, in response to which a second subframe period SF2 starts. In the second subframe period SF2, in a similar manner to the first subframe period SF1, sequentially-pulse-shifted selection signals are input to the scan lines GL1 to GLk; the scan lines GLk+1 to GL2k; and the scan lines GL2k+1 to GL3k.

Then, the pulse of the scan line driver circuit start pulse signal (GSP) is input to the scan line driver circuit 61 again, in response to which a third subframe period SF3 starts. In the third subframe period SF3, in a similar manner to the first subframe period SF1, sequentially-pulse-shifted selection signals are input to the scan lines GL1 to GLk; the scan lines GLk+1 to GL2k; and the scan lines GL2k+1 to GL3k.

The first to third subframe periods SF1 to SF3 are terminated to complete one frame period, whereby an image can be displayed on the pixel portion.

Next, an operation of the scan line driver circuit 61 in the monochrome still image display period 303 is described below. In the monochrome still image display period 303, an operation which is similar to the operation of any of the subframe periods in the full-color image display period 301 is performed in an image signal writing period in the scan line driver circuit 61.

Next, in a holding period, supplies of a driving signal and a power supply potential to the scan line driver circuit 61 are stopped. Specifically, first, the supply of the scan line driver circuit start pulse signal (GSP) is stopped to stop the output of selection signals from the scan line driver circuit 61, thereby terminating the selection by pulses in all of the scan lines GL, and then, the supply of the power supply potential to the scan line driver circuit 61 is stopped. According to the method, malfunction of the scan line driver circuit 61 in stopping the operation of the scan line driver circuit 61 can be prevented. In addition, supply of first to fourth scan line driver circuit clock signals (GCK1 to GCK4) to the scan line driver circuit 61 may be stopped.

The supplies of the driving signal and the power supply potential to the scan line driver circuit 61 are stopped, whereby a low-level potential is supplied to the scan lines GL1 to GLk; the scan lines GLk+1 to GL2k; and the scan lines GL2k+1 to GL3k.

In a monochrome moving image display period 302, in a writing period, an operation of the scan line driver circuit 61 is similar to the operation in the monochrome still image display period 303.

In one embodiment of the present invention, a transistor whose off-state current is extremely low is used in the pixel, whereby the period in which voltage applied to the liquid crystal element is held can be increased. Therefore, in the monochrome still image display period 303, the holding period shown in FIG. 17 can be prolonged, which enables the driving frequency of the scan line driver circuit 61 to be decreased to be lower than that in the full-color image display period 301. Accordingly, a liquid crystal display device whose power consumption is low can be provided.

<Configuration Example of Signal Line Driver Circuit 62>

Figure 18:
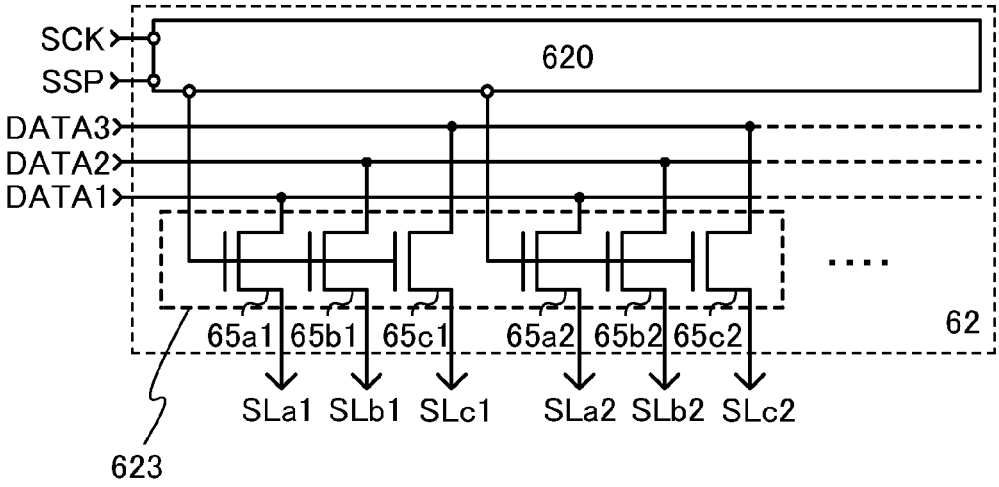
FIG. 18 illustrates a configuration of a signal line driver circuit.

FIG. 18 illustrates a configuration example of the signal line driver circuit 62 shown in FIG. 15A. The signal line driver circuit 62 shown in FIG. 18 includes a shift register 620 having first to n-th output terminals and a switching element group 623 which controls supply of an image signal (DATA1) for the region 601, an image signal (DATA2) for the region 602, and an image signal (DATA3) for the region 603 to the signal lines SLa to SLc.

Specifically, the switching element group 623 includes transistors 65*a*1 to 65*an*, transistors 65*b*1 to 65*bn*, and transistors 65*c*1 to 65*cn*.

First terminals of the transistors 65*a*1 to 65*an* are connected to a wiring for supplying the image signal (DATA1), second terminals thereof are connected to the signal lines SLal to SLan, respectively, and gate electrodes thereof are connected to the first to n-th output terminals of the shift register 620, respectively.

First terminals of the transistors 65*b*1 to 65*bn* are connected to a wiring for supplying the image signal (DATA2), second terminals thereof are connected to the signal lines SLbl to SLbn, respectively, and gate electrodes thereof are connected to the first to n-th output terminals of the shift register 620, respectively.

First terminals of the transistors 65*c*1 to 65*cn* are connected to a wiring for supplying the image signal (DATA3), second terminals thereof are connected to the signal lines SLc1 to SLcn, respectively, and gate electrodes thereof are connected to the first to n-th output terminals of the shift register 620, respectively.

The shift register 620 operates in accordance with a driving signal such as a signal line driver circuit start pulse signal (SSP) and a signal line driver circuit clock signal (SCK), and outputs signals whose pulses are sequentially shifted from the first to n-th output terminals. The signals are input to the gate electrodes of the transistors to turn the transistors 65*a*1 to 65*an* on sequentially, turn the transistors 65*b*1 to 65*bn* on sequentially, and turn the transistors 65*c*1 to 65*cn* on sequentially. Then, the image signal (DATA1) is input to the signal lines SLal to SLan, the image signal (DATA2) is input to the signal lines SLb 1 to SLbn, and the image signal (DATA3) is input to the signal lines SLc1 to SLcn, so that an image is displayed.

In the holding period in the monochrome still image display period 303, supply of the signal line driver circuit start pulse signal (SSP) to the shift register 620 and supply of the image signals (DATA1) to (DATA3) to the signal line driver circuit 62 are stopped. Specifically, first, the supply of the signal line driver circuit start pulse signal (SSP) is stopped to stop sampling of an image signal in the signal line driver circuit 62, and then, the supply of the image signals and the supply of the power supply potential to the signal line driver circuit 62 are stopped. According to the method, malfunction of the signal line driver circuit 62 in the stopping operation of the signal line driver circuit 62 can be prevented. In addition, supply of the signal line driver circuit clock signal (SCK) to the signal line driver circuit 62 may be stopped.

This embodiment can be combined as appropriate with any of the above-described embodiments.

(Embodiment 3)

In Embodiment 3, a manufacturing method of a transistor using an oxide semiconductor will be described.

Figure 21A:
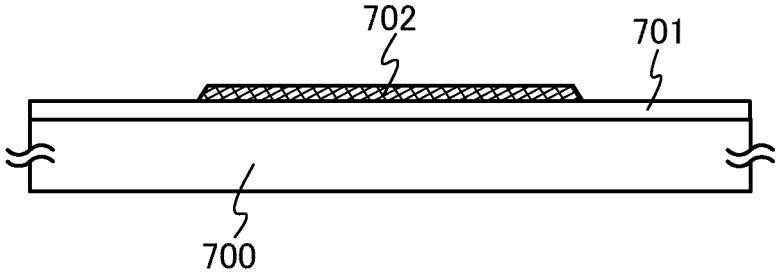
FIGS. 21A to 21C are cross-sectional views illustrating a method for manufacturing a transistor.

First, as illustrated in FIG. 21A, an insulating film 701 is formed over an insulating surface of a substrate 700, and a gate electrode 702 is formed over the insulating film 701.

Although there is no particular limitation on a substrate which can be used as the substrate 700 as long as it has a light-transmitting property, it is necessary that the substrate have at least enough heat resistance to heat treatment performed later. For example, a glass substrate manufactured by a fusion process or a float process, a quartz substrate, a ceramic substrate, or the like can be used as the substrate 700. In the case where a glass substrate is used and the temperature at which the heat treatment is performed is high, a glass substrate whose strain point is higher than or equal to 730° C. is preferably used. Although a substrate formed of a flexible synthetic resin such as plastic generally has a lower resistance temperature than the aforementioned substrates, it may be used as long as being resistant to a processing temperature during the manufacturing process.

The insulating film 701 is formed using a material which can withstand a temperature of heat treatment in a later manufacturing step. Specifically, it is preferable to use silicon oxide, silicon nitride, silicon nitride oxide, silicon oxynitride, aluminum nitride, aluminum oxide, or the like for the insulating film 701.

In this specification, an oxynitride denotes a material in which the amount of oxygen is larger than that of nitrogen, and a nitride oxide denotes a material in which the amount of nitrogen is larger than that of oxygen.

The gate electrode 702 can be formed with a single layer or a stacked layer using one or more of conductive films using a metal material such as molybdenum, titanium, chromium, tantalum, tungsten, neodymium, or scandium, or an alloy material including any of these metal materials as a main component, or a nitride of these metals. Aluminum or copper can also be used as such a metal material as long as it can withstand the temperature of the heat treatment to be performed in a later step. Aluminum or copper is preferably combined with a refractory metal material in order to prevent a heat resistance problem and a corrosive problem. As the refractory metal material, molybdenum, titanium, chromium, tantalum, tungsten, neodymium, scandium, or the like can be used.

For example, as a two-layer structure of the gate electrode 702, the following structures are preferable: a two-layer structure in which a molybdenum film is stacked over an aluminum film, a two-layer structure in which a molybdenum film is stacked over a copper film, a two-layer structure in which a titanium nitride film or a tantalum nitride film is stacked over a copper film, and a two-layer structure in which a titanium nitride film and a molybdenum film are stacked. As a three-layer structure of the gate electrode 702, the following structure is preferable: a stacked-layer structure in which an aluminum film, an alloy film of aluminum and silicon, an alloy film of aluminum and titanium, or an alloy film of aluminum and neodymium is used as a middle layer and sandwiched between two films as an upper layer and a lower layer which are selected from a tungsten film, a tungsten nitride film, a titanium nitride film, or a titanium film.

Further, a light-transmitting oxide conductive film of indium oxide, an alloy of indium oxide and tin oxide, an alloy of indium oxide and zinc oxide, zinc oxide, zinc aluminum oxide, zinc aluminum oxynitride, zinc gallium oxide, or the like can be used as the gate electrode 702.

The thickness of the gate electrode 702 is in the range of 10 nm to 400 nm, preferably 100 nm to 200 nm. In this embodiment, a conductive film with a thickness of 150 nm for the gate electrode is formed by a sputtering method using a tungsten target and is processed (patterned) into a desired shape by etching, so that the gate electrode 702 is formed. Note that the end portion of the formed gate electrode is preferably tapered because coverage with a gate insulating film stacked thereover is improved. A resist mask may be formed by an inkjet method. Formation of the resist mask by an inkjet method needs no photomask; thus, manufacturing cost can be reduced.

Figure 21B:
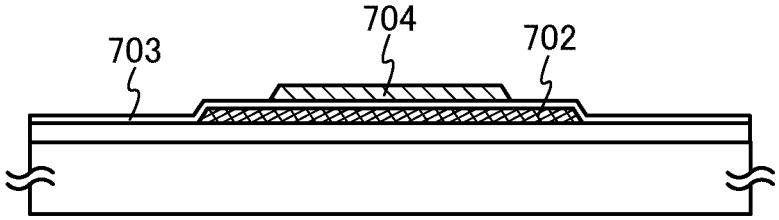

Next, as illustrated in FIG. 21B, a gate insulating film 703 is formed over the gate electrode 702, and then an island-shaped oxide semiconductor film 704 is formed over the gate insulating film 703 so as to overlap with the gate electrode 702.

The gate insulating film 703 can be formed with a single-layer structure or a stacked-layer structure including any of a silicon oxide film, a silicon nitride film, a silicon oxynitride film, a silicon nitride oxide film, an aluminum oxide film, an aluminum nitride film, an aluminum oxynitride film, an aluminum nitride oxide film, a hafnium oxide film, or a tantalum oxide film by a plasma CVD method, a sputtering method, or the like. It is preferable that the gate insulating film 703 do not include an impurity such as moisture, hydrogen, or oxygen as much as possible. In the case of forming a silicon oxide film by a sputtering method, a silicon target or a quartz target is used as a target, and oxygen or a mixed gas of oxygen and argon is used as a sputtering gas.

The oxide semiconductor which is highly purified by removal of an impurity is extremely sensitive to an interface state density or an interface electric charge; therefore, the interface between the highly purified oxide semiconductor and the gate insulating film 703 is important. Therefore, the gate insulating film (GI) that is in contact with the highly purified oxide semiconductor needs to have high quality.

For example, a high-density plasma enhanced CVD using a microwave (frequency: 2.45 GHz) is preferably used, with which an insulating film which is dense, has high withstand voltage, and is high quality can be formed. This is because when the highly purified oxide semiconductor is closely in contact with the high-quality gate insulating film, the interface state density can be reduced and interface properties can be favorable.

Needless to say, any other film formation method, such as a sputtering method or a plasma CVD method, can be applied as long as a high-quality insulating film can be formed as the gate insulating film 703. An insulating film whose quality and/or interface characteristics with the oxide semiconductor are/is improved by heat treatment after the deposition may be used as well. In any case, any insulating film that has a reduced interface state density between a gate insulating film and the oxide semiconductor and can form a favorable interface as well as having a favorable film quality as the gate insulating film can be used.

The gate insulating film 703 may be formed to have a structure in which an insulating film including a material having a high barrier property and an insulating film having lower proportion of nitrogen, such as a silicon oxide film or a silicon oxynitride film, are stacked. In that case, the insulating film such as a silicon oxide film or a silicon oxynitride film is provided between the insulating film having a high barrier property and the oxide semiconductor film. As the insulating film having a high barrier property, a silicon nitride film, a silicon nitride oxide film, an aluminum nitride film, an aluminum nitride oxide film, or the like can be given, for example. The insulating film having a high barrier property can prevent impurities in an atmosphere, such as moisture or hydrogen, or impurities in the substrate, such as an alkali metal or a heavy metal, from entering the oxide semiconductor film, the gate insulating film 703, or the interface between the oxide semiconductor film and another insulating film and the vicinity thereof. In addition, the insulating film having lower proportion of nitrogen such as a silicon oxide film or a silicon oxynitride film is formed so as to be in contact with the oxide semiconductor film, so that the insulating film having a high barrier property can be prevented from being in contact with the oxide semiconductor film directly.

For example, a silicon nitride film ($SiN_y(y>0)$) with a thickness greater than or equal to 50 nm and less than or equal to 200 nm is formed by a sputtering method as a first gate insulating film, and a silicon oxide film ($SiO_x(x>0)$) with a thickness greater than or equal to 5 nm and less than or equal to 300 nm is stacked over the first gate insulating film as a second gate insulating film; thus, a 100-nm-thick gate insulating film may be formed as the gate insulating film 703. The thickness of the gate insulating film 703 may be set as appropriate depending on characteristics needed for the transistor and may be about 350 nm to 400 nm.

In this embodiment, a silicon oxide film having a thickness of 100 nm formed by a sputtering method is stacked over a silicon nitride film having a thickness of 50 nm formed by a sputtering method, so that the gate insulating film 703 is formed.

Note that the gate insulating film 703 is in contact with the oxide semiconductor to be formed later. Hydrogen contained in the oxide semiconductor adversely affects characteristics of the transistor; therefore, it is preferable that the gate insulating film 703 do not contain hydrogen, a hydroxyl group, and moisture. In order that the gate insulating film 703 does not contain hydrogen, a hydroxyl group, and moisture as much as possible, it is preferable that an impurity adsorbed on the substrate 700, such as moisture or hydrogen, be eliminated and removed by preheating the substrate 700, over which the gate electrode 702 is formed, in a preheating chamber of a sputtering apparatus, as a pretreatment for film formation. The temperature for the preheating is higher than or equal to 100° C. and lower than or equal to 400° C., preferably higher than or equal to 150° C. and lower than or equal to 300° C. As an exhaustion unit provided for the preheating chamber, a cryopump is preferable. Note that this preheating treatment can be omitted.

The island-shaped oxide semiconductor film can be formed by processing an oxide semiconductor film formed over the gate insulating film 703 into a desired shape. The thickness of the oxide semiconductor film is greater than or equal to 2 nm and less than or equal to 200 nm, preferably greater than or equal to 3 nm and less than or equal to 50 nm, further preferably greater than or equal to 3 nm and less than or equal to 20 nm. The oxide semiconductor film is formed by a sputtering method using an oxide semiconductor target. Moreover, the oxide semiconductor film can be formed by a sputtering method under a rare gas (e.g., argon) atmosphere, an oxygen atmosphere, or a mixed atmosphere of a rare gas (e.g., argon) and oxygen.

Before the oxide semiconductor film is formed by a sputtering method, dust on a surface of the gate insulating film 703 is preferably removed by reverse sputtering in which an argon gas is introduced and plasma is generated. The reverse sputtering refers to a method in which, without application of voltage to a target side, an RF power source is used for application of voltage to a substrate side in an argon atmosphere to generate plasma in the vicinity of the substrate to modify a surface. Instead of an argon atmosphere, a nitrogen atmosphere, a helium atmosphere, or the like may be used. An argon atmosphere to which oxygen, nitrous oxide, or the like is added may be used as well. Alternatively, an argon atmosphere to which chlorine, carbon tetrafluoride, or the like is added may be used.

As described above, for the oxide semiconductor film, the following can be used: indium oxide; tin oxide; zinc oxide; a binary metal oxide such as an In—Zn-based oxide semiconductor, a Sn—Zn-based oxide semiconductor, an Al—Zn-based oxide semiconductor, a Zn—Mg-based oxide semiconductor, a Sn—Mg-based oxide semiconductor, an In—Mg-based oxide semiconductor, or an In—Ga-based oxide semiconductor; a ternary metal oxide such as an In—Ga—Zn-based oxide semiconductor (also referred to as IGZO), an In—Al—Zn-based oxide semiconductor, an In—Sn—Zn-based oxide semiconductor, an Sn—Ga—Zn-based oxide semiconductor, an Al—Ga—Zn-based oxide semiconductor, a Sn—Al—Zn-based oxide semiconductor, an In—Hf—Zn-based oxide semiconductor, an In—La—Zn-based oxide semiconductor, an In—Ce—Zn-based oxide semiconductor, an In—Pr—Zn-based oxide semiconductor, an In—Nd—Zn-based oxide semiconductor, an In—Sm—Zn-based oxide semiconductor, an In—Eu—Zn-based oxide semiconductor, an In—Gd—Zn-based oxide semiconductor, an In—Tb—Zn-based oxide semiconductor, an In—Dy—Zn-based oxide semiconductor, an In—Ho—Zn-based oxide semiconductor, an In—Er—Zn-based oxide semiconductor, an In—Tm—Zn-based oxide semiconductor, an In—Yb—Zn-based oxide semiconductor, or an In—Lu—Zn-based oxide semiconductor; or a quaternary metal oxide such as an In—Sn—Ga—Zn-based oxide semiconductor, an In—Hf—Ga—Zn-based oxide semiconductor, an In—Al—Ga—Zn-based oxide semiconductor, an In—Sn—Al—Zn-based oxide semiconductor, an In—Sn—Hf—Zn-based oxide semiconductor, or an In—Hf—Al—Zn-based oxide semiconductor.

The oxide semiconductor preferably includes Indium (In), and further preferably includes In and gallium (Ga). In order to obtain an I-type (intrinsic) oxide semiconductor film, dehydration or dehydrogenation and reduction in an oxygen defect by oxygen donation to the oxide semiconductor film, which are described later, are effective.

In this embodiment, as the oxide semiconductor film, an In—Ga—Zn—O-based oxide semiconductor thin film with a thickness of 30 nm, which is obtained by a sputtering method using a target including indium (In), gallium (Ga), and zinc (Zn), is used. As the target, for example, a target of $In_2O_3$:$Ga_2O_3$:ZnO=1:1:1 (molar ratio), $In_2O_3$:$Ga_2O_3$:ZnO=1:1:2 (molar ratio), or $In_2O_3$:$Ga_2O_3$:ZnO=1:1:4 (molar ratio) can be used. The filling factor of the target including In, Ga, and Zn is higher than or equal to 90% and lower than or equal to 100%, preferably higher than or equal to 95% and lower than 100%. As higher the filling factor of the target is, the denser the oxide semiconductor film is.

When an In—Zn—O based material is used as the oxide semiconductor, a target having a composition ratio of In:Zn=50:1 to 1:2 in an atomic ratio ($In_2O_3$:ZnO=25:1 to 1:4 in a molar ratio), preferably In:Zn=20:1 to 1:1 in an atomic ratio ($In_2O_3$:ZnO=10:1 to 2:1 in a molar ratio), or further preferably In:Zn=1.5:1 to 15:1 in an atomic ratio ($In_2O_3$:ZnO=3:4 to 15:2 in a molar ratio) is used. For example, in a target used for formation of an In—Zn—O-based oxide semiconductor which has an atomic ratio of In:Zn:O=X:Y:Z, Z>1.5X+Y is satisfied. The ratio of Zn may be set within the above range, so that the mobility can be improved.

In this embodiment, the oxide semiconductor film is formed over the substrate 700 in such a manner that the substrate is held in a treatment chamber kept at reduced pressure, a sputtering gas from which hydrogen and moisture have been removed is introduced into the treatment chamber while remaining moisture therein is removed, and the above target is used. The substrate temperature may be set to higher than or equal to 100° C. and lower than or equal to 600° C., preferably higher than or equal to 200° C. and lower than or equal to 400° C. in film formation. By forming the oxide semiconductor film in a state where the substrate is heated, the concentration of an impurity contained in the formed oxide semiconductor film can be reduced. In addition, damage by sputtering can be reduced. In order to remove remaining moisture in the treatment chamber, an entrapment vacuum pump is preferably used. For example, a cryopump, an ion pump, or a titanium sublimation pump is preferably used. The exhaustion unit may be a turbo pump provided with a cold trap. In a treatment chamber which is exhausted with the cryopump, for example, a hydrogen atom, a compound containing a hydrogen atom, such as water ($H_2O$), (more preferably, also a compound containing a carbon atom), and the like are removed, whereby the concentration of an impurity contained in the oxide semiconductor film formed in the treatment chamber can be reduced.

As one example of the deposition conditions, the distance between the substrate and the target is 100 mm, the pressure is 0.6 Pa, the direct-current (DC) power is 0.5 kW, and the atmosphere is an oxygen atmosphere (the proportion of the oxygen flow rate is 100%). A pulsed direct-current (DC) power supply is preferably used because dust generated in deposition can be reduced and the film thickness can be made uniform.

In order that the oxide semiconductor film does not contain hydrogen, a hydroxyl group, and moisture as much as possible, it is preferable that an impurity adsorbed on the substrate 700, such as moisture or hydrogen, be eliminated and removed by preheating the substrate 700, over which elements up to and including the gate insulating film 703 are formed, in a preheating chamber of a sputtering apparatus, as a pretreatment for film formation. The temperature for the preheating is higher than or equal to 100° C. and lower than or equal to 400° C., preferably higher than or equal to 150° C. and lower than or equal to 300° C. As an exhaustion unit, a cryopump is preferably provided for the preheating chamber. This preheating treatment can be omitted. This preheating may be similarly performed on the substrate 700 over which elements up to and including the conductive film 705 and the conductive film 706 are formed, before the formation of an insulating film 707.

Note that etching for forming the island-shaped oxide semiconductor film 704 may be wet etching, dry etching, or both dry etching and wet etching. As the etching gas for dry etching, a gas containing chlorine (e.g., a chlorine-based gas such as chlorine ($Cl_2$), boron trichloride ($BCl_3$), silicon tetrachloride ($SiCl_4$), or carbon tetrachloride ($CCl_4$)) is preferably used. Alternatively, a gas containing fluorine (e.g., a fluorine-based gas such as carbon tetrafluoride ($CF_4$), sulfur hexafluoride ($SF_6$), nitrogen trifluoride ($NF_3$), or trifluoromethane ($CHF_3$)); hydrogen bromide (HBr); oxygen ($O_2$); any of these gases to which a rare gas such as helium (He) or argon (Ar) is added; or the like can be used.

As the dry etching method, a parallel plate RIE (reactive ion etching) method or an ICP (inductively coupled plasma) etching method can be used. In order to etch a film into a desired shape, the etching conditions (the amount of electric power applied to a coil-shaped electrode, the amount of electric power applied to an electrode on a substrate side, the temperature of the electrode on the substrate side, or the like) are adjusted as appropriate.

As an etchant used for wet etching, ITO-07N (produced by KANTO CHEMICAL CO., INC.) may be used.

A resist mask for forming the island-shaped oxide semiconductor film 704 may be formed by an inkjet method. Formation of the resist mask by an inkjet method needs no photomask; thus, manufacturing cost can be reduced.

It is preferable that reverse sputtering be performed before the formation of a conductive film in the next step so that a resist residue or the like left over surfaces of the island-shaped oxide semiconductor film 704 and the gate insulating film 703 is removed.

Note that the oxide semiconductor film formed by sputtering or the like contains a large amount of moisture or hydrogen (including a hydroxyl group) as an impurity in some cases. Moisture or hydrogen easily forms a donor level and thus serves as an impurity in the oxide semiconductor. In one embodiment of the present invention, in order to reduce an impurity such as moisture or hydrogen in the oxide semiconductor film (dehydration or dehydrogenation), the island-shaped oxide semiconductor film 704 is subjected to heat treatment in a reduced-pressure atmosphere, an inert gas atmosphere of nitrogen, a rare gas, or the like, an oxygen gas atmosphere, or an ultra dry air atmosphere (the moisture amount is 20 ppm (−55° C. by conversion into a dew point) or less, preferably 1 ppm or less, further preferably 10 ppb or less, in the case where the measurement is performed by a dew point meter in a cavity ring down laser spectroscopy (CRDS) method).

By performing the heat treatment on the island-shaped oxide semiconductor film 704, moisture or hydrogen in the island-shaped oxide semiconductor film 704 can be eliminated. Specifically, heat treatment may be performed at a temperature higher than or equal to 250° C. and lower than or equal to 750° C., preferably higher than or equal to 400° C. and lower than the strain point of a substrate. For example, heat treatment may be performed at 500° C. for a period about longer than or equal to 3 minutes and shorter than or equal to 6 minutes. When an RTA method is used for the heat treatment, dehydration or dehydrogenation can be performed in a short time; therefore, treatment can be performed even at a temperature higher than the strain point of a glass substrate.

In this embodiment, an electrical furnace that is one of heat treatment apparatuses is used.

The heat treatment apparatus is not limited to an electrical furnace, and may include a device for heating an object by heat conduction or heat radiation from a heating element such as a resistance heating element. For example, an RTA (rapid thermal anneal) apparatus such as a GRTA (gas rapid thermal anneal) apparatus or an LRTA (lamp rapid thermal anneal) apparatus can be used. An LRTA apparatus is an apparatus for heating an object by radiation of light (an electromagnetic wave) emitted from a lamp such as a halogen lamp, a metal halide lamp, a xenon arc lamp, a carbon arc lamp, a high pressure sodium lamp, or a high pressure mercury lamp. A GRTA apparatus is an apparatus for heat treatment using a high-temperature gas. As the gas, an inert gas which does not react with an object processed by the heat treatment, such as nitrogen or a rare gas such as argon is used.

Note that it is preferable that in the heat treatment, moisture, hydrogen, or the like be not contained in nitrogen or a rare gas such as helium, neon, or argon. It is preferable that the purity of nitrogen or the rare gas such as helium, neon, or argon which is introduced into a heat treatment apparatus be set to be 6N (99.9999%) or higher, preferably 7N (99.99999%) or higher (that is, the impurity concentration is 1 ppm or lower, preferably 0.1 ppm or lower).

Through the above-described process, the concentration of hydrogen in the island-shaped oxide semiconductor film 704 can be reduced and the oxide semiconductor film 704 can be highly purified. Thus, the oxide semiconductor film can be stabilized. In addition, the heat treatment at a temperature of lower than or equal to the glass transition temperature makes it possible to form an oxide semiconductor film with a wide bandgap and a low carrier density due to hydrogen. Therefore, the transistor can be manufactured using a large substrate, so that the productivity can be increased. The above heat treatment can be performed at any time after the oxide semiconductor film is formed.

In the case where the oxide semiconductor film is heated, although depending on a material of the oxide semiconductor film or heating conditions, plate-shaped crystals are formed in the surface of the oxide semiconductor film in some cases. The plate-shaped crystal is preferably a single crystal which is c-axis-aligned in a direction substantially perpendicular to the surface of the oxide semiconductor film. Even if the plate-like crystals are not in a form of a single crystal body, each crystal is preferably a polycrystalline body which is c-axis-aligned in a direction substantially perpendicular to the surface of the oxide semiconductor film. In the above-described polycrystalline body, in addition to being c-axis-aligned, the crystals preferably have the same a-b plane, a-axis, or b-axis. Note that when a surface of the gate insulating film 703 in contact with the oxide semiconductor film is uneven, a plate-shaped crystal is a polycrystal. Therefore, the surface of the gate insulating film 703 is preferably as even as possible.

Figure 21C:
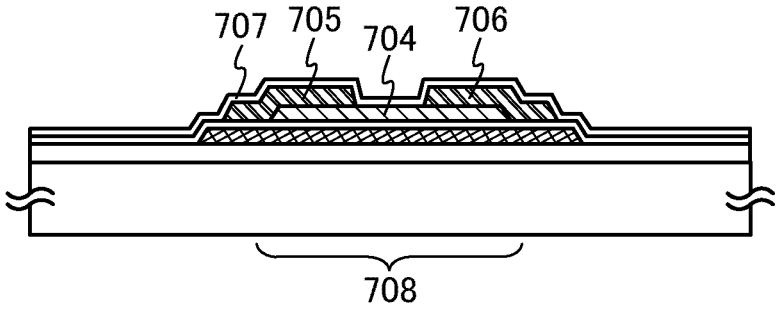

Next, as illustrated in FIG. 21C, the conductive film 705 and the conductive film 706 functioning as a source electrode and a drain electrode are formed, and an insulating film 707 is formed over the conductive film 705, the conductive film 706, and the island-shaped oxide semiconductor film 704.

The conductive film 705 and the conductive film 706 can be formed in the following manner: a conductive film is formed so as to cover the island-shaped oxide semiconductor film 704 by a sputtering method or a vacuum evaporation method, and then is patterned by etching or the like.

The conductive film 705 and the conductive film 706 are in contact with the island-shaped oxide semiconductor film 704. As materials of the conductive film for forming the conductive film 705 and the conductive film 706, any of the following materials can be used: an element selected from aluminum, chromium, copper, tantalum, titanium, molybdenum, or tungsten; an alloy including any of these elements; an alloy film including the above elements in combination; or the like. A structure may be employed in which a film of a refractory metal such as chromium, tantalum, titanium, molybdenum, or tungsten is stacked over or below a metal film of aluminum or copper. Aluminum or copper is preferably combined with a refractory metal material in order to avoid a heat resistance problem and a corrosion problem. As the refractory metal material, molybdenum, titanium, chromium, tantalum, tungsten, neodymium, scandium, yttrium, or the like can be used.

Further, the conductive film may have a single-layer structure or a stacked-layer structure of two or more layers. For example, a single-layer structure of an aluminum film containing silicon; a two-layer structure in which a titanium film is stacked over an aluminum film; a three-layer structure in which a titanium film, an aluminum film, and a titanium film are stacked in this order; and the like can be given.

For the conductive film included in the conductive film 705 and the conductive film 706, a conductive metal oxide may be used. As the conductive metal oxide, indium oxide, tin oxide, zinc oxide, an alloy of indium oxide and tin oxide, an alloy of indium oxide and zinc oxide, or the metal oxide material containing silicon or silicon oxide can be used.

In the case where heat treatment is performed after formation of the conductive film, the conductive film preferably has heat resistance enough to withstand the heat treatment.

Note that the material and etching conditions are adjusted as appropriate so that the island-shaped oxide semiconductor film 704 is not removed as much as possible in the etching of the conductive film. Depending on the etching conditions, there are some cases in which an exposed portion of the island-shaped oxide semiconductor film 704 is partly etched and thereby a groove (a depression portion) is formed.

In this embodiment, a titanium film is used for the conductive film. Therefore, wet etching can be selectively performed on the conductive film using a solution (an ammonia hydrogen peroxide mixture) containing ammonia and hydrogen peroxide water. Specifically, an aqueous solution in which hydrogen peroxide water at 31 weight %, ammonium hydroxide at 28 weight %, and pure water are mixed at a volume ratio of 5:2:2 is used. Alternatively, dry etching may be performed on the conductive film with the use of a gas containing chlorine ($Cl_2$), boron chloride ($BCl_3$), or the like.

In order to reduce the number of photomasks and steps in a photolithography step, etching may be performed with the use of a resist mask formed using a multi-tone mask through which light is transmitted so as to have a plurality of intensities. A resist mask formed with the use of a multi-tone mask has a plurality of thicknesses and further can be changed in shape by etching; therefore, the resist mask can be used in a plurality of etching steps for processing into different patterns. Therefore, a resist mask corresponding to at least two kinds or more of different patterns can be formed by one multi-tone mask. Thus, the number of light-exposure masks can be reduced and the number of corresponding photolithography steps can be also reduced, whereby simplification of a manufacturing process can be realized.

Note that before formation of the insulating film 707, the island-shaped oxide semiconductor film 704 is subjected to plasma treatment with the use of a gas such as $N_2O$, $N_2$, or Ar. By the plasma treatment, adsorbed water or the like attached to an exposed surface of the island-shaped oxide semiconductor film 704 is removed. Plasma treatment may be performed using a mixture gas of oxygen and argon as well.

The insulating film 707 does not preferably contain an impurity such as moisture or hydrogen as much as possible. An insulating film of a single layer or a plurality of insulating films stacked may be employed for the insulating film 707. Hydrogen contained in the insulating film 707 enters the oxide semiconductor film or extract oxygen in the oxide semiconductor film, whereby the resistance of a back channel portion of the island-shaped oxide semiconductor film 704 is decreased (n-type conductivity); thus, a parasitic channel might be formed. Therefore, it is important that a film formation method in which hydrogen is not used be employed so that the insulating film 707 does not contain hydrogen as much as possible. A material having a high barrier property is preferably used for the insulating film 707. For example, a silicon nitride film, a silicon nitride oxide film, an aluminum nitride film, an aluminum nitride oxide film, or the like can be used as the insulating film having a high barrier property. In the case of using a plurality of stacked insulating films, an insulating film whose proportion of nitrogen is low, such as a silicon oxide film or a silicon oxynitride film, is formed at a closer position to the island-shaped oxide semiconductor film 704 than the insulating film having a high barrier property. Then, the insulating film having a high barrier property is formed to overlap the conductive film 705, the conductive film 706, and the island-shaped oxide semiconductor film 704 with the insulating film whose proportion of nitrogen is low is interposed therebetween. With the use of the insulating film having a high barrier property, an impurity such as moisture or hydrogen can be prevented from entering the island-shaped oxide semiconductor film 704, the gate insulating film 703, or the interface between the island-shaped oxide semiconductor film 704 and another insulating film and the vicinity thereof. Further, by providing the insulating film whose proportion of nitrogen is low, such as a silicon oxide film or a silicon oxynitride film so as to be in contact with the island-shaped oxide semiconductor film 704, the insulating film having a high barrier property can be prevented from being directly in contact with the island-shaped oxide semiconductor film 704.

In this embodiment, the insulating film 707 has a structure in which a silicon nitride film having a thickness of 100 nm formed by a sputtering method is stacked over a silicon nitride film having a thickness of 200 nm formed by a sputtering method. The substrate temperature in film formation may be set to higher than or equal to room temperature and lower than or equal to 300° C.: in this embodiment, 100° C.

After the insulating film 707 is formed, heat treatment may be performed. The heat treatment is performed under an atmosphere of nitrogen, ultra-dry air, or a rare gas (argon, helium, or the like) preferably at a temperature of higher than or equal to 200° C. and lower than or equal to 400° C., for example, higher than or equal to 250° C. and lower than or equal to 350° C. It is desirable that the content of water in the gas be 20 ppm or less, preferably 1 ppm or less, and further preferably 10 ppb or less. In this embodiment, for example, heat treatment at 250° C. under a nitrogen atmosphere for 1 hour is performed. Alternatively, RTA treatment for a short time at a high temperature may be performed before the formation of the conductive film 705 and the conductive film 706 in a manner similar to that of the previous heat treatment performed on the oxide semiconductor film for reduction of moisture or hydrogen. Even when oxygen deficiency is generated in the island-shaped oxide semiconductor film 704 by the previous heat treatment, by performing heat treatment after the insulating film 707 containing oxygen is provided, oxygen is supplied to the island-shaped oxide semiconductor film 704 from the insulating film 707. By the oxygen donation to the island-shaped oxide semiconductor film 704, oxygen deficiency that serves as a donor is reduced in the island-shaped oxide semiconductor film 704 and the stoichiometric composition can be satisfied. The island-shaped semiconductor film 704 preferably contains oxygen whose composition rate exceeds the stoichiometric composition rate. As a result, the island-shaped oxide semiconductor film 704 can be made to be substantially i-type and variation in electric characteristics of the transistor due to oxygen deficiency can be reduced; thus, electric characteristics can be improved. The timing of this heat treatment is not particularly limited as long as it is after the formation of the insulating film 707. When this heat treatment doubles as another step such as heat treatment for formation of a resin film or heat treatment for reduction of the resistance of a light-transmitting conductive film, the island-shaped oxide semiconductor film 704 can be made to be substantially i-type without increasing the number of manufacturing steps.

Moreover, the oxygen deficiency that serves as a donor in the island-shaped oxide semiconductor film 704 may be reduced by subjecting the island-shaped oxide semiconductor film 704 to heat treatment in an oxygen atmosphere so that oxygen is added to the oxide semiconductor. The heat treatment is performed at a temperature of, for example, higher than or equal to 100° C. and lower than 350° C., preferably higher than or equal to 150° C. and lower than 250° C. It is preferable that an oxygen gas used for the heat treatment under an oxygen atmosphere do not contain water, hydrogen, or the like. Alternatively, the purity of the oxygen gas which is introduced into the heat treatment apparatus is preferably greater than or equal to 6N (99.9999%) or more preferably greater than or equal to 7N (99.99999%) (that is, the impurity concentration in the oxygen is less than or equal to 1 ppm, or preferably less than or equal to 0.1 ppm).

Alternatively, oxygen may be added to the island-shaped oxide semiconductor film 704 by an ion implantation method or an ion doping method to reduce oxygen deficiency serving as a donor. For example, oxygen which is made into a plasma state by a microwave at 2.45 GHz may be added to the island-shaped oxide semiconductor film 704.

A back gate electrode may be formed so as to overlap with the island-shaped oxide semiconductor film 704 by forming a conductive film over the insulating film 707 and then patterning the conductive film. In the case where the back gate electrode is formed, an insulating film is preferably formed so as to cover the back gate electrode. The back gate electrode can be formed using a material and a structure similar to those of the gate electrode 702 or the conductive films 705 and 706.

The thickness of the back gate electrode is 10 nm to 400 nm, preferably 100 nm to 200 nm. For example, the back gate electrode may be formed in a such a manner that a conductive film in which a titanium film, an aluminum film, and a titanium film are stacked is formed, a resist mask is formed by a photolithography method or the like, and an unnecessary portion of the conductive film is removed by etching so that the conductive film is processed (patterned) into a desired shape.

Through the above-described process, the transistor 708 is formed.

The transistor 708 includes the gate electrode 702, the gate insulating film 703 over the gate electrode 702, the island-shaped oxide semiconductor film 704 which is over the gate insulating film 703 and overlaps with the gate electrode 702, and the pair of the conductive film 705 and the conductive film 706 formed over the island-shaped oxide semiconductor film 704. Further, the transistor 708 may include the insulating film 707 as its constituent. The transistor 708 illustrated in FIG. 21C has a channel-etched structure in which part of the island-shaped oxide semiconductor film 704 between the conductive film 705 and the conductive film 706 is etched.

Although the transistor 708 is described as a single-gate transistor, a multi-gate transistor including a plurality of channel formation regions can be manufactured as well, in which case a plurality of gate electrodes 702 electrically connected to each other is included.

This embodiment can be combined as appropriate with any of the above-described embodiments.

(Embodiment 4)

In Embodiment 4, structural examples of a transistor will be described. Note that the same portions as those in the above embodiments, portions having functions similar to those in the above embodiments, the same steps as those in the above embodiments, and steps similar to those in the above embodiments may be described as in the above embodiments, and repeated description thereof is omitted in this embodiment. Further, a specific description for the same portions is omitted.

Figure 22A:
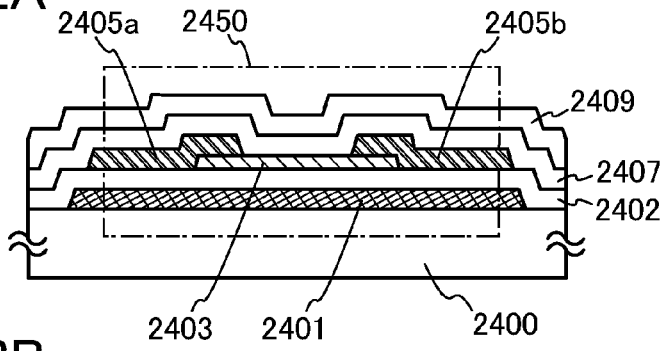
FIGS. 22A to 22D are cross-sectional views of transistors.

A transistor 2450 illustrated in FIG. 22A includes a gate electrode 2401 over a substrate 2400, a gate insulating film 2402 over the gate electrode 2401, an oxide semiconductor film 2403 over the gate insulating film 2402, and a source electrode 2405*a* and a drain electrode 2405*b* over the oxide semiconductor film 2403. An insulating film 2407 is formed over the oxide semiconductor film 2403, the source electrode 2405*a*, and the drain electrode 2405*b*. A protective insulating film 2409 may be formed over the insulating film 2407. The transistor 2450 is a bottom-gate transistor and is also an inverted staggered transistor.

Figure 22B:
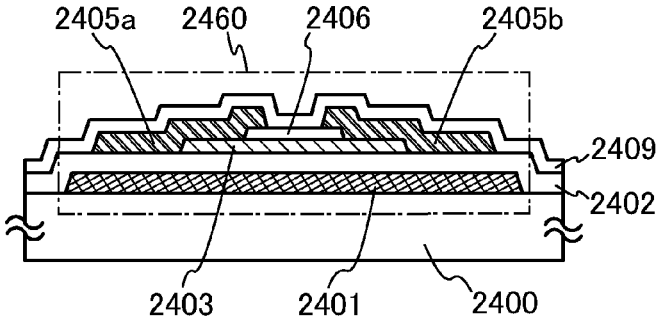

A transistor 2460 illustrated in FIG. 22B includes a gate electrode 2401 over the substrate 2400, the gate insulating film 2402 over the gate electrode 2401, the oxide semiconductor film 2403 over the gate insulating film 2402, a channel protective layer 2406 over the oxide semiconductor film 2403, and the source electrode 2405*a* and the drain electrode 2405*b* over the channel protective layer 2406 and the oxide semiconductor film 2403. The protective insulating film 2409 may be formed over the source electrode 2405*a* and the drain electrode 2405*b*. The transistor 2460 is a bottom-gate transistor called a channel-protective type (also referred to as a channel-stop type) transistor and is also an inverted staggered transistor. The channel protective layer 2406 can be formed using a material and a method similar to those of any other insulating film.

Figure 22C:
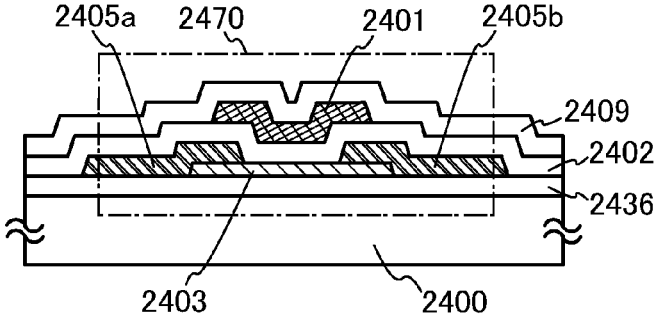

A transistor 2470 illustrated in FIG. 22C includes a base film 2436 over the substrate 2400, the oxide semiconductor film 2403 over the base film 2436, the source electrode 2405*a* and the drain electrode 2405*b* over the oxide semiconductor film 2403 and the base film 2436, the gate insulating film 2402 over the oxide semiconductor film 2403, the source electrode 2405*a*, and the drain electrode 2405*b*, and the gate electrode 2401 over the gate insulating film 2402. The protective insulating film 2409 may be formed over the gate electrode 2401. The transistor 2470 is a top-gate transistor.

Figure 22D:
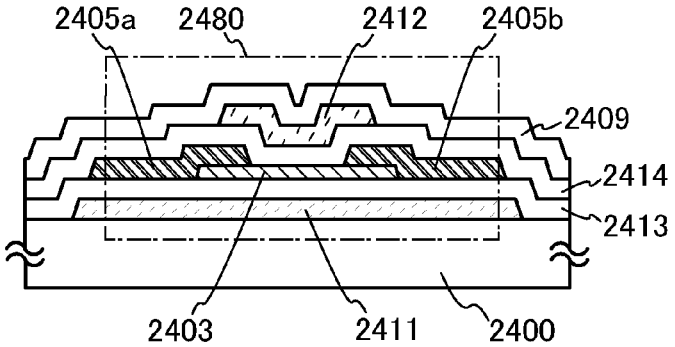

A transistor 2480 illustrated in FIG. 22D includes a first gate electrode 2411 over the substrate 2400, a first gate insulating film 2413 over the first gate electrode 2411, the oxide semiconductor film 2403 over the first gate insulating film 2413, and the source electrode 2405*a* and the drain electrode 2405*b* over the oxide semiconductor film 2403 and the first gate insulating film 2413. A second gate insulating film 2414 is formed over the oxide semiconductor film 2403, the source electrode 2405*a*, and the drain electrode 2405*b*, and a second gate electrode 2412 is formed over the second gate insulating film 2414. The protective insulating film 2409 may be formed over the second gate electrode 2412.

The transistor 2480 has a structure combining the transistor 2450 and the transistor 2470. The first gate electrode 2411 and the second gate electrode 2412 can be electrically connected to each other, so that they function as one gate electrode. Either the first gate electrode 2411 or the second gate electrode 2412 may be simply referred to as a gate electrode and the other may be referred to as a back gate electrode.

By changing the potential of the back gate electrode, the threshold voltage of the transistor can be changed. The back gate electrode is formed so as to overlap with a channel formation region in the oxide semiconductor film 2403. Further, the back gate electrode may be electrically insulated, i.e., in a floating state, or may be in a state where the back gate electrode is supplied with a potential. In the latter case, the back gate electrode may be supplied with a potential at the same level as that of the gate electrode, or may be supplied with a fixed potential such as a ground potential. The level of the potential applied to the back gate electrode is controlled, so that the threshold voltage of the transistor 2480 can be controlled.

The oxide semiconductor film 2403 is covered with the back gate electrode, whereby light from the back gate electrode side can be prevented from entering the oxide semiconductor film 2403. Therefore, photodegradation of the oxide semiconductor film 2403 can be prevented and deterioration in characteristics of the transistor, such as a shift of the threshold voltage, can be prevented.

An insulating film in contact with the oxide semiconductor film 2403 (in this embodiment, corresponding to each of the gate insulating film 2402, the insulating film 2407, the channel protective layer 2406, the base film 2436, the first gate insulating film 2413, and the second gate insulating film 2414) is preferably formed using an insulating material containing a Group 13 element and oxygen. Many oxide semiconductor materials contain a Group 13 element, and an insulating material containing a Group 13 element works well with an oxide semiconductor. By using such an insulating material containing a Group 13 element for the insulating film in contact with the oxide semiconductor film, an interface with the oxide semiconductor film can keep a favorable state.

The insulating material containing a Group 13 element means an insulating material containing one or more Group 13 elements. As the insulating material containing a Group 13 element, gallium oxide, aluminum oxide, aluminum gallium oxide, and gallium aluminum oxide can be given, for example. Here, the amount of aluminum is larger than that of gallium in atomic percent in aluminum gallium oxide, whereas the amount of gallium is larger than that of aluminum in atomic percent in gallium aluminum oxide.

For example, in the case of forming an insulating film in contact with an oxide semiconductor film containing gallium, a material containing gallium oxide may be used for the insulating film, so that favorable characteristics can be kept at the interface between the oxide semiconductor film and the insulating film. For example, by the oxide semiconductor film and the insulating film containing gallium oxide being provided in contact with each other, pileup of hydrogen at the interface between the oxide semiconductor film and the insulating film can be reduced. Note that a similar effect can be obtained in the case where an element in the same group as a constituent element of the oxide semiconductor film is used in an insulating film. For example, it is effective to form an insulating film with the use of a material containing aluminum oxide. Since aluminum oxide has a property of not easily transmitting water, it is preferable to use a material containing aluminum oxide in terms of preventing entry of water to the oxide semiconductor film.

The insulating film in contact with the oxide semiconductor film 2403 preferably contains oxygen in a proportion higher than that in the stoichiometric composition, by heat treatment in an oxygen atmosphere or oxygen doping. Oxygen doping means addition of oxygen into a bulk. The term "bulk" is used in order to clarify that oxygen is added not only to a surface of a thin film but also to the inside of the thin film. In addition, oxygen doping includes in its category oxygen plasma doping in which oxygen which is made to be plasma is added to a bulk. The oxygen doping may be performed using an ion implantation method or an ion doping method.

For example, in the case where the insulating film in contact with the oxide semiconductor film 2403 is formed of gallium oxide, the composition of gallium oxide can be set to be $Ga_2O_x$ ($x=3+\alpha$, $0<\alpha<1$) by heat treatment in an oxygen atmosphere or oxygen doping.

In the case where the insulating film in contact with the oxide semiconductor film 2403 is formed of aluminum oxide, the composition of aluminum oxide can be set to be $Al_2O_x$ ($x=3+\alpha$, $0<\alpha<1$) by heat treatment in an oxygen atmosphere or oxygen doping.

In the case where the insulating film in contact with the oxide semiconductor film 2403 is formed of gallium aluminum oxide (or aluminum gallium oxide), the composition of gallium aluminum oxide (or aluminum gallium oxide) can be set to be $Ga_xAl_{2-x}O_{3+\alpha}$($0<x<2$, $0<\alpha<1$) by heat treatment in an oxygen atmosphere or oxygen doping.

By oxygen doping, an insulating film including a region where the proportion of oxygen is higher than that in the stoichiometric composition can be formed. When the insulating film including such a region is in contact with the oxide semiconductor film, oxygen that exists excessively in the insulating film is supplied to the oxide semiconductor film, and oxygen deficiency in the oxide semiconductor film or at an interface between the oxide semiconductor film and the insulating film is reduced. Thus, the oxide semiconductor film can be formed to an i-type or substantially i-type oxide semiconductor.

The insulating film including a region where the proportion of oxygen is higher than that in the stoichiometric composition may be applied to either the insulating film placed on the upper side of the oxide semiconductor film or the insulating film placed on the lower side of the oxide semiconductor film of the insulating films in contact with the oxide semiconductor film 2403; however, it is preferable to apply such an insulating film to both of the insulating films in contact with the oxide semiconductor film 2403. The above-described effect can be enhanced with a structure where the oxide semiconductor film 2403 is sandwiched between the insulating films each including a region where the proportion of oxygen is higher than that in the stoichiometric composition, which are used as the insulating films in contact with the oxide semiconductor film 2403 and placed on the upper side and the lower side of the oxide semiconductor film 2403.

The insulating films on the upper side and the lower side of the oxide semiconductor film 2403 may contain the same constituent element or different constituent elements. For example, the insulating films on the upper side and the lower side may be both formed using gallium oxide whose composition is $Ga_2O_x$($x=3+\alpha$, $0<\alpha<1$). Alternatively, one of the insulating films on the upper side and the lower side may be formed using gallium oxide whose composition is $Ga_2O_x$ ($x=3+\alpha$, $0<\alpha<1$) and the other may be formed using aluminum oxide whose composition is $Al_2O_x$ ($x=3+\alpha$, $0<\alpha<1$).

The insulating film in contact with the oxide semiconductor film 2403 may be formed by stacking insulating films each including a region where the proportion of oxygen is higher than that in the stoichiometric composition. For example, the insulating film on the upper side of the oxide semiconductor film 2403 may be formed as follows: gallium oxide whose composition is $Ga_2O_x$ ($x=3+\alpha$, $0<\alpha<1$) is formed and gallium aluminum oxide (aluminum gallium oxide) whose composition is $Ga_xAl_{2-x}O_{3+\alpha}$($0<x<2$, $0<\alpha<1$) may be formed thereover. Note that the insulating film on the lower side of the oxide semiconductor film 2403 may be formed by stacking insulating films each including a region where the proportion of oxygen is higher than that in the stoichiometric composition. Further, both of the insulating films on the upper side and the lower side of the oxide semiconductor film 2403 may be formed by stacking insulating films each including a region where the proportion of oxygen is higher than that in the stoichiometric composition.

This embodiment can be combined as appropriate with any of the above-described embodiments.

(Embodiment 5)

In Embodiment 5, an embodiment of a substrate used in a liquid crystal display device according to one embodiment of the present invention will be described with reference to FIGS. 23A, 23B, 23C, 23C', 23D, 23D', 23E, 23E', 24A, 24B, and 24C.

Figure 23A:
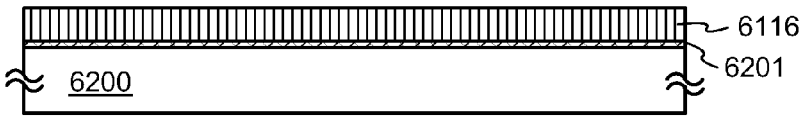
FIGS. 23A, 23B, 23C, 23C', 23D, 23D', 23E, and 23E' are cross-sectional views illustrating methods for manufacturing liquid crystal display devices.

A layer 6116 to be separated is formed over a substrate 6200 with a separation layer 6201 provided therebetween (see FIG. 23A).

A quartz substrate, a sapphire substrate, a ceramic substrate, a glass substrate, a metal substrate, or the like can be used as the substrate 6200. Note that such a substrate which is thick enough not to be definitely flexible enables precise formation of an element such as a transistor. The degree "not to be definitely flexible" means that the elastic modulus of the substrate is higher than or equivalent to that of a glass substrate used in generally fabricating a liquid crystal display.

The separation layer 6201 is formed with a single layer or stacked layers using any of elements selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), iridium (Ir), and silicon (Si), an alloy material containing any of the above elements as its main component, and a compound material containing any of the above elements as its main component by a sputtering method, a plasma CVD method, an application method, a printing method, or the like.

In the case where the separation layer 6201 has a single-layer structure, a tungsten layer, a molybdenum layer, or a layer containing a mixture of tungsten and molybdenum is preferably formed. Alternatively, a layer containing an oxide or an oxynitride of tungsten, a layer containing an oxide or an oxynitride of molybdenum, or a layer containing an oxide or an oxynitride of a mixture of tungsten and molybdenum is formed. The mixture of tungsten and molybdenum corresponds to an alloy of tungsten and molybdenum, for example.

In the case where the separation layer 6201 has a stacked-layer structure, it is preferable that a metal layer and a metal oxide layer be formed as the first layer and the second layer, respectively. Typically, it is preferable to form a tungsten layer, a molybdenum layer, or a layer containing a mixture of tungsten and molybdenum as the first layer and to form an oxide, a nitride, an oxynitride, or a nitride oxide of tungsten, molybdenum, or a mixture of tungsten and molybdenum as the second layer. As formation of the metal oxide layer as the second layer, an oxide layer (such as a silicon oxide layer which can be utilized as an insulating layer) may be formed over the metal layer which is the first layer so that an oxide of the metal is formed on a surface of the metal layer.

The layer 6116 to be separated includes components necessary for an element substrate, such as a transistor, an inter-layer insulating film, a wiring, and a pixel electrode, and a counter electrode, a light-blocking film, an alignment film, and the like as needed. Such components can be normally formed over the separation layer 6201. Materials, manufacturing methods, and structures of these components are similar to those described in any of the above embodiments, and repeated description thereof is omitted in this embodiment. Thus, the transistor and the electrode can be precisely formed using a known material and a known method.

Figure 23B:
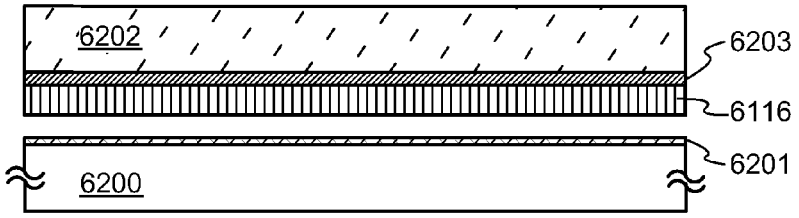

Next, the layer 6116 to be separated is bonded to a temporary supporting substrate 6202 with the use of an adhesive 6203 for separation and then, the layer 6116 to be separated is separated from the separation layer 6201 over the substrate 6200 to be transferred (see FIG. 23B). In this manner, the layer 6116 to be separated is placed on the temporary supporting substrate side. Note that in this specification, a process for transferring the layer to be separated from the substrate to the temporary supporting substrate is referred to as a transfer process.

As the temporary supporting substrate 6202, a glass substrate, a quartz substrate, a sapphire substrate, a ceramic substrate, a metal substrate, or the like can be used. Alternatively, a plastic substrate which can withstand the temperature of the following process may be used.

As the adhesive 6203 for separation which is used here, an adhesive which is soluble in water or a solvent, an adhesive which is capable of being plasticized upon irradiation of UV light, or the like is used so that the temporary supporting substrate 6202 and the layer 6116 to be separated can be separated when necessary.

Any of various methods can be used as appropriate in the process for transferring the layer 6116 to be separated to the temporary supporting substrate 6202. For example, when a film including a metal oxide film is formed as the separation layer 6201 so as to be in contact with the layer 6116 to be separated, the metal oxide film is embrittled by crystallization, whereby the layer 6116 to be separated can be separated from the substrate 6200. When an amorphous silicon film containing hydrogen is formed as the separation layer 6201 between the substrate 6200 and the layer 6116 to be separated, the amorphous silicon film containing hydrogen is removed by laser light irradiation or etching, so that the layer 6116 to be separated can be separated from the substrate 6200. In the case where a film containing nitrogen, oxygen, hydrogen, or the like (for example, an amorphous silicon film containing hydrogen, an alloy film containing hydrogen, an alloy film containing oxygen, or the like) is used as the separation layer 6201, the separation layer 6201 can be irradiated with laser light to release the nitrogen, oxygen, or hydrogen contained in the separation layer 6201 as a gas, so that separation between the layer 6116 to be separated and the substrate 6200 can be promoted. Alternatively, a liquid may be made to penetrate the interface between the separation layer 6201 and the layer 6116 to be separated to cause separation of the layer 6116 to be separated from the substrate 6200. Still alternatively, when the separation layer 6201 is formed using tungsten, the separation may be performed while the separation layer 6201 is etched with the use of a mixed solution of ammonia water and a hydrogen peroxide solution.

Further, the transfer process can be facilitated by using plural kinds of separation methods described above in combination. That is, the separation can be performed with a physical force (by a machine or the like) after performing laser light irradiation on part of the separation layer, etching on part of the separation layer with a gas, a solution, or the like, or mechanical removal of part of the separation layer with a sharp knife, a scalpel, or the like, in order that the separation layer and the layer to be separated can be easily separated from each other. In the case where the separation layer 6201 is formed to have a layered structure of a metal and a metal oxide, the layer to be separated can be physically separated easily from the separation layer by using a groove formed by laser light irradiation or a scratch made by a sharp knife, a scalpel, or the like as a trigger.

Alternatively, the separation may be performed while a liquid such as water is poured.

As a method for separating the layer 6116 to be separated from the substrate 6200, a method may alternatively be employed in which the substrate 6200 over which the layer 6116 to be separated is formed is removed by mechanical polishing or by etching using a solution or a halogen fluoride gas such as $NF_3$, $BrF_3$, or $ClF_3$, or the like. In that case, the separation layer 6201 is not necessarily provided.

Figure 23C:
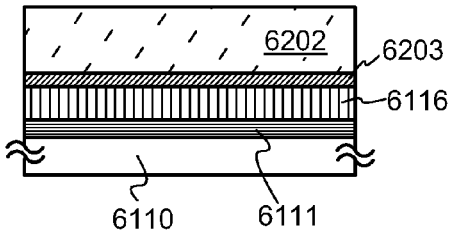
Figure 23C:
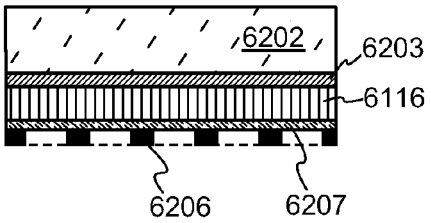

Next, a surface of the layer 6116 to be separated or the separation layer 6201 exposed by separation of the layer 6116 to be separated from the substrate 6200 is bonded to a transfer substrate 6110 with the use of a first adhesive layer 6111 including an adhesive different from the adhesive 6203 for separation (see FIG. 23C).

As a material of the first adhesive layer 6111, any of various curable adhesives, e.g., a light curable adhesive such as a UV curable adhesive, a reactive curable adhesive, a thermal curable adhesive, and an anaerobic adhesive, can be used.

As the transfer substrate 6110, any of various substrates with high toughness, such as an organic resin film and a metal substrate, can be favorably used. Substrates with high toughness have high impact resistance and thus are less likely to be damaged. In the case of using an organic resin film or a thin metal substrate, which are lightweight, the weight can be significantly lower than in the case of using a general glass substrate. With the use of such a substrate, it is possible to fabricate a lightweight liquid crystal display device which is not easily damaged.

Figure 23D:
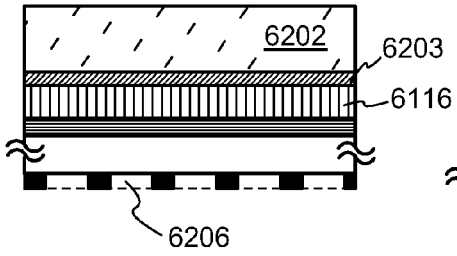
Figure 23D:
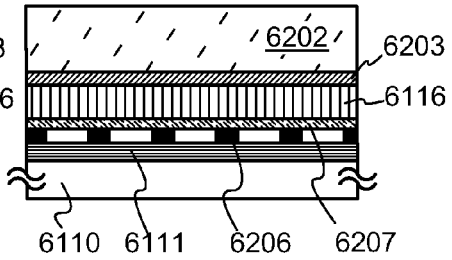

In the case of a transmissive or transflective liquid crystal display device, a substrate which has high toughness and transmits visible light may be used as the transfer substrate 6110. As a material of such a substrate, for example, polyester resins such as polyethylene terephthalate (PET) and polyethylene naphthalate (PEN), an acrylic resin, a polyacrylonitrile resin, a polyimide resin, a polymethyl methacrylate resin, a polycarbonate (PC) resin, a polyethersulfone (PES) resin, a polyamide resin, a cycloolefin resin, a polystyrene resin, a polyamide imide resin, and a polyvinylchloride resin can be given. A substrate made of such an organic resin has high toughness and thus has high impact resistance and is less likely to be damaged. Further, a film of such an organic resin, which is lightweight, enables significant reduction in weight of a display device unlike a general glass substrate. In that case, the transfer substrate 6110 is preferably further provided with a metal plate 6206 having an opening at least in a portion overlapping with a region where light of each pixel is transmitted. With the above structure, the transfer substrate 6110 which has high toughness and high impact resistance and is less likely to be damaged can be formed while a change in dimension is suppressed. Further, when the thickness of the metal plate 6206 is reduced, the transfer substrate 6110 which is lighter than a general glass substrate can be formed. With the use of such a substrate, it is possible to fabricate a lightweight liquid crystal display device which is not easily damaged (see FIG. 23D).

Figure 24A:
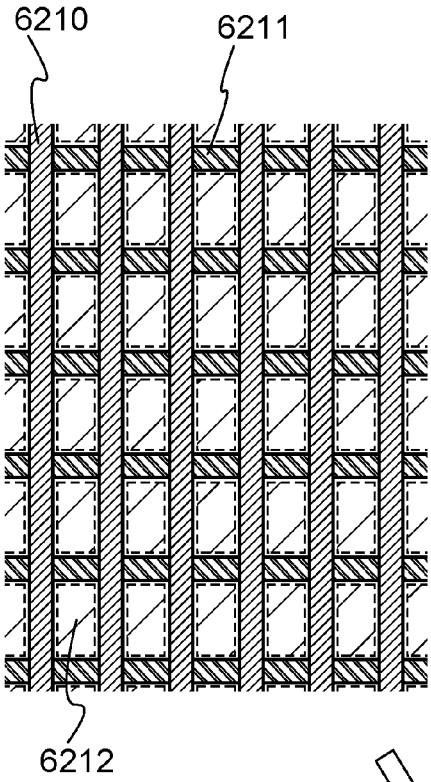
FIGS. 24A to 24C are top views of a liquid crystal display device.
Figure 24B:
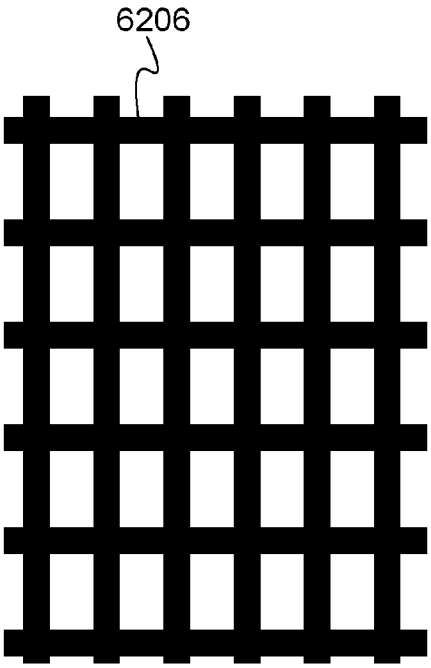
Figure 24C:
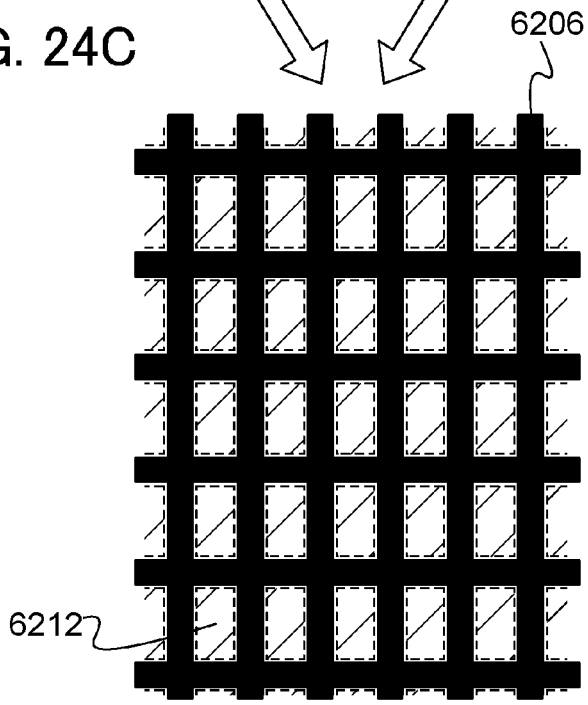

FIG. 24A is an example of a top view of a liquid crystal display device. In the case of a liquid crystal display device in which a first wiring layer 6210 and a second wiring layer 6211 intersect with each other, and a region surrounded by the first wiring layer 6210 and the second wiring layer 6211 is a light-transmitting region 6212 as illustrated in FIG. 24A, the metal plate 6206 having openings formed in a grid so as to leave a portion overlapping with the first wiring layer 6210 and/or the second wiring layer 6211 as in FIG. 24B may be used. Attachment of the metal plate 6206 as shown in FIG. 24C makes it possible to suppress a change in dimension due to unfavorable alignment or extension of a substrate owing to the use of a substrate made of an organic resin. When a polarizing plate (not shown) is necessary, it may be provided between the transfer substrate 6110 and the metal plate 6206 or outside the metal plate 6206. The polarizing plate may be attached to the metal plate 6206 in advance. In terms of weight reduction, a substrate which is thin but has dimension stability is preferably used as the metal plate 6206.

Figure 23E:
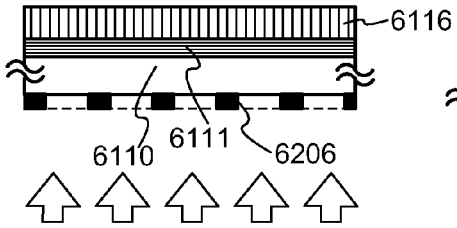
Figure 23E:
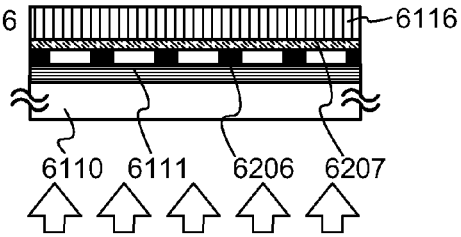

After that, the temporary supporting substrate 6202 is separated from the layer 6116 to be separated. Since the adhesive 6203 for separation includes a material capable of separating the temporary supporting substrate 6202 and the layer 6116 to be separated from each other when necessary, the temporary supporting substrate 6202 may be separated by a method suitable for the material. Note that light is emitted from the backlight as shown by arrows in the drawing (see FIG. 23E).

Thus, the layer 6116 to be separated, which includes elements such as the transistor and the pixel electrode (a counter electrode, a light-blocking film, an alignment film, or the like may also be provided as necessary), can be formed over the transfer substrate 6110, whereby a lightweight element substrate with high impact resistance can be formed. <Modification Example>

The liquid crystal display device having the above structure is one embodiment of the present invention, and the present invention also includes a liquid crystal display device having a structure different from that of the above liquid crystal display device. After the above transfer process (FIG. 23B), the metal plate 6206 may be attached to an exposed surface of the separation layer 6201 or the layer 6116 to be separated before attachment of the transfer substrate 6110 (see FIG. 23C'). In that case, a barrier layer 6207 is preferably provided between the metal plate 6206 and the layer 6116 to be separated so that a contaminant from the metal plate 6206 can be prevented from adversely affecting characteristics of the transistor in the layer 6116 to be separated. In the case of providing the barrier layer 6207, the barrier layer 6207 may be provided adjacent to the exposed surface of the separation layer 6201 or the layer 6116 to be separated before attachment of the metal plate 6206. The barrier layer 6207 may be formed using an inorganic material, an organic material, or the like; typically, a silicon nitride and the like can be used. A material of the barrier layer is not limited to the above as long as contamination of the transistor can be prevented. The barrier layer is formed using a light-transmitting material or formed to a thickness small enough to transmit light so that the barrier layer can transmit at least visible light. The metal plate 6206 may be bonded with the use of a second adhesive layer (not shown) including an adhesive different from the adhesive 6203 for separation.

After that, the first adhesive layer 6111 is formed adjacent to a surface of the metal plate 6206 and the transfer substrate 6110 is attached to the first adhesive layer 6111 (FIG. 23D') and the temporary supporting substrate 6202 is separated from the layer 6116 to be separated (FIG. 23E'), whereby a lightweight element substrate with high impact resistance can be formed. Note that light is emitted from the backlight as shown by arrows in the drawing.

The lightweight element substrate with high impact resistance formed as described above is firmly attached to a counter substrate with the use of a sealant with a liquid crystal layer provided between the substrates, whereby a lightweight liquid crystal display device with high impact resistance can be manufactured. As the counter substrate, a substrate which has high toughness and transmits visible light (similar to a plastic substrate which can be used as the transfer substrate 6110) can be used. Further, a polarizing plate, a light-blocking film, a counter electrode, or an alignment film may be provided as necessary. As a method for forming the liquid crystal layer, a dispenser method, an injection method, or the like can be employed as in a conventional case.

In the case of the lightweight liquid crystal display device with high impact resistance manufactured as described above, a fine element such as the transistor can be formed over a glass substrate or the like which has relatively high dimensional stability, and a conventional manufacturing method can be applied, so that even such a fine element can be formed precisely. Therefore, the lightweight liquid crystal display device with high impact resistance can display images with high precision and high quality.

Further, the liquid crystal display device manufactured as described above may be flexible.

This embodiment can be combined as appropriate with any of the above-described embodiments.

(Embodiment 6)

Figure 26A:
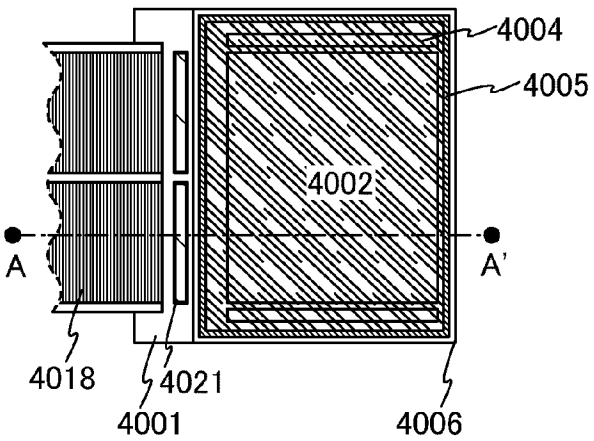
FIGS. 26A and 26B are a top view and a cross-sectional view of a liquid crystal display device.
Figure 26B:
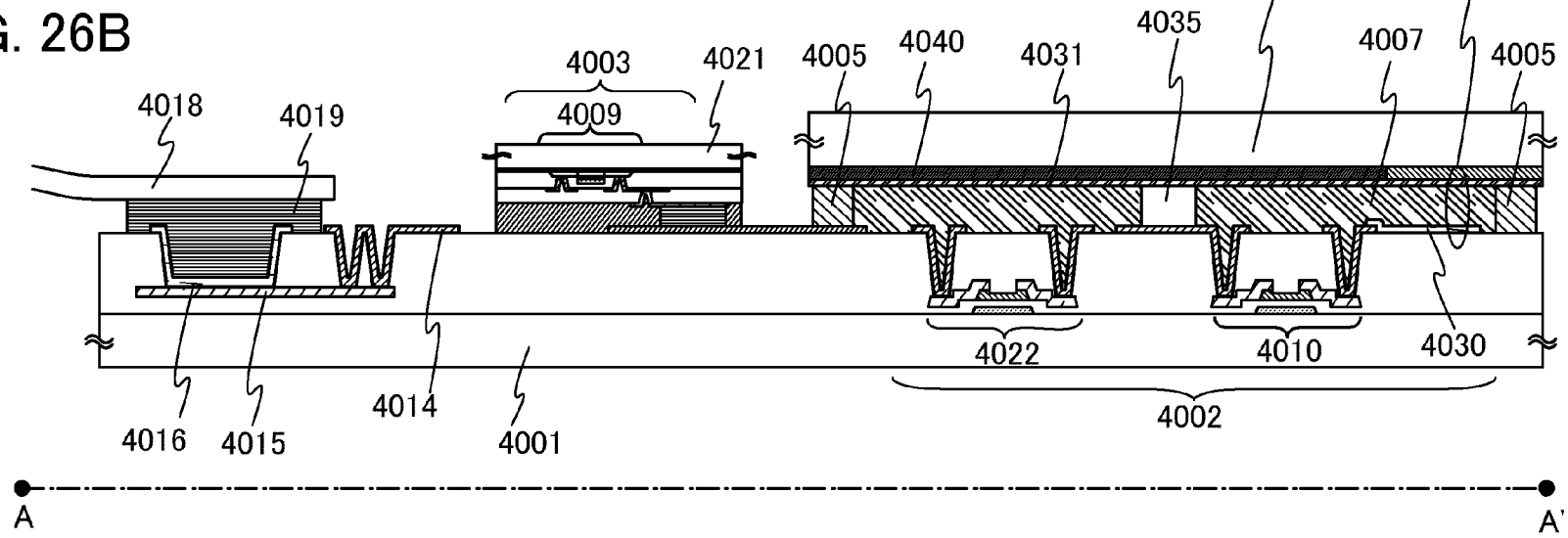

Next, a liquid crystal display device of one embodiment of the present invention will be described with reference to FIGS. 26A and 26B. FIG. 26A is a top view of a panel in which a substrate 4001 is attached to a counter substrate 4006 with a sealant 4005, and FIG. 26B is a cross-sectional view along dashed line A-A' in FIG. 26A.

The sealant 4005 is provided so as to surround a pixel portion 4002 and a scan line driver circuit 4004 provided over the substrate 4001. In addition, the counter substrate 4006 is provided over the pixel portion 4002 and the scan line driver circuit 4004. Thus, the pixel portion 4002 and the scan line driver circuit 4004 are sealed together with a liquid crystal 4007 by the substrate 4001, the sealant 4005, and the counter substrate 4006.

A substrate 4021 provided with a signal line driver circuit 4003 is mounted in a region which is different from the region surrounded by the sealant 4005 over the substrate 4001. In FIG. 26B, a transistor 4009 included in the signal line driver circuit 4003 is illustrated.

A plurality of transistors are included in the pixel portion 4002 and the scan line driver circuit 4004 which are provided over the substrate 4001. In FIG. 26B, transistors 4010 and 4022 which are included in the pixel portion 4002 are illustrated. Each of the transistor 4010 and the transistor 4022 includes an oxide semiconductor in a channel formation region. A light-blocking film 4040 provided for the counter substrate 4006 overlaps with the transistors 4010 and 4022.

By blocking light to the transistors 4010 and 4022, deterioration of the oxide semiconductor in each transistor due to light is prevented; thus, deterioration of characteristics of the transistors 4010 and 4022, such as a shift of the threshold voltage, can be prevented.

A pixel electrode 4030 included in a liquid crystal element 4011 is electrically connected to the transistor 4010. A counter electrode 4031 of the liquid crystal element 4011 is provided for the counter substrate 4006. A portion where the pixel electrode 4030, the counter electrode 4031, and the liquid crystal 4007 overlap with one another corresponds to the liquid crystal element 4011.

A spacer 4035 is provided to control a distance (cell gap) between the pixel electrode 4030 and the counter electrode 4031. FIG. 26B shows the case where the spacer 4035 is formed by patterning of an insulating film; alternatively, a spherical spacer may be used.

A variety of signals and potentials are supplied to the signal line driver circuit 4003, the scan line driver circuit 4004, and the pixel portion 4002 from a connection terminal 4016 through lead wirings 4014 and 4015. The connection terminal 4016 is electrically connected to a terminal of an FPC 4018 via an anisotropic conductive film 4019.

Note that any of the substrate 4001, the counter substrate 4006, and the substrate 4021 can be formed using glass, ceramics, or plastics. Plastics include in its category, a fiberglass-reinforced plastic (FRP) plate, a polyvinyl fluoride (PVF) film, a polyester film, an acrylic resin film, and the like. A sheet having a structure in which an aluminum foil is sandwiched between PVF films can be used as well.

Note that a substrate placed in a direction in which light is extracted through the liquid crystal element 4011 is formed using a light-transmitting material such as a glass plate, plastic, a polyester film, or an acrylic film.

Figure 27:
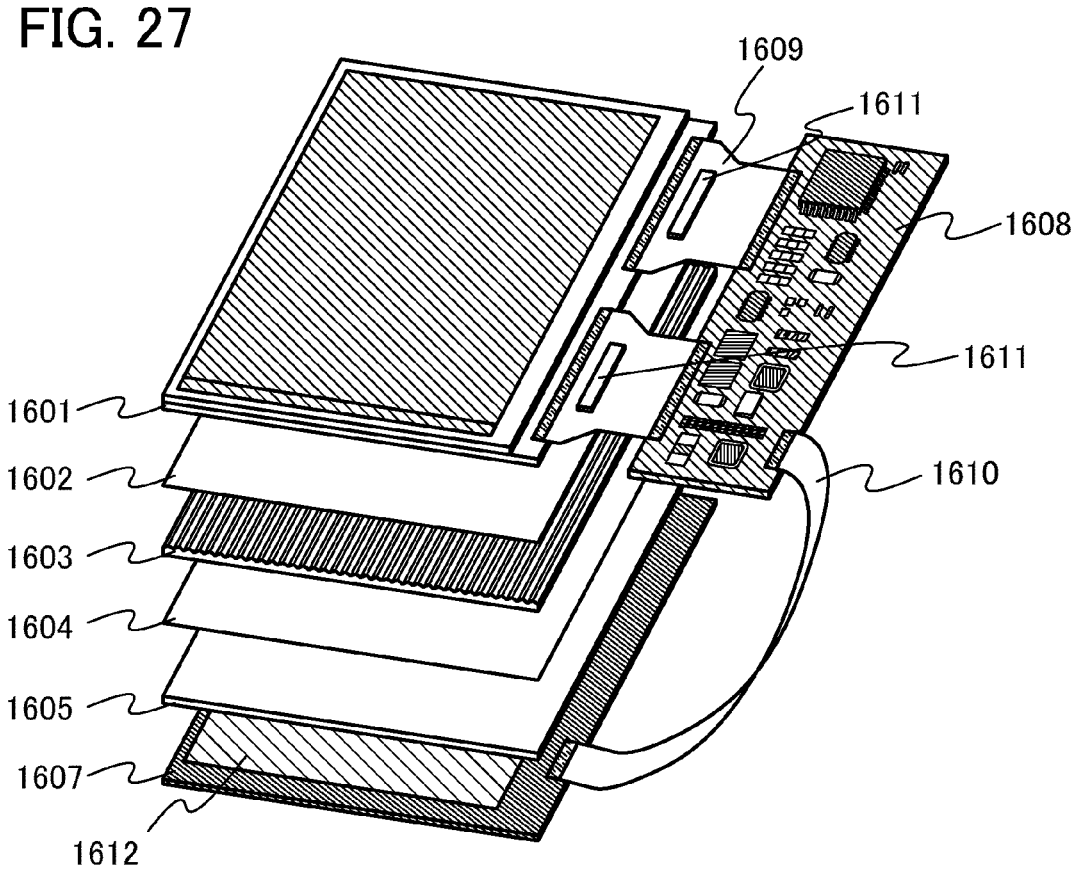
FIG. 27 is a perspective view illustrating a structure of a liquid crystal display device.

FIG. 27 is an example of a perspective view illustrating a structure of a liquid crystal display device of one embodiment of the present invention. The liquid crystal display device illustrated in FIG. 27 includes a panel 1601 including a pixel portion, a first diffusion plate 1602, a prism sheet 1603, a second diffusion plate 1604, a light guide plate 1605, a backlight panel 1607, a circuit board 1608, and a substrate 1611 provided with a signal line driver circuit.

The panel 1601, the first diffusion plate 1602, the prism sheet 1603, the second diffusion plate 1604, the light guide plate 1605, and the backlight panel 1607 are sequentially stacked. The backlight panel 1607 has a backlight 1612 including a plurality of light sources. Light from the backlight 1612 that is diffused in the light guide plate 1605 is delivered to the panel 1601 through the first diffusion plate 1602, the prism sheet 1603, and the second diffusion plate 1604.

Although the first diffusion plate 1602 and the second diffusion plate 1604 are used in this embodiment, the number of diffusion plates is not limited to two; the number of diffusion plates may be one, or may be three or more. The diffusion plate is provided between the light guide plate 1605 and the panel 1601. The diffusion plate may be provided only on the side closer to the panel 1601 than the prism sheet 1603, or may be provided only on the side closer to the light guide plate 1605 than the prism sheet 1603.

Further, the shape of the cross section of the prism sheet 1603 which is illustrated in FIG. 27 is not limited to a serrate shape; the cross section can have any shape with which light from the light guide plate 1605 can be gathered to the panel 1601 side.

The circuit board 1608 is provided with a circuit which generates various signals input to the panel 1601, a circuit which processes the signals, or the like. In FIG. 27, the circuit board 1608 is connected to the panel 1601 via a COF tape 1609. In addition, the substrate 1611 provided with the signal line driver circuit is connected to the COF tape 1609 by a chip on film (COF) method.

FIG. 27 illustrates an example in which the circuit board 1608 is provided with a control circuit which controls driving of the backlight 1612 and the control circuit is connected to the backlight panel 1607 via an FPC 1610. The control circuit may be formed over the panel 1601. In that case, the panel 1601 may be connected to the backlight panel 1607 via an FPC or the like.

This embodiment can be combined as appropriate with any of the above-described embodiments.

(Embodiment 7)

Figure 25A:
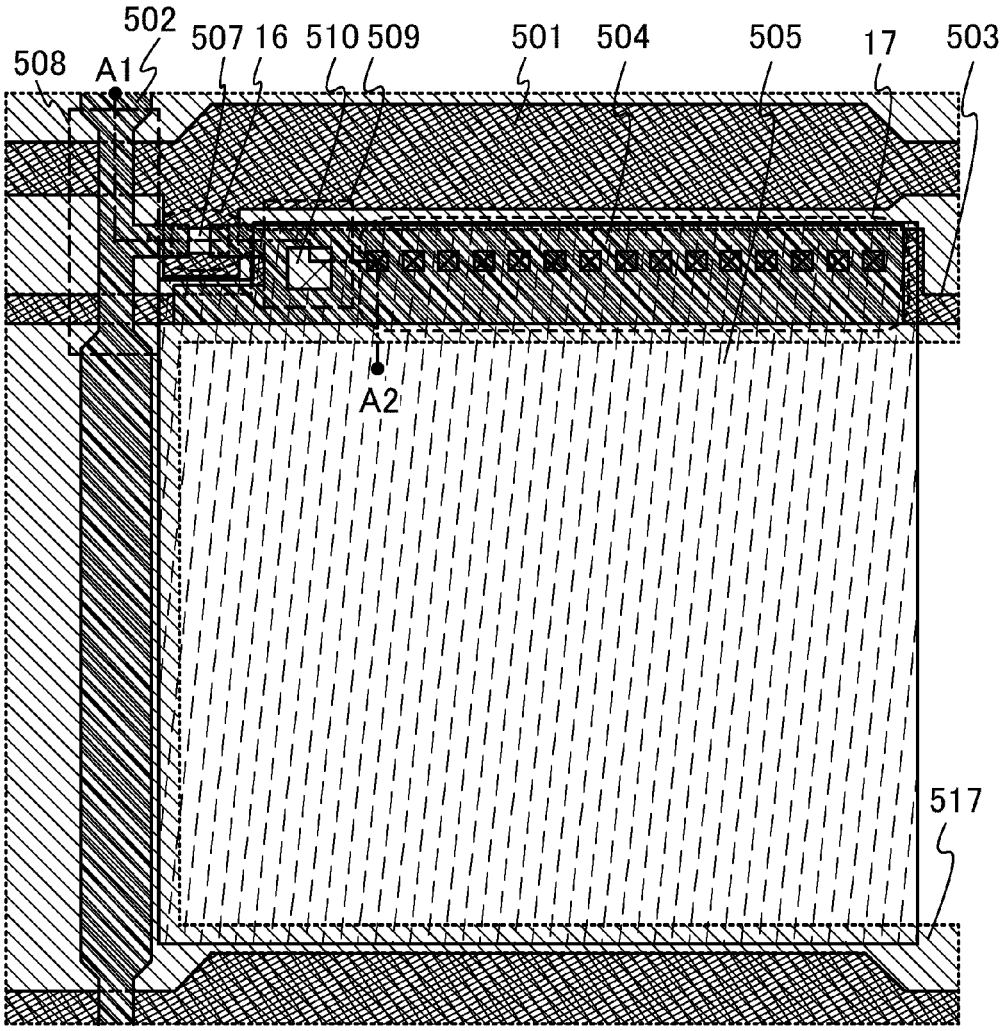
FIGS. 25A and 25B are a top view and a cross-sectional view of a pixel.

FIG. 25A illustrates an example of a top view of a pixel. A cross-sectional view along chain line A1-A2 in FIG. 25A is FIG. 25B.

Figure 25B:
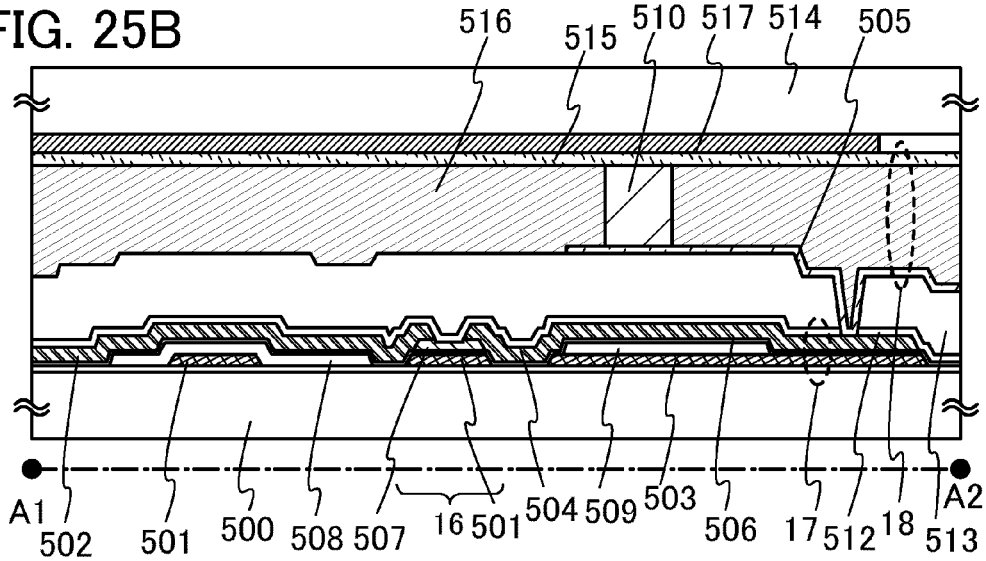

The pixel illustrated in FIGS. 25A and 25B includes a conductive film 501 functioning as a scan line GL, a conductive film 502 functioning as a signal line SL, a conductive film 503 functioning as a wiring COM, and a conductive film 504 functioning as a second terminal of a transistor 16. The conductive film 501 also functions as a gate electrode of the transistor 16 illustrated in FIG. 2B. In addition, the conductive film 502 also functions as a first terminal of the transistor 16.

The conductive film 501 and the conductive film 503 can be formed by processing one conductive film formed over a substrate 500 having an insulating surface into a desired shape. A gate insulating film 506 is formed over the conductive film 501 and the conductive film 503. Further, the conductive film 502 and the conductive film 504 can be formed by processing one conductive film formed over the gate insulating film 506 into a desired shape.

An active layer 507 of the transistor 16 is formed over the gate insulating film 506 so as to overlap with the conductive film 501. As illustrated in FIGS. 25A and 25B, the active layer 507 preferably completely overlaps with the conductive film 501 functioning as the gate electrode. With such a structure, an oxide semiconductor in the active layer 507 can be prevented from deteriorating owing to incident light from the substrate 500 side; thus, deterioration of characteristics of the transistor 16, such as a shift of the threshold voltage, can be prevented.

Further, in the pixel illustrated in FIGS. 25A and 25B, an insulating film 512 and an insulating film 513 are sequentially formed so as to cover the active layer 507, the conductive film 502, and the conductive film 504. In addition, a pixel electrode 505 is formed over the insulating film 513, and the conductive film 504 is connected to the pixel electrode 505 through a contact hole formed in the insulating film 512 and the insulating film 513.

A portion where the conductive film 503 functioning as the wiring COM overlaps with the conductive film 504 with the gate insulating film 506 provided therebetween functions as a capacitor.

In this embodiment, an insulating film 508 is formed between the conductive film 501 and the gate insulating film 506. The insulating film 508 is provided between the conductive film 501 and the conductive film 502; thus, parasitic capacitance generated between the conductive film 501 and the conductive film 502 can be suppressed to be lower by the insulating film 508.

In this embodiment, an insulating film 509 is formed between the conductive film 503 and the gate insulating film 506. In addition, a spacer 510 is formed over the pixel electrode 505 so as to overlap with the insulating film 509.

FIG. 25A is a top view of the pixel just after the step for forming the spacer 510. FIG. 25B illustrates the state where a substrate 514 is provided so as to face the substrate 500 with the state illustrated in FIG. 25A.

A counter electrode 515 is provided for the substrate 514, and a liquid crystal layer 516 containing a liquid crystal is provided between the pixel electrode 505 and the counter electrode 515. A liquid crystal element 18 is formed in a portion where the pixel electrode 505, the counter electrode 515, and the liquid crystal layer 516 overlap with one another.

The pixel electrode 505 and the counter electrode 515 can be formed using a light-transmitting conductive material such as indium tin oxide containing silicon oxide (ITSO), indium tin oxide (ITO), zinc oxide (ZnO), indium zinc oxide (IZO), or zinc oxide to which gallium is added (GZO), for example.

An alignment film may be provided as appropriate between the pixel electrode 505 and the liquid crystal layer 516 and/or between the counter electrode 515 and the liquid crystal layer 516. The alignment film can be formed using an organic resin such as polyimide or polyvinyl alcohol. Alignment treatment such as rubbing is performed on a surface of the alignment film in order to align liquid crystal molecules in a certain direction. Rubbing can be performed by rolling a roller wrapped with cloth of nylon or the like while being in contact with the alignment film such that the surface of the alignment film is rubbed in a certain direction. Note that it is also possible to form the alignment film having alignment characteristics with the use of an inorganic material such as silicon oxide by an evaporation method or the like, without alignment treatment.

A liquid crystal for forming the liquid crystal layer 516 may be injected by a dispenser method (dripping method) or a dipping method (pumping method).

Over the substrate 514, in order to prevent disclination due to disorder of the alignment of the liquid crystal between pixels from being perceived, or to prevent diffusing light from entering a plurality of adjacent pixels, a light-blocking film 517 capable of blocking light is provided. The light-blocking film 517 can be formed using an organic resin containing black colorant such as carbon black or titanium lower oxide whose oxidation number is smaller than the oxidation number of titanium dioxide. Alternatively, the light-blocking film 517 can be formed with a film formed using chromium.

By providing the light-blocking film 517 so as to overlap with the active layer 507 of the transistor 16, the oxide semiconductor in the active layer 507 can be prevented from deteriorating owing to incident light from the substrate 514 side; thus, deterioration of characteristics of the transistor 16, such as a shift of the threshold voltage, can be prevented.

Although the liquid crystal element 18 in which the liquid crystal layer 516 is provided between the pixel electrode 505 and the counter electrode 515 is illustrated in FIGS. 25A and 25B as an example, a structure of a liquid crystal display device of one embodiment of the present invention is not limited to this structure. A pair of electrodes may be formed over one substrate as in an IPS liquid crystal element or a liquid crystal element using a liquid crystal exhibiting a blue phase.

Note that in the case of forming a driver circuit over a substrate over which a panel is formed, also by disposing a gate electrode or a light-blocking film so as to block light to a transistor in the driver circuit, deterioration in characteristics of the transistor, such as a shift of the threshold voltage, can be prevented.

Figure 32A:
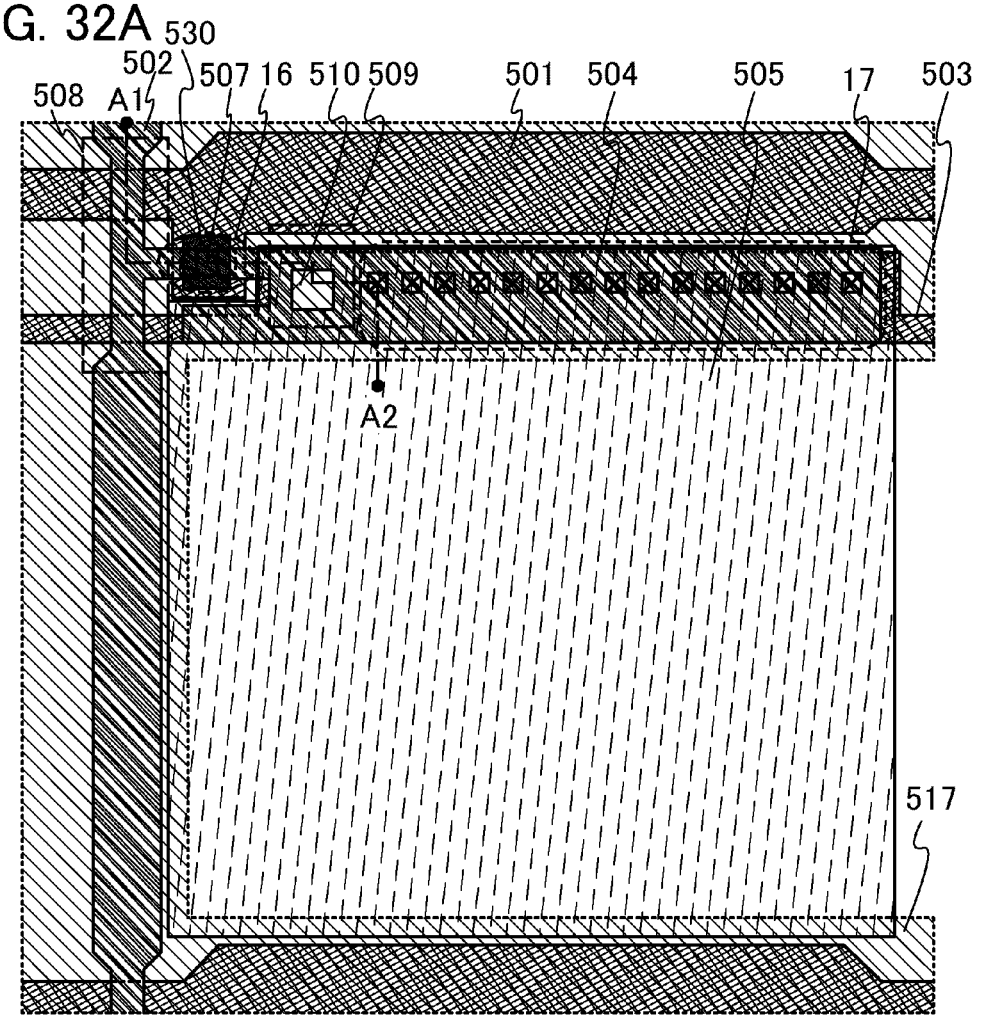
FIGS. 32A and 32B are a top view and a cross-sectional view of a pixel.
Figure 32B:
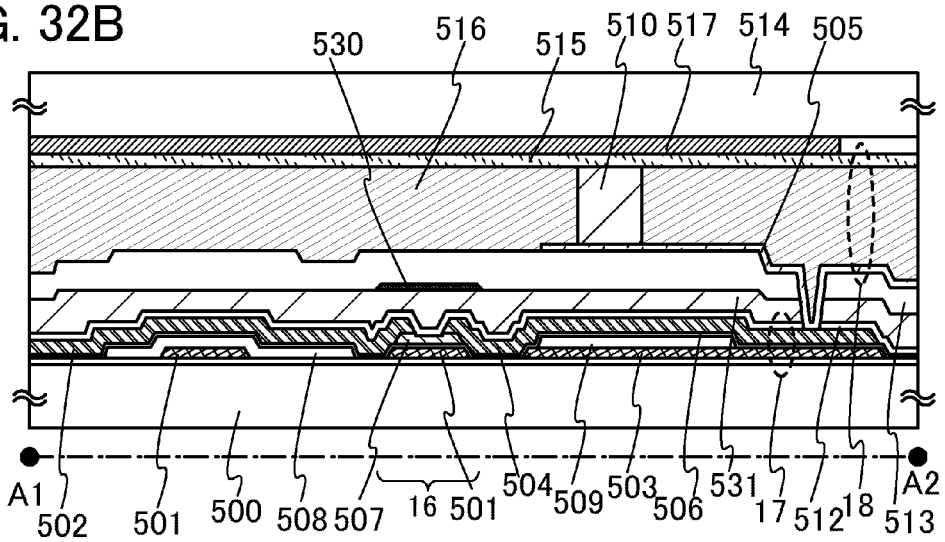

In order to prevent light from entering the active layer 507 more surely, a light-blocking conductive film may be provided so as to overlap with the active layer 507. In FIGS. 32A and 32B, a light-blocking conductive film 530 is provided to overlap with the active layer 507 in the pixel shown in FIGS. 25A and 25B. FIG. 32A is a top view of a pixel, and a cross-sectional view along chain line A1-A2 in FIG. 32A is FIG. 32B.

Specifically, in FIGS. 32A and 32B, an insulating film 531 is provided over the insulating film 512, and the conductive film 530 is formed over the insulating film 531. The insulating film 513 is formed over the insulating film 531 so as to cover the conductive film 530.

The active layer 507 partly overlaps with the conductive films 502 and 504; thus, the active layer 507 has a portion which is covered with either the conductive film 502 or the conductive film 504 and an exposed portion which is covered with none of the conductive films 502 and 504. In FIGS. 32A and 32B, the conductive film 530 is provided so as to overlap with the exposed portion which is covered with none of the conductive films 502 and 504.

With the conductive film 530, the oxide semiconductor in the active layer 507 can be prevented from deteriorating owing to incident light from the substrate 514 side; thus, deterioration of characteristics of the transistor 16, such as a shift of the threshold voltage, can be prevented.

The conductive film 530 may be in a floating state, i.e., electrically insulated, or may be in a state being applied with a potential.

This embodiment can be combined as appropriate with any of the above-described embodiments.

(Embodiment 8)

In Embodiment 8, a transistor 951 was manufactured using the manufacturing method described in another embodiment, a transistor 952 having a back gate electrode was manufactured, and evaluation results of the amount of a change in the threshold voltage (Vth) through a negative bias stress test with light irradiation on the transistors will be described.

Figure 29A:
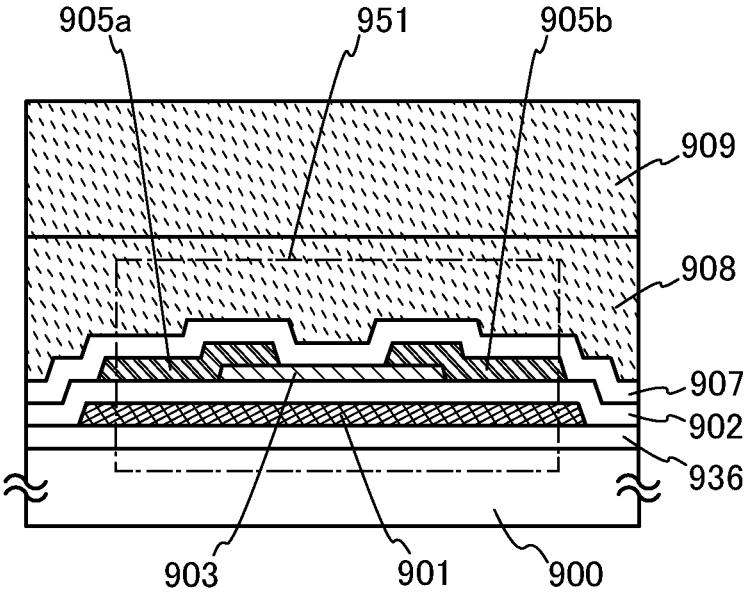
FIGS. 29A and 29B illustrate structures of transistors.

Described first is a stacked-layer structure and a manufacturing method of the transistor 951 with reference to FIG. 29A. Over a substrate 900, a stacked-layer film of a silicon nitride film (thickness: 200 nm) and a silicon oxynitride film (thickness: 400 nm) was formed by a CVD method as a base film 936. Next, over the base film 936, a stacked-layer film of a tantalum nitride film (thickness: 30 nm) and a tungsten film (thickness: 100 nm) was formed by a sputtering method and selectively etched to form a gate electrode 901.

Next, over the gate electrode 901, a silicon oxynitride film (thickness: 30 nm) was formed by a high-density plasma enhanced CVD method as a gate insulating film 902.

Next, over the gate insulating film 902, an oxide semiconductor film (thickness: 30 nm) was formed using a target of an In—Ga—Zn—O-based oxide semiconductor by a sputtering method. Then, the oxide semiconductor film was selectively etched to form an island-shaped oxide semiconductor film 903.

Next, first heat treatment was performed at 450° C. for 60 minutes under a nitrogen atmosphere.

Next, over the oxide semiconductor film 903, a stacked-layer film of a titanium film (thickness: 100 nm), an aluminum film (thickness: 200 nm), and a titanium film (thickness: 100 nm) was formed by a sputtering method and selectively etched to form a source electrode 905*a* and a drain electrode 905*b*.

Next, second heat treatment was performed at 300° C. for 60 minutes under a nitrogen atmosphere.

Next, over the source electrode 905*a* and the drain electrode 905*b*, a silicon oxide film was formed by a sputtering method as an insulating film 907 so as to be in contact with part of the oxide semiconductor film 903, and over the insulating film 907, a polyimide resin film (thickness: 1.5 μm) was formed as an insulating film 908.

Next, third heat treatment was performed at 250° C. for 60 minutes under a nitrogen atmosphere.

Next, over the insulating film 908, a polyimide resin film (thickness: 2.0 μm) was formed as an insulating film 909.

Next, fourth heat treatment was performed at 250° C. for 60 minutes under a nitrogen atmosphere.

Figure 29B:
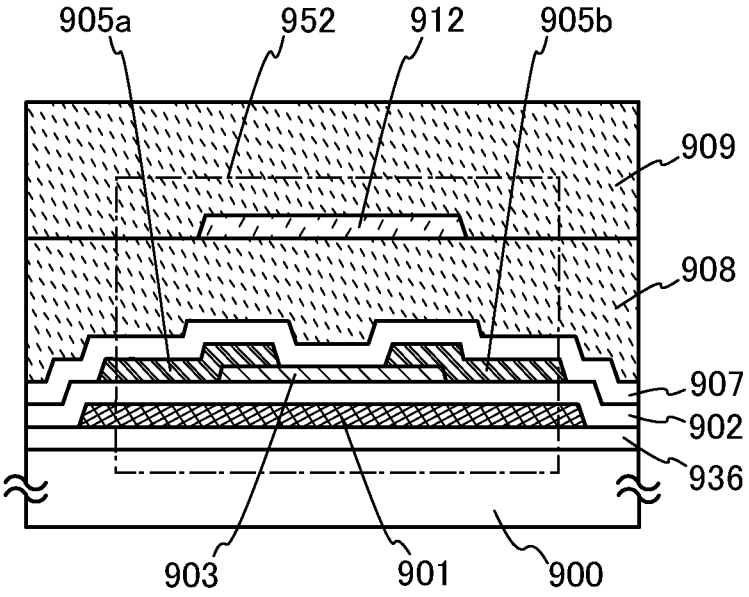

The transistor 952 shown in FIG. 29B can be manufactured in a manner similar to that of the transistor 951. The transistor 952 is different from the transistor 951 in that a back gate electrode 912 is provided between the insulating films 908 and 909. The back gate electrode 912 was formed as follows: a stacked-layer film of a titanium film (thickness: 100 nm), an aluminum film (thickness: 200 nm), and a titanium film (thickness: 100 nm) was formed by a sputtering method over the insulating film 908 and selectively etched. The back gate electrode 912 was electrically connected to the source electrode 905*a*.

In each of the transistors 951 and 952, the channel length is 3 μm and the channel width is 20 μm.

Described next is a negative bias stress test with light irradiation performed on the transistors 951 and 952.

The negative bias stress test with light irradiation is a kind of accelerated test and can evaluate the change of characteristics of a transistor with light irradiation, in a short period of time. In particular, the amount of a change in the threshold voltage Vth of a transistor through the negative bias stress test with light irradiation is an important benchmark for the reliability. The smaller the amount of a change in the threshold voltage Vth of a transistor through the negative bias stress test with light irradiation is, the higher the reliability of the transistor is. The amount of a change through the negative bias stress test with light irradiation is preferably less than or equal to 1 V, far preferably less than or equal to 0.5 V.

Specifically, according to the negative bias stress test with light irradiation, the temperature of a substrate provided with a transistor (substrate temperature) is kept at a fixed temperature, a source electrode and a drain electrode of the transistor are set at the same potential, and a gate electrode of the transistor is applied with a potential lower than the potential of the source electrode and the drain electrode for a certain period while irradiating the transistor with light.

The stress intensity of a negative bias stress test with light irradiation can be determined in accordance with the light irradiation condition, the substrate temperature, the intensity of electric field applied to a gate insulating film, and a time of applying the electric field. The intensity of the electric field applied to the gate insulating film is determined in accordance with a value obtained by dividing a potential difference between a gate electrode and a source and drain electrodes by the thickness of the gate insulating film. For example, in the case where the intensity of the electric field applied to the gate insulating film with a thickness of 100 nm is to be 2 MV/cm, the potential difference may be set to 20 V.

A test in which a potential higher than that of a source electrode and a drain electrode is applied to a gate electrode under light irradiation is called a positive bias stress test with light irradiation. The characteristics of a transistor are more likely to change through a negative bias stress test with light irradiation than through the positive bias stress test with light irradiation, and therefore, the negative bias stress test with light irradiation was adopted in this embodiment.

The negative bias stress test with light irradiation in this embodiment was performed in the following condition: the substrate temperature is room temperature (25° C.), the electric field intensity applied to the gate insulating film 902 is 2 MV/cm, and a period of light irradiation and electric field application is 1 hour. The condition of the light irradiation was as follows: a xenon light source "MAX-302" manufactured by Asahi Spectra Co., Ltd. is used, the peak wavelength is 400 nm (half width: 10 nm), and irradiance is 326 μW/cm$^2$.

Prior to the negative bias stress test with light irradiation, initial characteristics of each transistor were measured. Measured in this embodiment were Vg-Id characteristics, that is, change characteristics of a current which flows between the source electrode and the drain electrode (the current hereinafter referred to as a drain current or Id) under the following condition: the substrate temperature is room temperature (25° C.), the voltage between the source electrode and the drain electrode (the voltage hereinafter referred to as a drain voltage or Vd) is 3 V, and the voltage between the source electrode and the gate electrode (the voltage hereinafter referred to as a gate voltage or Vg) is changed from −5 V to +5 V.

Next, light irradiation on the insulating film 909 side was started, the potential of each of the source and drain electrodes of the transistor was set to 0 V, and a negative voltage was applied to the gate electrode 901 such that the intensity of an electric field applied to the gate insulating film 902 of the transistor became 2 MV/cm. In this embodiment, since the thickness of the gate insulating film 902 of the transistor was 30 nm, and therefore −6 V was applied to the gate electrode 901 and kept for 1 hour. The time of the voltage application was 1 hour in this embodiment; however, the time may be determined as appropriate in accordance with the purpose.

Next, the voltage application was ended, but while keeping the light irradiation, the Vg-Id characteristics were measured under the condition which is the same as the measurement of the initial characteristics, so that the Vg-Id characteristics after the negative bias stress test with light irradiation were obtained.

Figure 30:
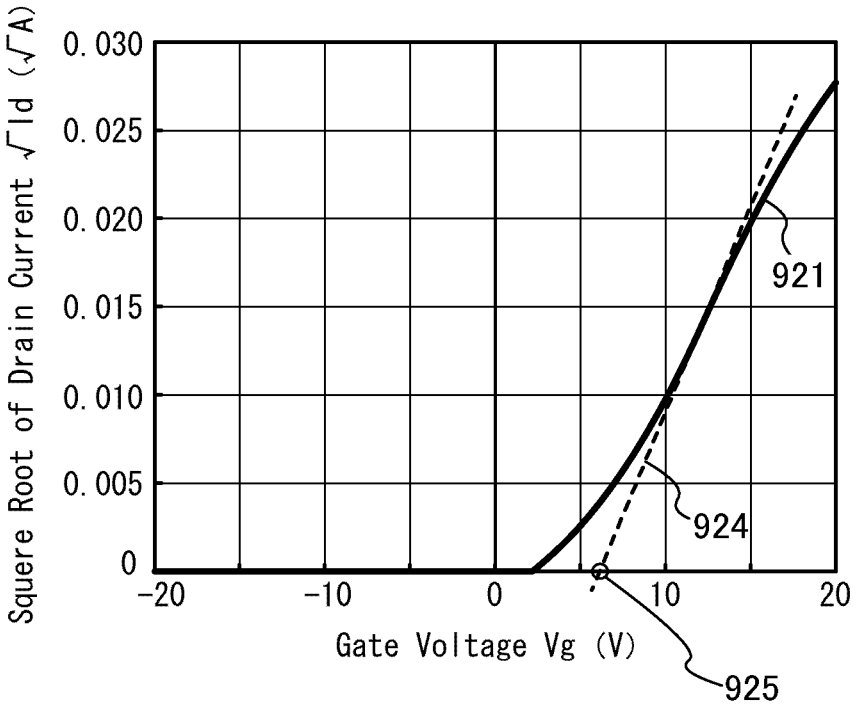
FIG. 30 is a graph for defining Vth.

The threshold voltage Vth in this embodiment is defined below using FIG. 30. In FIG. 30, the horizontal axis represents the gate voltage on a linear scale and the vertical axis represents the square root of the drain current (hereinafter also referred to as √Id) on a linear scale. A curve 921 indicates the square root of value of Vth in the Vg-Id characteristics (the curve hereinafter also referred to as a √Id curve).

First, the √Id curve (the curve 921) is obtained from the Vg-Id curve. Then, a tangent 924 to a point on the √Id curve at which a differential value of the √Id curve is the maximum is obtained. Then, the tangent 924 is extended, and the gate voltage Vg at a drain current Id of 0 A on the tangent line 924, that is, a value at a horizontal-axis-intercept, i.e., gate-voltage-axis-intercept 925 of the tangent 924 is defined as Vth.

Figure 31A:
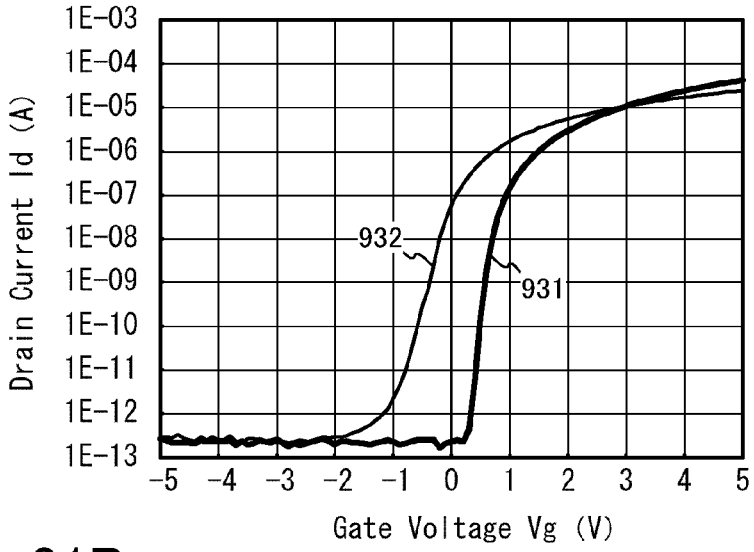
FIGS. 31A to 31C are graphs showing results of a negative bias stress test with light irradiation.
Figure 31B:
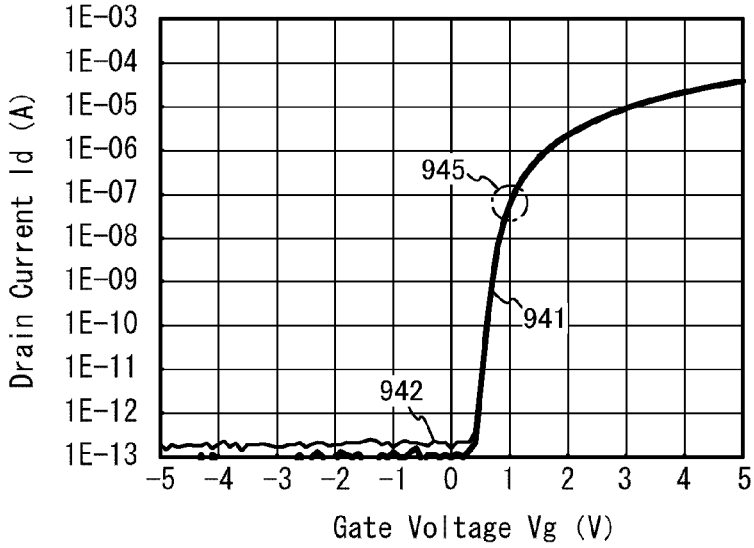
Figure 31C:
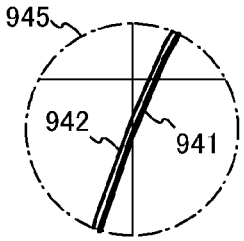

FIGS. 31A to 31C show the Vg-Id characteristics of the transistors 951 and 952 before and after the negative bias stress test with light irradiation. In each of FIGS. 31A and 31B, the horizontal axis represents the gate voltage (Vg), and the vertical axis represents the drain current (Id) with respect to the gate voltage on a logarithmic scale.

FIG. 31A shows the Vg-Id characteristics of the transistor 951 before and after the negative bias stress test with light irradiation. Initial characteristics 931 are the Vg-Id characteristics of the transistor 951 before being subjected to the negative bias stress test with light irradiation, and post-test characteristics 932 are the Vg-Id characteristics of the transistor 951 after being subjected to the negative bias stress test with light irradiation. The threshold voltage Vth of the initial characteristics 931 was 1.01 V, and that of the post-test characteristics 932 was 0.44 V.

FIG. 31B shows the Vg-Id characteristics of the transistor 952 before and after the negative bias stress test with light irradiation. FIG. 31C is an enlarged graph of a portion 945 in FIG. 31B. Initial characteristics 941 are the Vg-Id characteristics of the transistor 952 before being subjected to the negative bias stress test with light irradiation, and post-test characteristics 942 are the Vg-Id characteristics of the transistor 952 after being subjected to the negative bias stress test with light irradiation. The threshold voltage Vth of the initial characteristics 941 was 1.16 V, and that of the post-test characteristics 942 was 1.10 V. Since the back gate electrode 912 of the transistor 952 is electrically connected to the source electrode 905*a*, the potential of the back gate electrode 912 equals to that of the source electrode 905*a*.

In FIG. 31A, the threshold voltage Vth of the post-test characteristics 932 is changed by 0.57 V in the negative direction from that of the initial characteristics 931; in FIG. 31B, the threshold voltage Vth of the post-test characteristics 942 is changed by 0.06 V in the negative direction from that of the initial characteristics 941. The amount of a change of either of the transistor 951 and the transistor 952 is less than 1 V, from which it can be confirmed that both of the transistors have high reliability. In addition, since the amount of a change of the threshold voltage Vth of the transistor 952 provided with the back gate electrode 912 is less than 0.1 V, it can be confirmed that the transistor 952 has higher reliability than the transistor 951.

EXAMPLE 1

With a liquid crystal display device of one embodiment of the present invention, an electronic device capable of displaying a high-quality image can be provided. With the liquid crystal display device of one embodiment of the present invention, an electronic device with low power consumption can be provided. In particular, in a mobile electronic device to which power cannot be easily supplied constantly, a liquid crystal display device of one embodiment of the present invention included as a component provides a merit of an increase in continuous use time.

A liquid crystal display device of one embodiment of the present invention can be used for display devices, laptop computers, or image reproducing devices provided with recording media (typically, devices which reproduce the content of recording media such as digital versatile discs (DVDs) and have displays for displaying the reproduced image). In addition to the above examples, as an electronic device which can include a liquid crystal display device of one embodiment of the present invention, the following can be given: mobile phones, portable game machines, portable information terminals, e-book readers, cameras such as video cameras or digital still cameras, goggle-type displays (head mounted displays), navigation systems, audio reproducing devices (e.g., car audio components and digital audio players), copiers, facsimiles, printers, multifunction printers, automated teller machines (ATM), vending machines, and the like. Specific examples of such electronic devices are shown in FIGS. 28A to 28F.

Figure 28A:
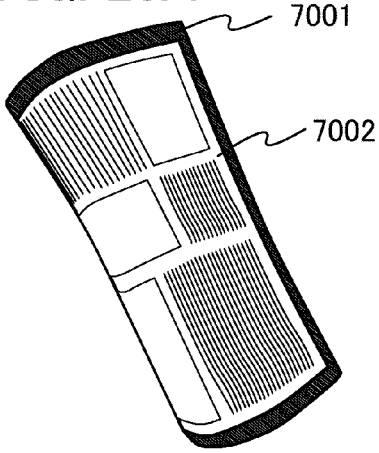
FIGS. 28A to 28F each illustrate an electronic device.

FIG. 28A illustrates an e-book reader including a housing 7001, a display portion 7002, and the like. A liquid crystal display device of one embodiment of the present invention can be used for the display portion 7002. With the liquid crystal display device of one embodiment of the present invention applied to the display portion 7002, an e-book reader capable of displaying a high-quality image or an e-book reader with low power consumption can be provided. Moreover, a panel can be formed using a flexible substrate and a touch panel can be flexible, whereby the liquid crystal display device can have flexibility, which enables a flexible, lightweight, and easy-to-use e-book reader to be provided.

Figure 28B:
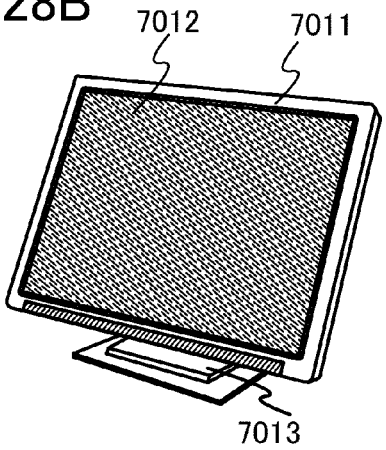

FIG. 28B illustrates a display device including a housing 7011, a display portion 7012, a support 7013, and the like. A liquid crystal display device of one embodiment of the present invention can be used for the display portion 7012. With the liquid crystal display device of one embodiment of the present invention applied to the display portion 7012, a display device capable of displaying a high-quality image or a display device with low power consumption can be provided. The display device includes in its category, any information display device for personal computers, TV broadcast reception, advertisement, and the like.

Figure 28C:
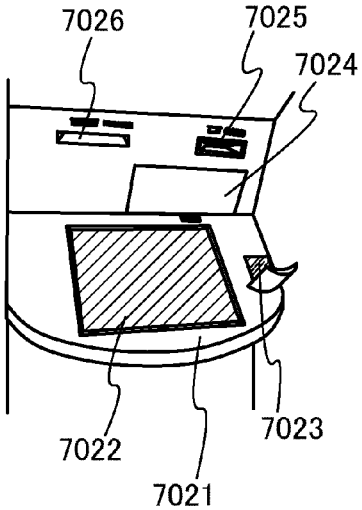

FIG. 28C illustrates an automated teller machine including a housing 7021, a display portion 7022, a coin slot 7023, a bill slot 7024, a card slot 7025, a bankbook slot 7026, and the like. A liquid crystal display device of one embodiment of the present invention can be used for the display portion 7022. With the liquid crystal display device of one embodiment of the present invention applied to the display portion 7022, an automated teller machine capable of displaying a high-quality image or an automated teller machine with low power consumption can be provided.

Figure 28D:
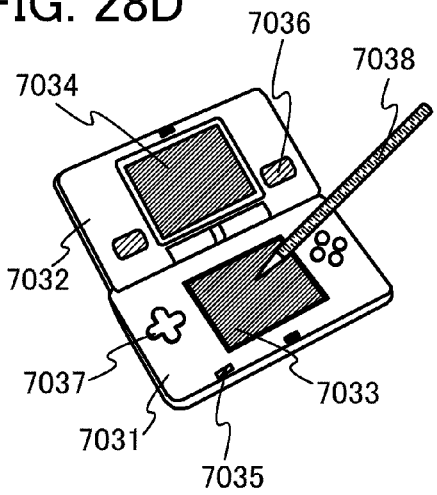

FIG. 28D illustrates a portable game machine including a housing 7031, a housing 7032, a display portion 7033, a display portion 7034, a microphone 7035, speakers 7036, operation keys 7037, a stylus 7038, and the like. A liquid crystal display device of one embodiment of the present invention can be used for the display portion(s) 7033 and/or 7034. With the liquid crystal display device of one embodiment of the present invention applied to the display portion(s) 7033 and/or 7034, a portable game machine capable of displaying a high-quality image or a portable game machine with low power consumption can be provided. Although the portable game machine illustrated in FIG. 28D has the two display portions 7033 and 7034, the number of display portions included in the portable game machine is not limited to two.

Figure 28E:
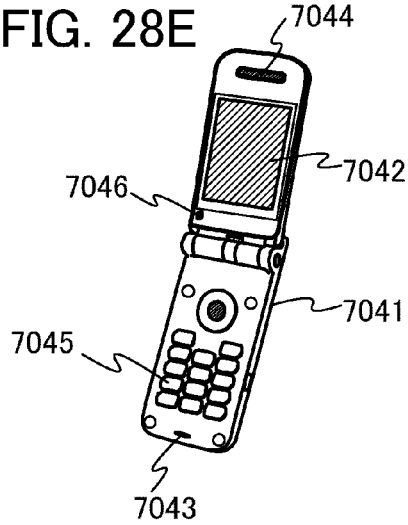

FIG. 28E illustrates a mobile phone including a housing 7041, a display portion 7042, an audio input portion 7043, an audio output portion 7044, operation keys 7045, a light-receiving portion 7046, and the like. Light received in the light-receiving portion 7046 is converted into electrical signals, whereby external images can be loaded. A liquid crystal display device of one embodiment of the present invention can be used for the display portion 7042. With the liquid crystal display device of one embodiment of the present invention applied to the display portion 7042, a mobile phone capable of displaying a high-quality image or a mobile phone with low power consumption can be provided.

Figure 28F:
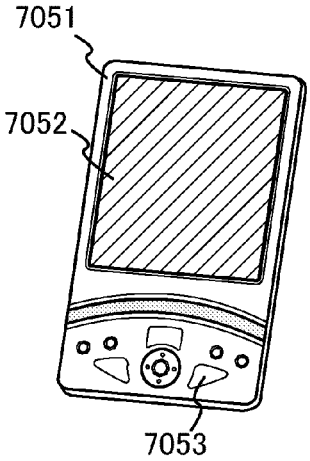

FIG. 28F illustrates a portable information terminal including a housing 7051, a display portion 7052, operation keys 7053, and the like. A modem may be incorporated in the housing 7051 of the portable information terminal illustrated in FIG. 28F. A liquid crystal display device of one embodiment of the present invention can be used for the display portion 7052. With the liquid crystal display device of one embodiment of the present invention applied to the display portion 7052, a portable information terminal capable of displaying a high-quality image or a portable information terminal with low power consumption can be provided.

This example can be combined as appropriate with any of the above-described embodiments.

EXPLANATION OF REFERENCE

10: pixel portion; 11: scan line driver circuit; 12: signal line driver circuit; 15: pixel; 16: transistor; 17: capacitor; 18: liquid crystal element; 20: pulse output circuit; 21: terminal;

22: terminal; 23: terminal; 24: terminal; 25: terminal; 26: terminal; 27: terminal; 31: transistor; 32: transistor; 33: transistor; 34: transistor; 35: transistor; 36: transistor; 37: transistor; 38: transistor; 39: transistor; 50: transistor; 51: transistor; 52: transistor; 53: transistor; 60: pixel portion; 61: scan line driver circuit; 62: signal line driver circuit; 65*a*: transistor; 65*b*: transistor; 65*c*: transistor; 101: region; 102: region; 103: region; 120: shift register; 121: transistor; 123: switching element group; 301: full-color image display period; 302: monochrome moving image display period; 303: monochrome still image display period; 400: liquid crystal display device; 401: image memories; 402: image data selection circuit; 403: selector; 404: CPU; 405: controller; 406: panel; 407: backlight; 408: backlight control circuit; 410: full-color image data; 411: monochrome image data; 412: pixel portion; 413: signal line driver circuit; 414: scan line driver circuit; 420: input device; 421: photometric circuit; 500: substrate; 501: conductive film; 502: conductive film; 503: conductive film; 504: conductive film; 505: pixel electrode; 506: gate insulating film; 507: active layer; 508: insulating film; 509: insulating film; 510: spacer; 512: insulating film; 513: insulating film; 514: substrate; 515: counter electrode; 516: liquid crystal layer; 517: light-blocking film; 530: conductive film; 531: insulating film; 601: region; 602: region; 603: region; 611: shift register; 612: shift register; 613: shift register; 615: pixel; 616: transistor; 617: capacitor; 618: liquid crystal element; 620: shift register; 623: switching element group; 700: substrate; 701: insulating film; 702: gate electrode; 703: gate insulating film; 704: oxide semiconductor film; 705: conductive film; 706: conductive film; 707: insulating film; 708: transistor; 900: substrate; 901: gate electrode; 902: gate insulating film; 903: oxide semiconductor film; 905*a*: source electrode; 905*b*: drain electrode; 907: insulating film; 908: insulating film; 909: insulating film; 912: back gate electrode; 921: curve; 924 tangent line; 925: gate-voltage-axis-intercept; 931: initial characteristics; 932: post-test characteristics; 936: base film; 941: initial characteristics; 942: post-test characteristics; 945: portion; 951: transistor; 952: transistor; 1601: panel; 1602: first diffusion plate; 1603: prism sheet; 1604: second diffusion plate; 1605: light guide plate; 1607: backlight panel; 1608: circuit board; 1609: COF tape; 1610: FPC; 1611: substrate; 1612: backlight; 2400: substrate; 2401: gate electrode; 2402: gate insulating film; 2403: oxide semiconductor film; 2405*a*: source electrode; 2405*b*: drain electrode; 2406: channel protective film; 2407: insulating film; 2409: protective insulating film; 2411: first gate electrode; 2412: second gate electrode; 2413: first gate insulating film; 2414: second gate insulating film; 2436: base film; 2450: transistor; 2460: transistor; 2470: transistor; 2480: transistor; 4001: substrate; 4002: pixel portion; 4003: signal line driver circuit; 4004: scan line driver circuit; 4005: sealant; 4006: counter substrate; 4007: liquid crystal; 4009: transistor; 4010: transistor; 4011: liquid crystal element; 4014: lead wiring; 4015: lead wiring; 4016: connection terminal; 4018: FPC; 4019: anisotropic conductive film; 4021: substrate; 4022: transistor; 4030: pixel electrode; 4031: counter electrode; 4035: spacer; 4040: light-blocking film; 6110: transfer substrate; 6111: first adhesive layer; 6116: layer to be separated; 6200: substrate; 6201: separation layer; 6202: temporary supporting substrate; 6203: adhesive for separation; 6206: metal plate; 6207: barrier layer; 6210: first wiring layer; 6211: second wiring layer; 6212: region; 7001: housing; 7002: display portion; 7011: housing; 7012: display portion; 7013: support; 7021: housing; 7022: display portion; 7023: coin slot; 7024: bill slot; 7025: card slot; 7026: bankbook slot; 7031: housing; 7032: housing; 7033: display portion; 7034: display portion; 7035: microphone; 7036: speakers; 7037: operation keys; 7038: stylus; 7041: housing; 7042: display portion; 7043: audio input portion; 7044: audio output portion; 7045: operation keys; 7046: light-receiving portion; 7051: housing; 7052: display portion; 7053: operation keys.

This application is based on Japanese Patent Application serial no. 2010-152158 filed with Japan Patent Office on Jul. 2, 2010, the entire contents of which are hereby incorporated by reference.

The invention claimed is:

1. A liquid crystal display device comprising:

a pixel portion including a first region including a first pixel and a second pixel and a second region including a third pixel and a fourth pixel, wherein the second pixel is located closer to the second region than the first pixel and the third pixel is located closer to the first region than the fourth pixel; and a plurality of light sources including first light sources emitting a first hue and second light sources emitting a second hue, wherein each of the first pixel, the second pixel, the third pixel, and the fourth pixel includes a liquid crystal element whose transmissivity is controlled in accordance with a voltage of an image signal and a transistor for controlling holding of the voltage, wherein a channel formation region of the transistor contains an oxide semiconductor film whose crystal is c-axis-aliqned in a direction substantially perpendicular to a surface of the oxide semiconductor film, wherein the plurality of light sources are configured to perform a first driving and a second driving, wherein after a first image signal is written to the first pixel, a first light with the first hue is supplied to the first pixel in the first driving, wherein after a second image signal is written to the third pixel, a second light with the second hue is supplied to the third pixel in the first driving, wherein after a third image signal is written to the second pixel while the first light with the first hue is supplied to the first pixel and the second light with the second hue is supplied to the third pixel, the first light with the first hue is supplied to the second pixel in the first driving, wherein after a fourth image signal is written to the fourth pixel while the first light with the first hue is supplied to the first pixel and the second light with the second hue is supplied to the third pixel, the second light with the second hue is supplied to the fourth pixel in the first driving, wherein a light having a single hue is supplied consecutively to one or both of the first region and the second region in the second driving, wherein a period for holding the voltage is different between the first driving and the second driving, and wherein an interval between writings of image signals is 1 minute or more in the second driving.

2. The liquid crystal display device according to claim 1, wherein the oxide semiconductor is an In—Ga—Zn—O-base oxide semiconductor.

3. The liquid crystal display device according to claim 1, wherein a hydrogen concentration of the channel formation region is less than or equal to $5\times10^{19}$ /cm$^3$.

4. The liquid crystal display device according to claim 1, wherein an off-state current density of the transistor is less than or equal to 100 yA/μm.

5. A liquid crystal display device comprising:

a pixel portion including a first region including a first pixel and a second pixel and a second region including a third pixel and a fourth pixel, wherein the second pixel is located closer to the second region than the first pixel and the third pixel is located closer to the first region than the fourth pixel; and a plurality of light sources including first light sources emitting a first hue and second light sources emitting a second hue, wherein each of the first pixel, the second pixel, the third pixel, and the fourth pixel includes a liquid crystal element whose transmissivity is controlled in accordance with a voltage of an image signal and a transistor for controlling holding of the voltage, wherein a channel formation region of the transistor contains an oxide semiconductor film whose crystal is c-axis-aliqned in a direction substantially perpendicular to a surface of the oxide semiconductor film, wherein the plurality of light sources are configured to perform a first driving and a second driving, wherein after a first image signal is written to the first pixel, a first light with the first hue is supplied to the first pixel in the first driving, wherein after a second image signal is written to the third pixel, a second light with the second hue is supplied to the third pixel in the first driving, wherein after a third image signal is written to the second pixel while the first light with the first hue is supplied to the first pixel and the second light with the second hue is supplied to the third pixel, the first light with the first hue is supplied to the second pixel in the first driving, wherein after a fourth image signal is written to the fourth pixel while the first light with the first hue is supplied to the first pixel and the second light with the second hue is supplied to the third pixel, the second light with the second hue is supplied to the fourth pixel in the first driving, wherein a light having a single hue is supplied consecutively to one or both of the first region and the second region in the second driving, wherein a period for holding the voltage is increased when a driving is switched from the first driving to the second driving, and wherein an interval between writings of image signals is 1 minute or more in the second driving.

6. The liquid crystal display device according to claim 5, wherein the oxide semiconductor is an In—Ga—Zn—O-base oxide semiconductor.

7. The liquid crystal display device according to claim 5, wherein a hydrogen concentration of the channel formation region is less than or equal to $5\times10^{19}$ /cm$^3$.

8. The liquid crystal display device according to claim 5, wherein an off-state current density of the transistor is less than or equal to 100 yA/μm.

9. A liquid crystal display device comprising:

a pixel portion including a first region including a first pixel and a second pixel and a second region including a third pixel and a fourth pixel, wherein the second pixel is located closer to the second region than the first pixel and the third pixel is located closer to the first region than the fourth pixel;

a plurality of light sources including first light sources emitting a first hue and second light sources emitting a second hue; and an input device, wherein each of the first pixel, the second pixel, the third pixel, and the fourth pixel includes a liquid crystal element whose transmissivity is controlled in accordance with a voltage of an image signal and a transistor for controlling holding of the voltage, wherein a channel formation region of the transistor contains an oxide semiconductor film whose crystal is c-axis-aliened in a direction substantially perpendicular to a surface of the oxide semiconductor film, wherein the plurality of light sources are configured to perform a first driving and a second driving, wherein after a first image signal is written to the first pixel, a first light with the first hue is supplied to the first pixel in the first driving, wherein after a second image signal is written to the third pixel, a second light with the second hue is supplied to the third pixel in the first driving, wherein after a third image signal is written to the second pixel while the first light with the first hue is supplied to the first pixel and the second light with the second hue is supplied to the third pixel, the first light with the first hue is supplied to the second pixel in the first driving, wherein after a fourth image signal is written to the fourth pixel while the first light with the first hue is supplied to the first pixel and the second light with the second hue is supplied to the third pixel, the second light with the second hue is supplied to the fourth pixel in the first driving, wherein a light having a single hue is supplied consecutively to one or both of the first region and the second region in the second driving, wherein a driving is switched between the first driving and the second driving in accordance with a signal from the input device, wherein a period for holding the voltage is different between the first driving and the second driving, and wherein an interval between writings of image signals is 1 minute or more in the second driving.

10. The liquid crystal display device according to claim 9, wherein the oxide semiconductor is an In—Ga—Zn—O-base oxide semiconductor.

11. The liquid crystal display device according to claim 9, wherein a hydrogen concentration of the channel formation region is less than or equal to $5\times10^{19}$ /cm$^3$.

12. The liquid crystal display device according to claim 9, wherein an off-state current density of the transistor is less than or equal to 100 yA/μm.

13. A liquid crystal display device comprising:

a pixel portion including a first region including a first pixel and a second pixel and a second region including a third pixel and a fourth pixel, wherein the second pixel is located closer to the second region than the first pixel and the third pixel is located closer to the first region than the fourth pixel;

a plurality of light sources including first light sources emitting a first hue and second light sources emitting a second hue; and an input device, wherein each of the first pixel, the second pixel, the third pixel, and the fourth pixel includes a liquid crystal element whose transmissivity is controlled in accordance with a voltage of an image signal and a transistor for controlling holding of the voltage, wherein a channel formation region of the transistor contains an oxide semiconductor film whose crystal is c-axis-aligned in a direction substantially perpendicular to a surface of the oxide semiconductor film, wherein the plurality of light sources are configured to perform a first driving and a second driving, wherein after a first image signal is written to the first pixel, a first light with the first hue is supplied to the first pixel in the first driving, wherein after a second image signal is written to the third pixel, a second light with the second hue is supplied to the third pixel in the first driving, wherein after a third image signal is written to the second pixel while the first light with the first hue is supplied to the first pixel and the second light with the second hue is supplied to the third pixel, the first light with the first hue is supplied to the second pixel in the first driving, wherein after a fourth image signal is written to the fourth pixel while the first light with the first hue is supplied to the first pixel and the second light with the second hue is supplied to the third pixel, the second light with the second hue is supplied to the fourth pixel in the first driving, wherein a light having a single hue is supplied consecutively to one or both of the first region and the second region in the second driving, wherein a driving is switched between the first driving and the second driving in accordance with a signal from the input device, wherein a period for holding the voltage is increased when the driving is switched from the first driving to the second driving, and wherein an interval between writings of image signals is 1 minute or more in the second driving.

14. The liquid crystal display device according to claim 13, wherein the oxide semiconductor is an In—Ga—Zn—O-base oxide semiconductor.

15. The liquid crystal display device according to claim 13, wherein a hydrogen concentration of the channel formation region is less than or equal to $5\times10^{19}$ /cm$^3$.

16. The liquid crystal display device according to claim 13, wherein an off-state current density of the transistor is less than or equal to 100 yA/μm.

* * * * *